US006418854B1

(12) United States Patent
Kraft

(10) Patent No.: US 6,418,854 B1
(45) Date of Patent: Jul. 16, 2002

(54) PRIORITY CAR SORTING IN RAILROAD CLASSIFICATION YARDS USING A CONTINUOUS MULTI-STAGE METHOD

(76) Inventor: Edwin R. Kraft, 512 Partridge Way, Frederick, MD (US) 21703

( * ) Notice: Subject to any disclaimer, the term of this patent is extended or adjusted under 35 U.S.C. 154(b) by 0 days.

(21) Appl. No.: 09/716,300

(22) Filed: Nov. 21, 2000

(51) Int. Cl.[7] ..... B61B 1/00
(52) U.S. Cl. ..... 104/26.1
(58) Field of Search ..... 104/26.1, 26.2, 104/307; 340/536, 933; 105/61; 246/30, 2 R; 701/19

(56) References Cited

U.S. PATENT DOCUMENTS 2,045,695 A * 6/1936 Brown ..... 104/26.1
2,948,234 A * 8/1960 Hughson ..... 104/26.1
2,976,817 A * 3/1961 Stapp ..... 104/26.1
3,307,031 A * 2/1967 Frielinghaus et al. ..... 246/2 R
3,598,990 A * 8/1971 Convey ..... 104/26.1
3,727,559 A * 4/1973 McCune et al. ..... 104/26.1
3,861,316 A * 1/1975 Yamazaki et al. ..... 104/26.1
3,865,042 A * 2/1975 DePaola et al. ..... 104/26.1
3,889,603 A * 6/1975 Harada ..... 104/26.1
4,034,677 A * 7/1977 Frank ..... 104/26.1
4,610,206 A * 9/1986 Kubala et al. ..... 104/26.1
4,689,602 A * 8/1987 Morihara et al. ..... 340/536
4,883,245 A * 11/1989 Erickson, Jr. ..... 246/2 R
5,623,413 A * 4/1997 Matheson et al. ..... 246/2 R
5,758,848 A * 6/1998 Beule ..... 246/2 R
5,777,547 A * 7/1998 Waldrop ..... 340/536
5,986,577 A * 11/1999 Bezos ..... 340/933
5,986,579 A * 11/1999 Halvorson ..... 340/933

OTHER PUBLICATIONS

James A. Wetzel, *Optimal Use of Classification Yards*, Transportation Research Record 1029, Railroad Productivity, Transportation Research Board, National Research Council, Washington DC, 1985, pp. 36–41.

* cited by examiner

*Primary Examiner*—S. Joseph Morano
*Assistant Examiner*—Lars A. Olson
(74) *Attorney, Agent, or Firm*—Donald A. Kettlestrings

(57) ABSTRACT

A new method of sorting railroad cars in yards is presented, whereby outbound trains are built in proper standing order for departure directly on classification tracks, using a continuously sustainable multi-stage sorting process. During this process, cars are easily separated based on priority or according to their delivery time commitments, so connections of cars needing to go on a specific train can be protected. During second stage sorting operations, railcars may be inspected or repaired while they await outbound connections on classification tracks, effectively utilizing otherwise idle time and resulting in considerable savings in time required for railcars to pass through the yard. The need for a separate departure yard, along with the bottleneck "flat" switching operation at the departure end of the classification yard, is also eliminated. This sorting process may be implemented in a traditional rail yard setting, but it will yield even more benefit if accomplished in one of the specialized facility designs shown in the drawing figures.

32 Claims, 46 Drawing Sheets

PRIORITY CAR SORTING IN RAILROAD CLASSIFICATION YARDS USING A CONTINUOUS MULTI-STAGE METHOD

FIELD OF THE INVENTION

This invention relates to railroads particularly to methods of sorting cars in railroad yards.

DESCRIPTION OF THE RELATED ART

The purpose of sorting railroad cars is to collect them into "blocks" or groups of cars moving together to the next rail terminal, or having commodity, car type or some other attribute in common. Once individual cars have been collected into blocks, the blocks can be assembled into trains. If a train makes any intermediate stops? blocks are usually arranged in order of the sequence of stops, so all intermediate switching can be performed from the front (or occasionally the rear) of the train. Armstrong, J. H. (1998) in *The Railroad: What It Is, What It Does: The Introduction to Railroading*, 4th *Edition*. Simmons-Boardman Books, Omaha. Nebr. offers an excellent introductory text with a section on railroad terminal operations at pp. 197–211.

A railroad "hump yard" utilizes a raised section of track, from which cars are individually cut off, and allowed to roll by gravity into their proper classification tracks. This contrasts with a "flat yard" where railcars are individually shoved into their proper tracks by switch engines. In single stage sorting, only one block is assigned to a track at any point in time. Multiple stage sorting builds more than one block on each track simultaneously. Beckmann, M. J., McGuire C. B. and Winsten C. B. (1956) in *Studies in the Economics of Transportation*. Oxford University Press, London, on pp. 127–171 describe in detail the differences between hump versus flat yards, as well as ways their use can be coordinated to minimize total switching and delay cost. Troup, K. F., ed. (1975) in *Railroad Classification Yard Technology: An Introductory Analysis of Functions and Operations*, Transportation Systems Center, Cambridge, Mass., (DOT-TSC-FRA-7519), NTIS #PB246724, hereinafter Troup (1975), developed a "primer" on railroad yard operations. In general, hump yards are better suited for classification of railcars one-at-a-time, while flat yards may be more efficient for large blocks or "cuts" of cars which remain coupled together during the switching movement.

Very few hump yards have been built in recent years, as railroads have suffered the loss of a large portion of their traffic base to trucking competitors. The clear trend has been towards closing of hump yards rather than building new facilities; in some cases, portions of old facilities remain in use as flat switching yards, as in Russell, Ky., Dewitt, N.Y., and Enola, Pa.; in some cases former hump yards have been converted into intermodal facilities as happened to Norfolk Southern's yards in Atlanta, Ga. and Rutherford, Pa.; sometimes land has been released for non-transportation use, as in Potomac Yard, Va., just a stone's throw away from the U.S. Patent and Trademark Office in Crystal City. Many surviving facilities now operate at close to maximum throughput and under a state of chronic congestion, to the point that they often cannot even accept newly arriving trains, which have to be parked on the main line. Needless to say, this has an extreme adverse effect on railroad service reliability, which in turn has contributed to further loss of traffic to the trucking industry.

Although computers and new hardware have automated some previously manual processes—in particular, control of speed and routing of freely rolling railcars in hump yards— the fundamental process of sorting cars and associated facility designs have changed very little since hump yards were first invented nearly a century ago. In the single-stage sorting approach commonly in use today, each block is assigned its own track. Each car must be sorted only once, but the maximum number of blocks built is limited to the number of tracks available. For example, a 50track yard could build a maximum of 50 blocks at one time using a single stage approach. Yards designed for single stage sorting need a large number of tracks, so they can build the maximum number of blocks possible. Since cars are sorted into many tracks, individual tracks can be short. Usually there are not enough tracks to build all needed blocks, so small blocks typically have only part-time availability in the yard.

By contrast, multiple stage sorting needs fewer tracks, but each car must be sorted more than once. For example, using the "geometric" or "triangular" sorting patterns (see FIGS. 1 and 2), four trains with a total of 29 or 26 blocks, respectively, can be built simultaneously using only four tracks. Yards designed for multiple stage sorting need only a few tracks, but since each track must hold several blocks at once, tracks should be long enough to hold an entire train. The requirement to process cars more than once also implies a need for a high capacity hump.

Multiple-stage sing is undeniably a more powerful approach, but in the United States the need to process cars more than once has been viewed as costly and inefficient, so it has not been commonly applied in practice. Indeed, facilities designed for single-stage sorting are not well suited for multi-stage sorting because of differences in the basic design parameters for each kind of yard. But as will be shown herein, in a properly designed facility multiple-stage sorting can be not only more powerful, but even more efficient than single stage sorting because the costly flat switching operation at the "trim" end of the yard can be eliminated altogether.

A primary objective of this invention is to provide railroads a practical means to classify cars on a priority basis. While some cars don't need to move on any particular schedule, other cars have strict delivery deadlines. Although it is always desirable to be able to increase train capacity to handle all traffic on a same-day basis, it is not always possible to increase capacity nor would it always be economical. So in the event an outbound train has more cars than it can carry, it is essential to make certain that any cars having no remaining slack time in their delivery commitments have first access to available train capacity.

But today, because of the severely limited capabilities of single stage sorting, cars are sorted by destination block only, and not by specific outbound train. The scheme is essentially first come first served rather than reflecting the priority of individual shipments. Some cars not needing to go may occupy space needed to accomodate higher priority shipments, resulting in unnecessary missed connections and service failures.

If airlines (like railroads) allowed passengers to board aircraft without regard to whether they held tickets for a flight, revenue management would be impossible. The implications for railroads should be clear: to take advantage of revenue management technology which has been successfully applied by many other industries—including railroads' direct competitor, the trucking industry—it is essential that classification yard performance be improved to the level where connections can be guaranteed to specific trains. Yet, even very recent published literature as in Gallagher, J.

(1999) Reconsider This, *Traffic World*, Jul. 12, 1999 on pp. 32–33 still holds that "you can't use data in real time to modify the way you handle individual cars. It's impractical."

Prior Art Methods of Single Stage Sorting

Traditionally, large hump yards are subdivided into three separate areas, with tracks dedicated to specific functions: (a) Inbound trains; arrive on the receiving tracks. Cars are inspected for mechanical defects and air brakes released so cars can roll free. (b) To classify an inbound train, a switch engine couples to the train in the receiving yard and then shoves cars to the hump, where they are uncoupled and individually roll into their proper classification tracks by gravity. (c) Once enough cars have been collected to run an outbound train, or the scheduled "close-out" time arrives, blocks of cars are pulled from the "trim" end of the yard (opposite the hump) by switch engines and moved into the departure tracks. There, air hoses are reconnected, air brakes charged and tested, and a final inspection of the train is made before departure. A typical single stage hump yard design with these three subyards is diagrammed in FIG. 5.

Small yards combine all these functions on the same tracks, so they can be more flexible than large facilities; but since small yards usually rely on flat switching, they are not as efficient as larger hump yards. Traditional single stage hump yard designs have the following shortcomings:

(a) A large number of tracks are required. For each track, switches and car retarder units (used for speed control) are required, which are expensive to build and maintain.

(b) As many classification tracks "fan out" from the hump, the outermost tracks have sharp curves, which can bind the wheels of cars causing them to stop short of their destinations. When this happens, collisions or derailments may occur; processing must be stopped and those cars pushed clear with switch engines. Because of these interruptions, frequent use of "outer tracks" reduces the productivity of the humping operation.

(c) Contrary to popular notion, each car must be handled at least twice in a single stage yard: first when the car is classified at the hump, then again in a flat switching movement when cars are pulled out of the trim end of the yard and moved to the departure yard.

(d) If a needed block has only a part-time assignment, and if that block is not allocated in the classification yard when cars come to the hump for it, those cars must be sent into a temporarily designated "rehump" track for reprocessing later. Rehump cars must therefore be handled at least three times before they finally depart the yard.

(e) Since classification tracks are usually too short to make up a whole train, several tracks must be assembled at the trim end of the yard to complete each train. If a train consists of only a single large block, usually that block will have too many cars to fit into a single classification track; it will spill over into additional tracks, thereby reducing the total number of blocks which can be built in the yard.

(f) If more than one switch engine is working on the "trim" end at the same time, movements of these switch engines can interfere with one another, causing unproductive delays and reduction of capacity. Typically, the capacity bottleneck occurs at the "trim" end of the yard rather than at the hump. Then, the heavy financial investment in automated speed control and switching systems at the "hump" end of the yard cannot be fully utilized due to the bottleneck at the trim end of the yard. Effective hump capacity can be increased by eliminating this bottleneck at the trim end of the yard, as is proposed by this invention.

(g) All the time cars now spend waiting in the classification yard (typically 12–24 hours) is wasted. Since other cars may be routed into any track at any time (impacting standing cars), it is not safe for mechanical personnel to inspect or repair cars while they lie in the classification yard. Mechanical inspection and repair activities are typically performed in either the receiving or departure yards, adding directly to the total time required to process cars through the terminal. This invention will show how time spent in the classification yard can be effectively utilized in a multiple stage yard.

Prior Art Methods of Priority Based Classification

All known methods of priority based classification rely on traditional single stage sorting. All these techniques have serious drawbacks. Three different methods can be used to classify cars for specific trains:

(a) The most commonly accepted method is to sort cars at the "hump" in'the usual way (only by destination block), then select specific cars for each outbound train at the "trim" end of the yard. This is known as "cherry picking" in the railroad industry. In FIG. 6A from O. K. Kwon's Ph. D. Dissertation (1994) *Managing Heterogeneous Traffic on Rail Freight Network Incorporating the Logistics Needs of Market Segments*, Dept of Civil and Environmental Engineering, Massachussetts Institute of Technology, pg. 103, the object is to extract a specific car (or group of cars) #1, which are "buried" behind another group of cars #3. Taking group #1 instead of #3 entails extra switching work because it is necessary to first move #1 to another track (FIG. 6B), then put #3 back to the original track (FIG. 6C). This doubles the amount of switching work as compared to only taking "first out" cars #3.

The advantage of "cherry picking" is to defer decision making until the latest possible time, when the choice of available cars is known for sure; but the method is extremely costly to implement since the "trim" end of the yard is designed for flat switching large blocks of cars, not for sorting by individual car. Digging out priority cars at the trim end of the yard exacerbates the capacity bottleneck which already exists there, and reduces throughput of the whole facility. For these reasons, cherry picking is not considered cost effective by the railroad industry.

(b) A second approach performs all individual car selection at the "hump," which is better designed for this kind of work, rather than trying to accomplish it at the trim end of the yard. It can be done by diverting a sufficient number of low priority cars away from their primary classifications into "rehump" tracks instead, so that remaining train capacity is just sufficient to take all high priority cars. To implement this, train capacity must be known in advance, which in turn may require determining locomotive assignments well ahead of time. The main disadvantage is that this approach may require committing to decisions up to 12–24 hours prior to the scheduled train departure time. Afterwards, if a planned inbound train does not arrive on time or with all its cars, or if more mechanical defects are discovered than anticipated, it may be hard to get the excess diverted cars back onto the outbound train in time.

(c) To reduce the number of rehump cars, an adaptation of method (b) from Kraft, E. R. (1995) *Union Pacific Railroad's Terminal Priority Movememt Planner*, Working Paper, Union Pacific Railroad, Omaha, Nebr., tries to find classification track assignments to start new blocks immediately rather than automatically diverting excess cars into a rehump track. The decision to divert low priority cars is still required as early as before. The approach makes very intensive use of every available inch of classification track space, but also tends to widely scatter blocks for the same outbound train across the entire yard, requiring frequent "crossover" movements for train assembly at the trim end. Outbound blocks must be trimmed in strict order and absolutely by the scheduled time; otherwise, the whole block to track assignment plan falls apart. The approach relies on very precise adherance to both inbound and outbound train schedules. But even with tight adherance to schedules, there are still distinct advantages to postponing as long as possible a final decision on the exact makeup of the outbound train.

Prior Art Methods of Multiple Stage Sorting

Multiple stage sorting methods have been described by M. W. Siddiquee (1971) in Investigation of Sorting and Train Formation Schemes for a Railroad Hump Yard, in *Traffic Flow and Transportation, Proceedings of the Fifth International Symposium on the Theory of Traffic Flow and Transportation*, Jun. 16–18, 1971, G. F. Newell, editor, American Elsevier Publishing Company, New York (hereinafter known as Siddiquee, 1971) and by Daganzo, C. F. et al. (1983) Railroad Classification Yard Throughput: The Case of Multistage Triangular Sorting, *Transportation Research* A, 17A (2) 95–106 (hereinafter known as Daganzo, 1983), as well as by several other authors. No mention of sorting cars by priority has been found in any prior art references on multiple stage sorting. Siddiquee (1971) defines four sorting methods—by train; by block; geometric and triangular sorting—but these last two are very closely related, and do not constitute significantly different methods for organizing railroad yard operations.

(a) The "Sorting by train" method initially collects cars by outbound train, intermixing cars for each train in no particular block order on a single classification track. Those cars are later pulled back to the hump and sorted into specific blocks needed for the train being made up. Finally, blocks must be assembled into proper standing order sequence for departure. This requires a minimum of three handlings per car (including the flat switch at the trim end of the yard) making it noncompetitive with other approaches, unless a special herringbone track arrangment is used (see FIG. 7). By providing intermediate crossover tracks, a herringbone arrangement allows assembly of a train carrying more than one block of cars on a single departure track, without needing to flat switch cars from the trim end of the yard. This reduces the number of car handlings to only two, but a specialized track layout is needed to achieve it.

Technically, cars can be sorted into a herringbone track using only single stage sorting, but construction and maintenance costs of herringbone tracks are so high that carriers generally cannot afford to build a sufficient number of them. If blocks needed for the outbound train are not being built in the herringbone tracks when cars come to the hump, according to N. Miyakawa (1972) in Automation of Koriyama Marshalling Yard and the Herringbone Track. *Rail International* 1972 (5) 300–320, those cars must be sent into a rehump track instead. To increase utilization of the herringbone tracks, they can be used in the two-stage manner just described. However since Japanese National Railroad did not initially sort by outbound train as suggested here, some rehump cars had to be processed more than twice.

(b) The "Sorting by block" method (also called arithmetic or rectangular sorting) intermixes cars of several trains, different blocks of the same train are never intermixed on the same track. As shown in FIG. 8, cars from the first block of each train are intermixed on the first track, cars from the second block of each train are intermixed on the second track; and so on. Just prior to train departure, the cars are resorted by outbound train, simultaneously assembling several trains with all blocks in proper sequence for departure.

Sorting by block inherently requires no more work than conventional single stage sorting, only two handlings per car. However, in a traditional hump yard, classification tracks are usually too short, so several tracks would be required to hold all the cars for each train. Due to this design flaw, outbound trains still need to be assembled in the departure yard by flat switching out of the "trim" end, forcing an unnecessary third handling for each car. This extra handling results entirely from trying to perform multiple stage sorting in a facility not properly designed for it. It also leads to the myth that multiple stage sorting is more costly than conventional single stage processing. To the contrary, the issue is simply one of optimizing facility design to its intended use, but once a yard has been constructed—for better or for worse—this does tend to "lock in" the operational method for which the facility has been originally designed.

The greatest weakness of sorting by block is the requirement either that all first stage tracks must be completely cleared prior to commencement of second stage sorting (requiring a very long switching lead to hold all the cars from several tracks at once); or that second stage sorting must use different tracks than those used for the first stage sort (as in a "folded" or "two stage" design, L. C. Davis (1967) *The Folded Two Stage Classification Yard*, MBA Thesis, Wharton School, University of Pennsylvania, Philadelphia, Pa., hereinafter known as Davis, 1967). This practically restricts "sorting by block" to assembly of only short local trains, or to detailed makeup of trains carrying a very large number of small blocks.

(c) "Geometric" and "Triangular" sorting are based upon a pattern of arranging blocks which allows intermixing blocks of the same train on the same track; by resorting each track in turn on top of other cars (without requiring all tracks be cleared at once) several trains may be assembled simultaneously in correct block sequence for departure. According to K. J. Pentinga (1959) Teaching Simulaneous Marshalling, *The Railway Gazette*, May 22, 1959, pp. 590–593, the triangular pattern was adapted from the geometric pattern by the French National Railways (SNCF) so that no car must be sorted more than three times—but track assignments for the first six blocks are identical (see FIGS. 1 and 2). For more than six blocks, geometric sorting requires slightly fewer tracks, but this savings in tracks is accomplished at the expense of an increase in the total number of cars rehandled. For the purpose of this invention, since very few trains carry more than six blocks at one time, the geometric and triangular patterns will be seen to be practically equivalent.

According to Pentinga (p. 591), the "Geometric" sorting pattern is so named because block numbers assigned to each track corresponds to a geometric series of numbers, with a common multiplier of two (e.g. for track 1:1,2,4,8=$1\times2^0$, $1\times2^1$, $1\times2^2$, $1\times2^3$; for track 2:3,6,12=$3\times2^0$,$3\times2^1$, $3\times2^2$; for track 3:5,10=$5\times2^0$,$5\times2^1$.) Blocks on the first train are numbered 1,2,3, etc. Blocks on the second train are numbered 3,4,5,6, etc. Blocks on the d'th train are numbered 2 (d−1)+1, 2 (d−1)+2, 2 (d−1)+3, etc. Classification track "k" is assigned all blocks having the following indices:

$$b_{k,j}=(2(k-1)+1)2^{(j-1)}$$

where $b_{k,j}$ is the j'th lowest block number assigned to track k.

Mathematical equations describing the "Triangular" sorting pattern are given by Daganzo (1983, pg. 98, eqn. 8, 9a and 9b). Following Daganzo, blocks on the first train are numbered 1, 2, 3, etc. Blocks on the second train are numbered 2,3,4, etc. Blocks on the d'th train are numbered d (d−1)/2+1, d (d−1)/2+2, d (d−1)/d+3, etc. Classification track "k" is assigned all blocks having the following indices:

$$b_{k,1}=k(k-1)/2+1$$

$$bk,j=k(k-1)/2+jk+1+(j-1)(j-2)/2,\ j=2,3,4$$

where $b_{k,j}$ is the j'th lowest block number assigned to track k. However, a much simpler method of describing the Trangular sorting pattern is shown by Davis (1967, pg. 52, FIGS. 3–7). Davis' figure is reproduced below as Table 2. To generate the triangular pattern, block numbers are simply arranged left to right, skipping over the position that would normally be used for the second block assignment to each track.

TABLE 2

Prior Art

| | Tracks | | | | | |
|---|---|---|---|---|---|---|
| | A | B | C | D | E | F |
| Classification | 1 | | | | | |
| Identifications | — | 2 | | | | |
| Assigned | 3 | — | 4 | | | |
| | 5 | 6 | — | 7 | | |
| | 8 | 9 | 10 | — | 11 | |
| | 12 | 13 | 14 | 15 | — | 16 |
| | 17 | 18 | 19 | 20 | 21 | — |

Adopting Siddiquee's notation, in all drawing figures depicting car movements, parenthesis indicate intermixed groups of cars, but an alphabetic prefix indicating the specific outbound train has been added. For example, (A1 A2 A3) indicates that cars for the first three blocks assigned to train "A", may be randomly intermixed together on the same track. By contrast, (A1) (A2) (A3) indicates that cars for blocks 1,2,3 have been separated into three distinct cuts, following one another in proper standing order on the track and that cars of each block are not intermixed. The notation (A2) (A1) (A3) shows blocks 2, 1 and 3 separated, but not in proper train standing order. These cars would have to be put into proper block sequence either (A1)(A2)(A3) or (A3)(A2)(A1) by flat switching, depending whether the train was intended to depart to the left or right. The first block of any train always follows immediately behind the locomotive, with subsequent blocks in ascending numerical sequence.

For train "A" with six blocks, the desired outcome is: (A1)(A2)(A3)(A4)(A5)(A6) for a train departing to the left: this indicates all cars needed for the train have been separated into distinct blocks (cars not intermixed) and all lined up on one track in proper sequence for departure. To simplify'the notation, only one representative car for each block is shown in each example. H. B. Christianson, Should Future Yards Classify Freight in Two Stages? *Railway Management Review* 72 (2) A20–A32 (hereinafter known as Christianson, 1972) specifically addressed this issue with several examples, demonstrating that the sorting process still works if more than one car is included in each block.

FIGS. 1 and 2 show initial block to track assignment patterns to simultaneously build four trains on four tracks using prior art geometric and triangular sorting, respectively. For easy comparison to past published references, Siddiquee's block-numbering scheme is used in both figures. In FIG. 1, blocks 1,3,5,7 and 9 for each train are assigned to track 1; blocks 2,6, and 10 are assigned to track 2, block 4 is assigned to track 3, and block 8 is assigned to track 4. Using Siddiquee's notation, same-numbered blocks for different trains are always assigned to the same tracks; but this can be confusing since the block numbering sequence does not always begin at one for every train. Blocks of train A are numbered 1 thru 10; but train B is numbered 2 thru 10, train C is 4 thru 10, and train D is 8 thru 10.

Such notation would be confusing in later figures, which present continuous sorting patterns. Introducing the notation which will be used throughout the remainder of this application, in FIG. 3A, blocks are renumbered so every train always starts with block #1. Blocks of train B are renumbered 1 thru 9; train C is 1 thru 7 and train D is 1 thru 3. Block to track assignment patterns shown in FIG. 3A and FIG. 2 are actually the same, but FIG. 3A uses the new block numbering sequence, which is used in the remainder of this application.

FIGS. 3B thru 3E work through a complete sequence of switching cars using the prior art triangular sorting method. This prior art pattern assembles all four trains simultaneously, so these trains should all be scheduled to depart close to the same time. A detailed step-by-step explanation of the sorting process follows. In later figures, including ones showing continuous sorting processes, each track is similarly sorted in turn and each drawing figure shows the result after the completion of each sorting step. A textual description is only provided (below) tracing the steps of FIGS. 3A–3E, but for every series of drawing figures depicting car movements, a table is provided summarizing the sequence of car movements needed to carry out the sorting process. For ease of comparison, each table is numbered the same as the set of drawing figures to which it relates, even though in some cases this results in tables being shown here out of numerical order. For example, Table 3 below describes the sequence of railcar movements shown in drawing FIGS. 3A–3E.

TABLE 3

Prior Art

| | |
|---|---|
| First Stage Setup shown in FIG. 3A | A1,A3,A5,A8,B2,B4,B7,C2,C5,D2 to Track 1<br>A2,A6,A9,B1,B5,B8,C3,C6,D3 to Track 2<br>A4,A10,B3,B9,C1,C7,D4 to Track 3<br>A7,B6,C4,D1 to Track 4 |
| Pull Back Track 1 from the right side, and reclassify as follows. Outcome shown in FIG. 3B. | A1 to Track 1<br>A3,B2 to Track 2<br>A5,B4,C2 to Track 3<br>A8,B7,C5,D2 to Track 4 |
| Pull Back Track 2 from the right side, and reclassify as follows. Outcome shown in FIG. 3C. | A2,A3 to Track 1<br>B1,B2 to Track 2<br>A6,B5,C3 to Track 3<br>A9,B8,C6,D3 to Track 4 |
| Pull Back Track 3 from the right side, and reclassify as follows. Outcome shown in FIG. 3D. | A4,A5,A6 to Track 1<br>B3,B4,B5 to Track 2<br>C1,C2,C3 to Track 3<br>A10,B9,C7,D4 to Track 4 |
| Pull Back Track 4 from the right side, and reclassify as follows. Outcome shown in FIG. 3E. All four trains are ready for departure towards the left. | A7,A8,A9,A10 to Track 1<br>B6,B7,B8,B9 to Track 2<br>C4,C5,C6,C7 to Track 3<br>D1,D2,D3,D4 to Track 4 |

The initial yard setup is shown in FIG. 3A. This configuration of block to track assignments would be maintained for most of the day (perhaps 20 hours) while arriving inbound trains are processed, and cars for all four trains are collected in the classification tracks.

When departure time approaches, outbound train assembly is started by retrieving the contents of Track #1 and pulling those cars back to the hump. These cars are reswitched as follows: A1 to Track 1 by themselves, A3 and B2 to track 2, on top of cars already there; A5, B4 and C2 to track 3, on top of cars already there; and A8, B7, C5 and D2 to track 4. The result, shown in FIG. 3B has cars for block (A1) isolated by themselves on track 1, while cars on the other three tracks are segregated into two distinct groups of blocks, and cars are not intermixed between distinct groups.

Next, track 2 is retrieved. The entire track is pulled back to the hump, including all cars just sent in from reprocessing of the first track. These cars are routed as follows: A2 and A3 to Track 1, B1 and B2 to Track 2, A6, B5 and C3 to Track 3, and A9, B8, C6 and D3 to Track 4. The result, shown in FIG. 3C has (A1) (A2) (A3) assembled in proper order on track 1; since blocks (A2) and (A3) were not intermixed on track 2, they will not be intermixed when those cars are collected on track 1; and train B is started on track 2. Cars on the other two tracks are segregated into three distinct groups of blocks, whereby cars are not intermixed between groups.

Track 3 is then reprocessed in a similar fashion. As shown in FIG. 3D, cars on track 4 are segregated into four distinct groups of blocks. By reprocessing this last track, all four trains are simultaneously assembled in proper standing order, without requiring use of more than four tracks at any time. The final result is shown in FIG. 3E.

Note that a six block train could be built using a block to track assignment pattern for seven (or more) blocks, simply by assuming that some blocks have no cars. This is shown in FIGS. 9A thru 9D, where the position normally reserved for the third block has no cars, so subscripts 4–7 have been resequenced as 3–6, respectively. Table 9 below describes the sequence of railcar movements shown in drawing FIGS. 9A–9D. Thus, the geometric pattern could be derived from the triangular pattern, and vice versa, simply by skipping some intermediate block positions. For the purpose of this invention these two patterns are treated as, in fact, equivalent as well as any variations which can be constructed by simply skipping intermediate block positions.

TABLE 9

| | |
|---|---|
| First Stage Setup shown in FIG. 9A | A1,A4,A6 to Track 1<br>A2,A5 to Track 2<br>A3 to Track 3 |
| Pull Back Track 1 from the right side, and reclassify as follows. Outcome shown in FIG. 9B. | A1 to Track 1<br>A4 to Track 3<br>A6 to Track 2 |
| Pull Back Track 2 from the right side, and reclassify as follows. Outcome shown in FIG. 9C. | A2 to Track 1<br>A5,A6 to Track 3 |
| Pull Back Track 3 from the right side, and reclassify as follows. Outcome shown in FIG. 9D. All four trains are ready for departure towards the left. | A3,A4,A5,A6 to Track 1 |

Another improvement results from simply taking advantage of triangular sorting's capability to build trains in proper block standing order. In triangular sorting, cars assigned to a "head block" slot (the first block in standing order sequence on each track) are handled twice, whereas other cars must be handled three times. Therefore, Daganzo (1983) suggests blocks with the largest number of cars should be assigned to "head block" slots to minimize the number of cars rehumped. But if that is done, the order of the blocks must be rearranged by flat switching before the outbound train can depart. Doing this might make sense in a traditionally designed yard where cars must be trimmed out anyway—but clearly in a new facility the benefit of completely eliminating the trim operation would outweigh the cost of rehumping a few additional cars, given that the basic design of a multi stage sorting facility must provide for a very high capacity hump and an effective car speed control system. Although the extension to sequence blocks strictly in the order required by the transportation plan may seem obvious, prior literature teaches against the practice.

Additional Prior Art Citations

A number of prior art citations are furnished with this Patent application which are not otherwise discussed in the specification. This section provides a brief discussion of each of those citations. It is hoped that future researchers may benefit by having a comprehesive survey of prior literature in multiple stage switching techniques.

Herbert T. Landow published a series of two articles, as Overseas Railroads Try New Yard Techniques (Part I), pp 95–100, and Train Blocks and Herringbones (Part II), pp 101–102, both in September 1968 *Modern Railroads*. The first article discusses several means of car retardation and car mover devices and how these can be used to improve yard efficiency, but Part I does not discuss multiple stage switching techniques. Part II describes herringbone track layouts (as shown in FIG. 7) and prior art geometrical and triangular switching techniques. A third article by Landow, in Yard Switching with, Multiple Pass Logic, *Railway Management Review*, Vol. 72 No. 1, pp :11–23 uses difficult notation which is hard to follow. However Landow's context (p 16) is that "Simultaneous switching is applicable in any case where two or more trains are to be sent out of a yard at or near the same time." This restriction is clearly associated with the prior art method of batch sorting of trains. None of these papers address either the continuous approach to multiple stage sorting, as this invention does, nor do they discuss the ability to use multiple stage sorting to preselect particular cars if an outbound train exceeds capacity.

Hoppe, C. W. (1972) in Do We Need Yards? *Railway Management Review*, Vol 72 No. 2 pp A1–A6 discusses general problems associated with prior art designs for railroad classification yards. Hoppe's article has a very short section on multiple stage switching techniques concluding (p A5) "It does little good to design a yard with great potential if the men who are going to run it are not trained to run it." Christianson (1972), as cited previously, examines several real-world yard configurations, finally concluding, "no large two-stage yard operation exists anywhere in the world." A later article by Christianson, H. B., et al (1979) in Committee 14—Yards and Terminals, Report on Assignment 7, Yard System Design for Two Stage Switching, American Railway Engineering Association, Proceedings 79'th Annual Conference, Vol 81, pp 145–155, repeats much of the material from Christianson's 1972 article but concludes "One alleged disadvantage is that personnel cannot learn and effectively use two-stage switching, but a seven-day test at a large flat yard and a two-day experiment at a medium-sized hump yard refuted this. Two staging will work in a normal environment with normal delays and problems."Neither of Christianson's papers offer any improvement to the basic techniques of two stage switching, as this patent application does.

Rao, M. S. (1976) in Switch Back Hump—A New Marshalling Tool, *Rail International* 1976, No. 4, pp 219–222 proposes to use a steep gradient to cause cars actually to reverse direction and then be routed into a secondary sorting yard. Rao proposes to utilize multiple stage switching techniques to maximize the productivity of his switch back hump. The novel aspect of Rao's paper is the reversal of direction which cars undergo during the humping process; however Rao offers no improvements to prior art multiple stage switching techniques. Rao's paper also appears as a prior art citation in U.S. Pat. No. 4,766,815 to Chongben et al (1988). Chongben proposes using a section of ascending gradient only to reduce car speeds rather than to actually reverse the cars' direction, as Rao does. Chongben's patent does not address multiple stage switching but only the design of the car retarder systems in the yard.

Middleton, W. D. (1979) in New Approaches to Yard Automation in Japan, *Railway Age*, Feb. 12, 1979, pp. 46–49, does not discuss multiple stage switching techniques, but this citation is provided as a further reference on the Japanese National Railroad's use of Herringbone tracks and car retarder systems. Koehn, K., Holt, H. L. and Sabeti, A. (1972) in European Yard Retarder Systems, *Railway Management Review*, Vol 72 No. 2 pp A7–A19 offer a survey of many different kinds of car retarder systems, which provide an alternative to the traditional "clasp" retarder systems (as in U.S. Pat. No. 5,388,525 to Bodkin, 1993) now widely used in the United States.

Welty, G. (1980) in Outlook: Fewer Yards, Faster Output, *Railway Age*, Oct. 13, 1980, pp. 16–17, surveys the then-current state of the art in railroad classification yard technology. He states, "First, discard the radical. Linear-designed yards may work overseas, but experts who have looked at these and other nonstandard yards say that they simply don't meet the requirements of railroading in North America Thus, the new classification yards of tomorrow, like those of today and yesterday, will have the standard components—receiving yard, class yard, and departure yard, either inline or wraparound, depending mostly upon the constraints of available space." This teaches against the current invention. The ability to successfully implement "non standard" yards in North America was later reported by Welty in At Livonia, An Early Payoff, *Railway Age*, February 1995, pp 41–42, describing a successful application of the "Dowty" retarder system at Union Pacific's yard at Livonia, La., one of the very few new classification yards constructed anywhere in North America during the 1990's.

Kraft, E. R. and Guignard-Spielberg, M. (1993) in *A Mixed Integer Optimization Model to Improve Freight Car Classification in Railroad Yards*, Report 93-06-06, Department of Operations and Information Management, The Wharton School, University of Pennsylvania, propose to simultaneously optimize both hump sequence and dynamic block to track assignments using a network-based, mixed integer math programming formulation. Using a decomposition approach, Wang, X. (1998) in *Improving Planning for Railroad Yard, Forestry and Distribution*, Ph. D. Dissertation, Department of Operations and Information Management, The Wharton School, University of Pennsylvania, was able to scale up Kraft and Spielberg's approach to solve a realistically sized problem within a reasonable time frame. However, Kraft's formulation was only tested using a "toy" problem of 3 trains, 4 time periods, 3 blocks and 2 tracks, not practical for any real applications. In order to solve the problem, Wang adjusted some constraints so that they may no longer represent a feasible solution to Kraft and Spielberg's original problem. Both the Kraft and Spielberg (1993) and Wang (1998) formulations attempt to preselect cars for specific outbound trains; but both rely on single stage sorting techniques in traditional hump yard facilities; they do not use any multiple stage sorting techniques as advocated by this invention.

BRIEF SUMMARY OF THE INVENTION

In accordance with the present invention, outbound trains are built in proper standing order for departure directly from the classification tracks, using a continuously sustainable multi-stage sorting process. During this process, cars are easily separated based on priority or according to their delivery time commitments, so connections of cars needing to go on a specific train can be protected. During second stage sorting operations, cars may be inspected or repaired while they await outbound connections in the classification tracks, effectively utilizing otherwise idle time and resulting in considerable savings in time required to pass through the yard. This may be accomplished in a traditional rail yard setting, but will yield even more benefit if accomplished in one of the specialized facility designs shown in the drawing figures.

Objects and Advantages

Accordingly, several objects and advantages of the present invention are:

(a) The continuous multiple stage sorting process utilizes terminal resources more uniformly and thus efficiently than prior art methods.

(b) If more cars are available than the capacity of the outbound train, the decision which specific cars to take is not required until immediately before train departure, rather than 12–24 hours in advance as with some prior art single stage sorting methods.

(c) Tracks can be used for more than one purpose, allowing flexible use of assets and eliminating unnecessary movement of cars within the yard. Single car sorting is efficiently performed at the hump. Preblocked groups of cars may be conveniently transferred from one train to another by flat switching at the opposite end of the yard—without requiring preblocked cars to be unnecessarily reprocessed over the hump or moved a long distance in a special flat switching transfer, as current yard designs do.

(d) Yard designs proposed here, particularly the preferred embodiment, utilize a very simple track layout, offering a distinct possibility that new yards could be constructed to an essentially standardized design, with only minor variations such as the exact length and number of tracks needed in each yard. Computer software needed for both yard design and process control can be standardized across many facilities, rather than having to be heavily customized for each individual yard. The guesswork can be eliminated from yard design by utilizing such standardized computer simulation tools to ensure facilities are properly sized.

(e) Assembly of outbound trains by flat switching at the trim end of the yard—and the related capacity bottleneck—are completely eliminated. One additional hump operation is required to replace the flat switching which now occurs at the trim end of the yard. However, this poses no inherent difficulty provided the hump is designed with sufficient capacity to accomplish its intended workload. Since the hump operation should actually proceed faster than the trim operation it replaces, the net effect should be a savings in operating cost per car classified, as well as in the capital construction and maintenance costs of the yard facilities themselves.

(f) The total number and aggregate length of tracks needed in the yard is considerably reduced. The need for separate receiving and departure yards is eliminated altogether. In the classification yard, instead of many short tracks (for example, 60 tracks up to 40 cars long), only a few long tracks must be built (for example, 15 tracks up to 150 cars long.) Fewer tracks need fewer switches and retarder units (for controlling car speeds) to construct and maintain. Compared to conventional hump yard designs, proposed new multi-stage yards will be considerably more economical to construct, maintain and operate.

(g) With fewer classification tracks, a relatively straight path can be constructed from the hump into any of the tracks, and the distance is reduced from the hump to the clearance point of the farthest classification track. This improved geometry raises the probability a car will at least roll clear of the switching area, thereby increasing the capacity and throughput of the humping operation. Many multiple car cuts are humped, especially during second stage sorting. Hydraulic car retarders, well known as "Dowty" units—see A. W. Melhuish (1983) Developments in the Application of the Dowty Continuous-Control Method, Transportation Research Record 927 pp. 32–38 (hereinafter Melhuish, 1983); D. E. Bick (1984) A History of the Dowty Marshalling Yard Wagon Control System, *Proceedings of the Institute of Mechanical Engineers* 198B (2) 19–26 (hereinafter Bick, 1984); and U.S. Pat. No. 5,092,248 to Parry (1992)—are well suited to accomodate the requirement for processing multiple car cuts, and this retarder system can provide continuous speed control for very long classification tracks as well. As compared to conventional single stage hump yards—where cars are nearly always sorted one-at-a-time and where the humping process is subject to frequent interruptions—excellent geometry and frequent processing of cars in multiple car groups should substantially increase the hump processing rate. Another benefit of the Dowty retarder system is practical elimination of lading and railcar damage by preventing overspeed coupling impacts in yards.

(h) Inspection and servicing of cars while they wait for connections on classification tracks may save perhaps 5–10 hours in the average time required to process cars through the yard. This practice also permits more efficient utilization of mechanical forces by allowing their activities to be spread uniformly throughout the day, rather than unduly determining maintenance personnel needs based on (often highly peaked) train arrival and departure patterns.

(i) FIG. 4 shows the potential to bypass intermediate terminal handlings, by improving sorting capabilities at railyards which originate and terminate a sufficient volume of local traffic (in the vicinity of 1000 cars per day total). Currently, such yards often have only "flat" switching capability, so it is more efficient to send cars to a nearby "hump" yard for detailed individual car classification. By converting from flat switching to a multiple stage hump yard design, as proposed here, cars may be economically sorted at the originating yard, allowing more trains to be operated on a direct "point to point" basis, rather than continuing the industry's current over reliance on a "hub and spoke" network design.

Still further objects and advantages will become apparent from consideration of the ensuing description and drawings.

BRIEF DESCRIPTION OF THE SEVERAL VIEWS OF THE DRAWINGS

In the drawings, closely related figures have the same number but different alphabetic suffixes.

DESCRIPTION OF THE INVENTION

Reference Numerals In Drawings

| | |
|---|---|
| 10 | Hump Escape Track |
| 20 | Locomotive Servicing Facility |
| 25 | Running Track |
| 30 | Main Line Track |
| 35 | Wye Track |
| 40 | Hump Lead Track |
| 45 | First Stage Sorting Yard |
| 50 | Second Stage Sorting Yard |
| 55 | Classification Tracks with Retarders |
| 60 | Cart Road between each track |
| 65 | Car Stopper Device |
| 70 | Departure Yard |
| 75 | Receiving Yard |
| 80 | Arrival Departure end |
| 85 | Trim End |
| 90 | Hump |
| 100 | Eastbound Receiving/ Westbound Departure Switches |
| 105 | Middle Tracks |
| 110 | Westbound Receiving/ Eastbound Departure Switches |
| 115 | Sorting Switches |
| 120 | Dowty retarder units |
| 125 | Rails |
| 130 | Locomotive |
| 135 | Railcars to be sorted |

Figure 10:
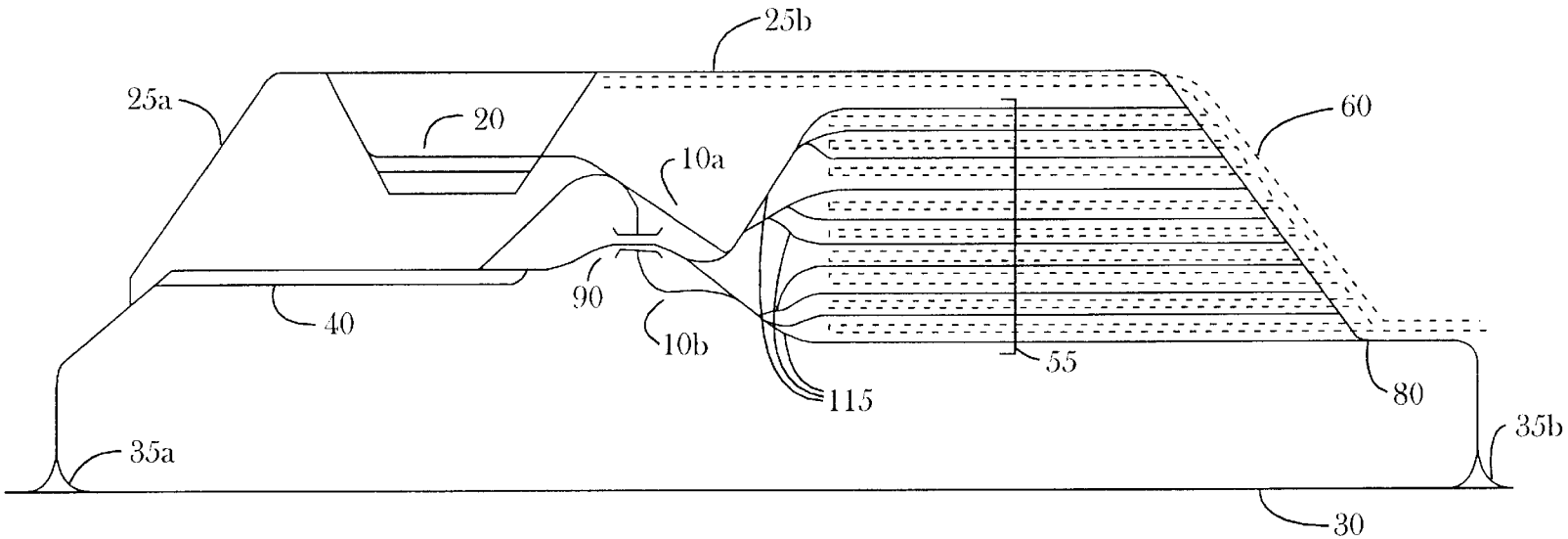
FIG. 10 shows the preferred embodiment of this invention for a multiple stage sorting yard, designed to efficiently implement continuous "triangular" sorting as shown in FIGS. 11 and 12.

FIG. 10—Preferred Embodiment

The preferred embodiment consists of the continuous triangular sorting pattern of FIGS. 11A–11J and 12A–12G, implemented in a switching yard similar to that shown in FIG. 10.

The design of the yard shown in FIG. 10 promotes maximum flexibility. Trains are received, classified on and depart from the same set of classification tracks 55, any of which are long enough to hold an entire train. Tracks 55 are the same tracks shown as tracks 1–9 in FIGS. 11A–11J and 12A–12G and in the other drawing figures which depict car movement patterns. A raised hump 90 provides means for accelerating individual railcars or groups of railcars through sorting switches 115 into the classification tracks 55 allowing cars to be sorted among all tracks which are accessible from that hump.

Figure 19:
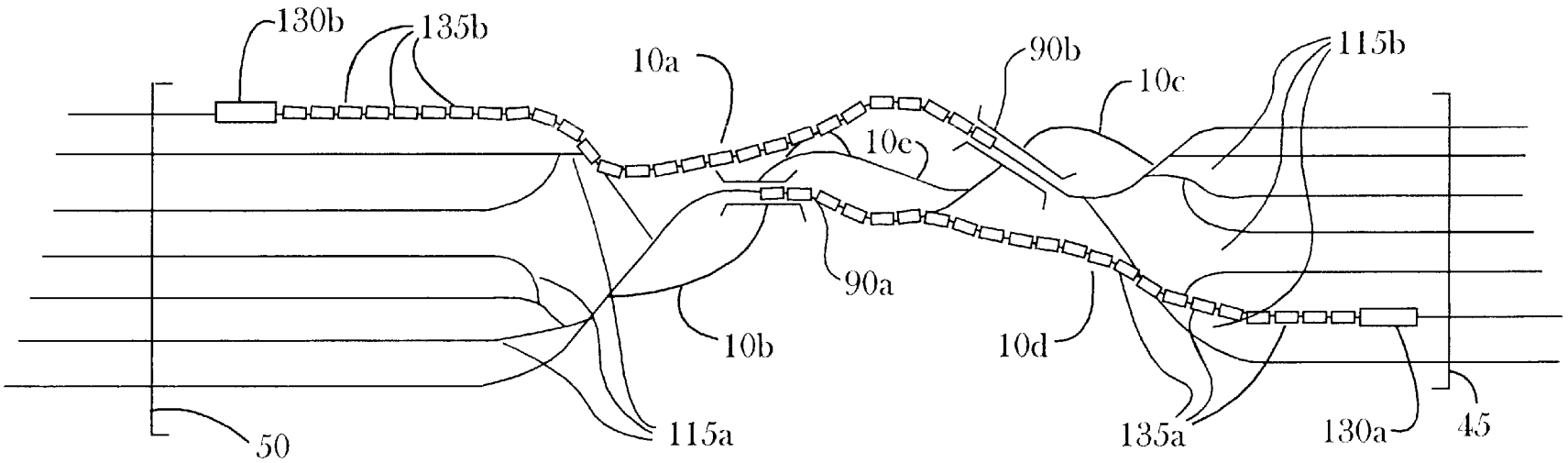
FIG. 19 shows a track arrangement in accordance with this invention using dual humps and escape tracks, to increase the capacity of a folded yard design using conventional humps and retarder systems, rather than relying on mechanical devices as proposed by Davis (1967).

The design minimizes interference with hump 90 processing to maximize the effective sorting capacity of the facility. Means are provided in operative relationship with classification tracks 55 and with the mainline 30, for enabling departure of outbound trains directly from classification tracks 55 and for enabling arriving trains to be received into the same tracks 55 for storage while awaiting processing. Specifically, using wye track 35*b*, trains for either direction can move directly between the mainline 30 and classification tracks 55 using a second set of switches 80 at the Arrival/Departure end of the yard, without interfering with hump 90 operations. Alternatively, trains can arrive or depart from "outside" classification tracks 55 on extreme left or right sides of the yard using "escape" tracks 10*a* or 10*b*, while hump 90 operations continue simultaneously. While escape tracks are in use, this prevents cars being routed from the hump only into those extreme outside tracks which are blocked (as shown in FIG. 19). Preblocked groups of cars making direct connections from inbound to outbound trains can also be flat-switched using switches 80 at the Arrival/Departure end without interfering with hump processing. A third, but undesirable alternative would be for trains to arrive and depart via the hump 90 itself and the hump switching lead track 40.

Since locomotives are very expensive assets, it is desirable to release them from inbound trains promptly, so locomotives can move quickly either to connecting outbound trains or to the locomotive servicing facility 20. Locomotives can move between their trains on classification tracks 55 and the locomotive servicing facility 20 using the yard running track 25 via switches 80 at the Arrival/Departure end without interfering with hump processing, or via the escape tracks 10 causing only a very short interference to hump processing.

To process an arriving train, cars must be pulled back from the classification tracks 55 onto one of the hump lead tracks 40. Arriving trains can also be received directly on either of the double hump lead tracks 40 for immediate processing. When retrieving railcars from a classification track 55 for second stage processing, this again may be accomplished using escape tracks 10 without preventing simultaneous hump processing of another train. To maximize use of escape tracks, inbound trains should be received on the outside of tracks 55 and first stage sorting also performed onto these outside tracks. Second stage sorting, which assembles outbound trains for departure, should favor the middle of tracks 55 which are not accessible from the escape tracks. This block placement strategy permits any outside track to be pulled back to the hump via an escape track 10 while second stage sorting proceeds concurrently.

For sorting of railcars, once a train has been positioned on the hump switching lead 40, a locomotive or car pusher device may be used to slowly shove cars towards the hump 90, where cars are uncoupled and allowed to individually roll by gravity into their proper classification tracks 55. Then, conventional car retarder units may be used to control and reduce their speed to a safe velocity for impacting and coupling to other railcars already standing on those tracks, or to prevent cars from rolling out the far ends of the'tracks.

Figure 22:
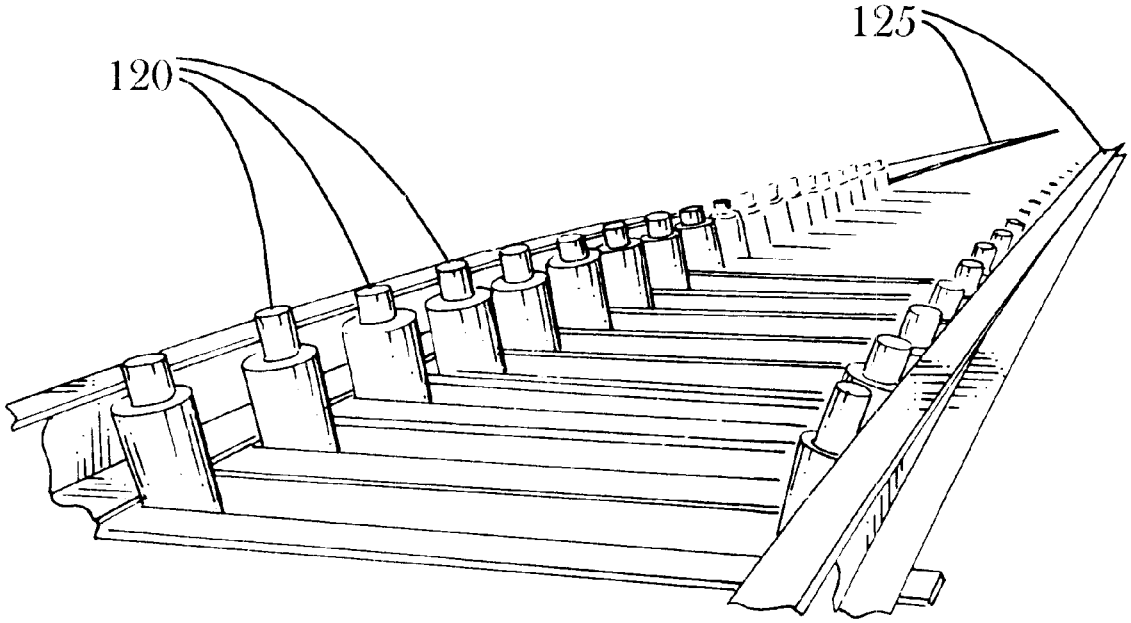
Fig. 22 Prior Art
FIG. 22 shows the placement of "Dowty" hydraulic retarder units between the rails of a yard track and the method by which those units may distributed along the entire length of the track, if needed.

As shown in FIG. 22, "Dowty" units 120 are placed between the rails 125 of each classification track 55 where the flanges of car wheels can contact them. Through this contact a retarding force can be applied to the wheels. These hydraulic retarder units may be spaced every several yards for the entire length of the classification track. The "Dowty" retarder system is described in U.S. Pat. No. 5,092,248 to Parry (1992) and its practical use and application in prior art citations Melhuish (1983) and Bick (1984). Many different kinds of retarder units are described in Class 104 Subclass 26.2. "Dowty" retarder units, proposed for the preferred embodiment are not separately shown in any of the drawing figures, since these units are distributed throughout the entire length of each classification track 55. Alternative embodiments might use conventional clasp retarders as described in U.S. Pat. No. 5,388,525 to Bodkin (1993), "Screw" type retarders as in U.S. Pat. No. 4,480,723 to Ingvast (1984), or magnetic induction retarders as in U.S. Pat. No. 5,676,337 to Giras (1997), or other means of car retardation.

Car pushers consist of mechanical arms, levers or other devices which can accelerate or propel cars without using a switching locomotive. Davis (1967) proposed the use of mechanical car pushers in his Master's thesis on folded two stage yards, but use of such devices in hump yard operations has not yet proven practical. Such devices are widely utilized in other kinds of industrial applications such as coal train unloading facilities, and are categorized under Class 104 Subclass 176. Some U.S. Patents describing such devices include 4,354,792 to Cornish (1982) and 4,926,755 to Seiford (1990). However in the preferred embodiment, it is envisioned that hump processing will be performed by entirely conventional means utilizing conventional switching locomotives.

Conventional track switches 115 connect the hump lead 40 into the classification tracks 55 and are used to control routings of individual railcars. Class 104 Subclass 130.01 is devoted to these devices. Since the problems of switching railroad cars were solved many years ago, most recent patents in this class are devoted to monorails and industrial vehicle switching. Some U.S. Patents relating to railroad track switches include 1,825,415 to Overmiller (1931) and 4,174,820 to Kempa (1979).

During second stage sorting, cars are humped exclusively into a very limited number of tracks 55 representing only the specific train(s) currently being closed out. Other tracks never receive any cars during this second stage sort, so mechanical forces may safely conduct inspections and repair cars on those tracks during second stage sorting operations. Because mechanical inspection and repairs can be performed practically anytime, arriving trains can be humped immediately upon arrival, (as soon as air brakes can be bled off) without needing to wait for complete inspection of the inbound cars. Cars can be inspected anytime before the final second stage sort.

To facilitate access by maintenance personnel, cart roads or paths 60 are provided between every set of classification tracks 55. This speeds the bleeding of air brakes and car inspection, and since carts can bring needed tools and materials directly to the location of the car, it maximizes the likelihood that mechanical defects can be repaired without having to shop the car. Cars having serious defects can still be removed from the outbound train in the second stage sort. These same cart roads faciliate easy access for engineering forces to maintain power switches and retarder systems in the yard. Cart roads are included in all drawing figures for the proposed facility designs.

Davis (1967, pg 61) suggested that icing, cleaning and minor repair might be accomplished in the classification yard through provision of cart paths, but on pages 80–81 he insisted that inspection must still be accomplished before the first sorting. By contrast, in accordance with this invention, even inspection can be performed in the classification yard. Because of the second chance afforded by multiple stage switching techniques to separate any bad-order cars that cannot be repaired in the classification yard, it is unnecessary to delay hump processing of inbound trains for inspection. That will offer a considerable advantage since connections potentially as tight as one hour could be made using the proposed new method of operation, whereas complete inspection of an entire inbound train may often require several hours at least. Currently, cars arriving on late inbound trains will miss their connections awaiting inspection of other cars on the same train, which cars don't all necessarily have tight connections. By processing each inbound train immediately upon arrival, those tight connections could still be protected and only those individual cars having tight connections would have to be inspected and repaired right away. Prior literature, including Davis (1967) actually teaches against the practice of inspection and repair in the classification tracks which is advocated by this invention.

Figure 17:
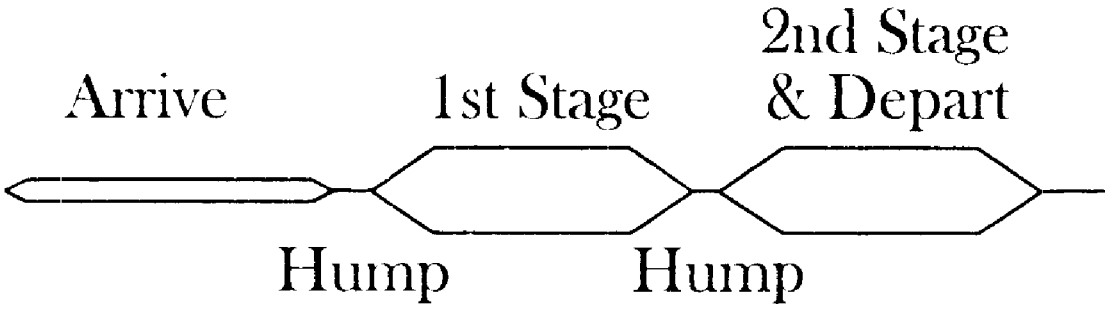
Fig. 17 Prior Art
FIG. 17 shows a prior art yard design for the sorting by block, or arithmetic sorting method (Christianson, 1972 pg A26).
Figure 18:
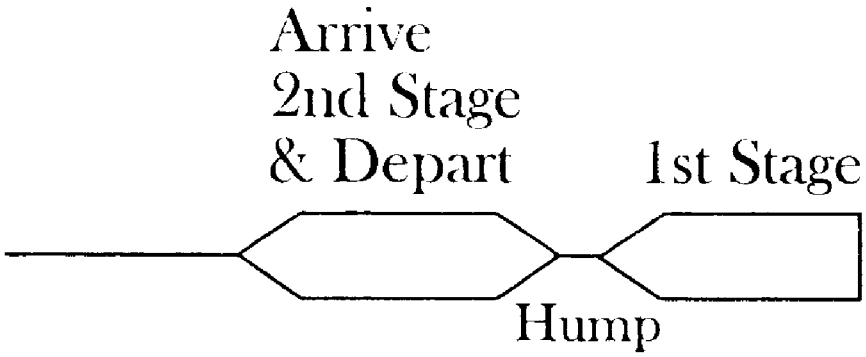
Fig. 18 Prior Art
FIG. 18 shows a prior art "folded" yard design for the sorting by block, or arithmetic sorting method, with a combined receiving, departure and second stage sorting yard (Christianson, 1972 pg A26).
Figure 20:
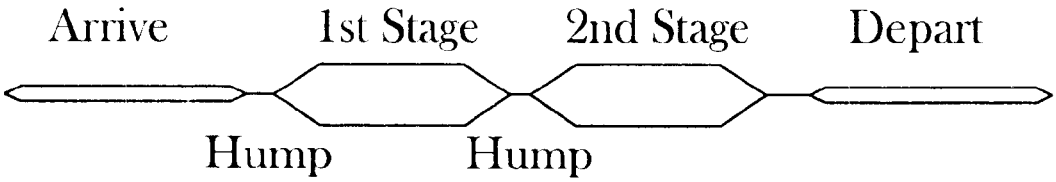
Fig. 20 Prior Art
FIG. 20 shows a prior art "in line" yard design for the sorting by block, or arithmetic sorting method (Christianson, 1972 pg A25).

Yard designs proposed here offer a distinct advantage over prior art two-stage yard designs shown in FIGS. 17, 18 and 20. In accordance with this invention, inbound train receiving, departure, first stage and second stage sorting operations are all conducted on the same set of tracks—so whenever any outbound train has too many cars, it is easy to divert excess cars back to the proper first stage classification track 55 designated for a later departing train. If that particular first stage classification track is unavailable because it has been turned over to mechanical personnel, the excess cars can be temporarily diverted to a different track, and moved back to the correct track later.

In prior art multiple stage yard designs, since first and second stage classification tracks are in separate sub-yards, it is hard to get excess cars back to their appropriate first stage tracks for a later-departing train. For perhaps this reason, along with the requirement that all tracks be completely cleared after each group of trains has been assembled (using the prior art multiple stage batch methods), no prior art reference addresses the question of how priority based sorting to specific trains might be accomplished using multiple stage switching methods.

Figure 4:
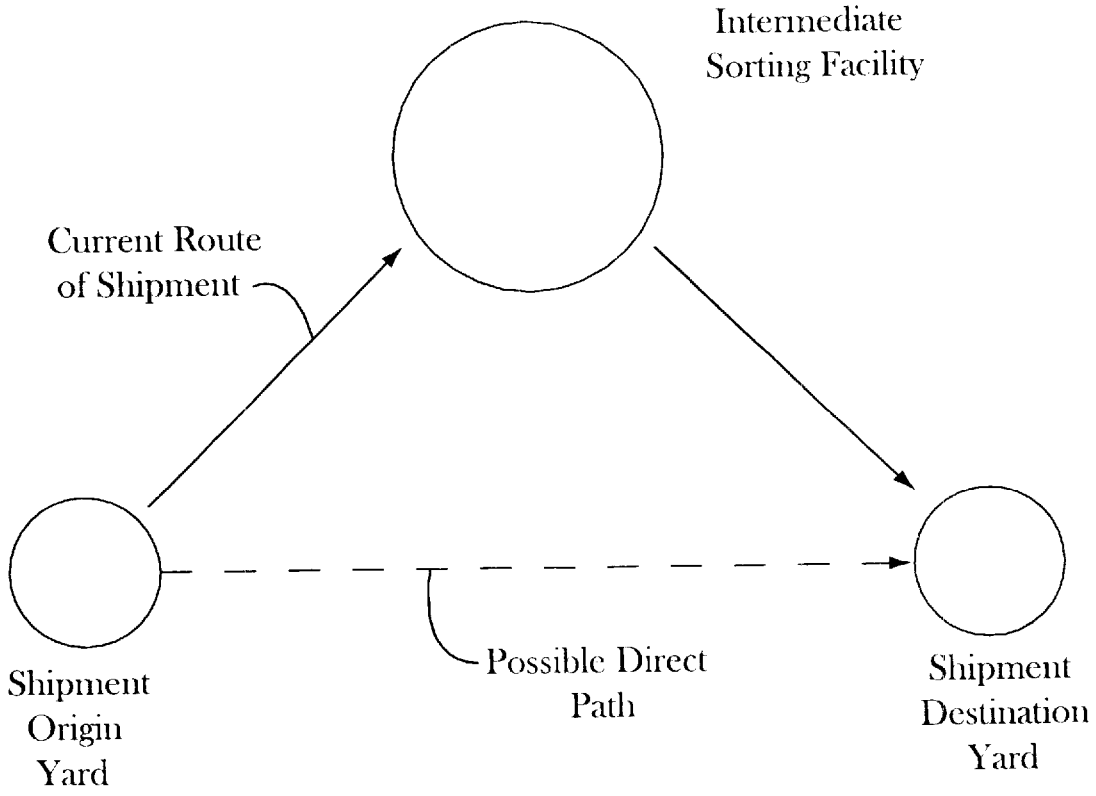
FIG. 4 shows how intermediate yard handlings can be reduced by improving the sorting capability of originating railyards to perform their own classification work, rather than having to rely on remote hump yards to perform their switching work for them.
Figure 5:
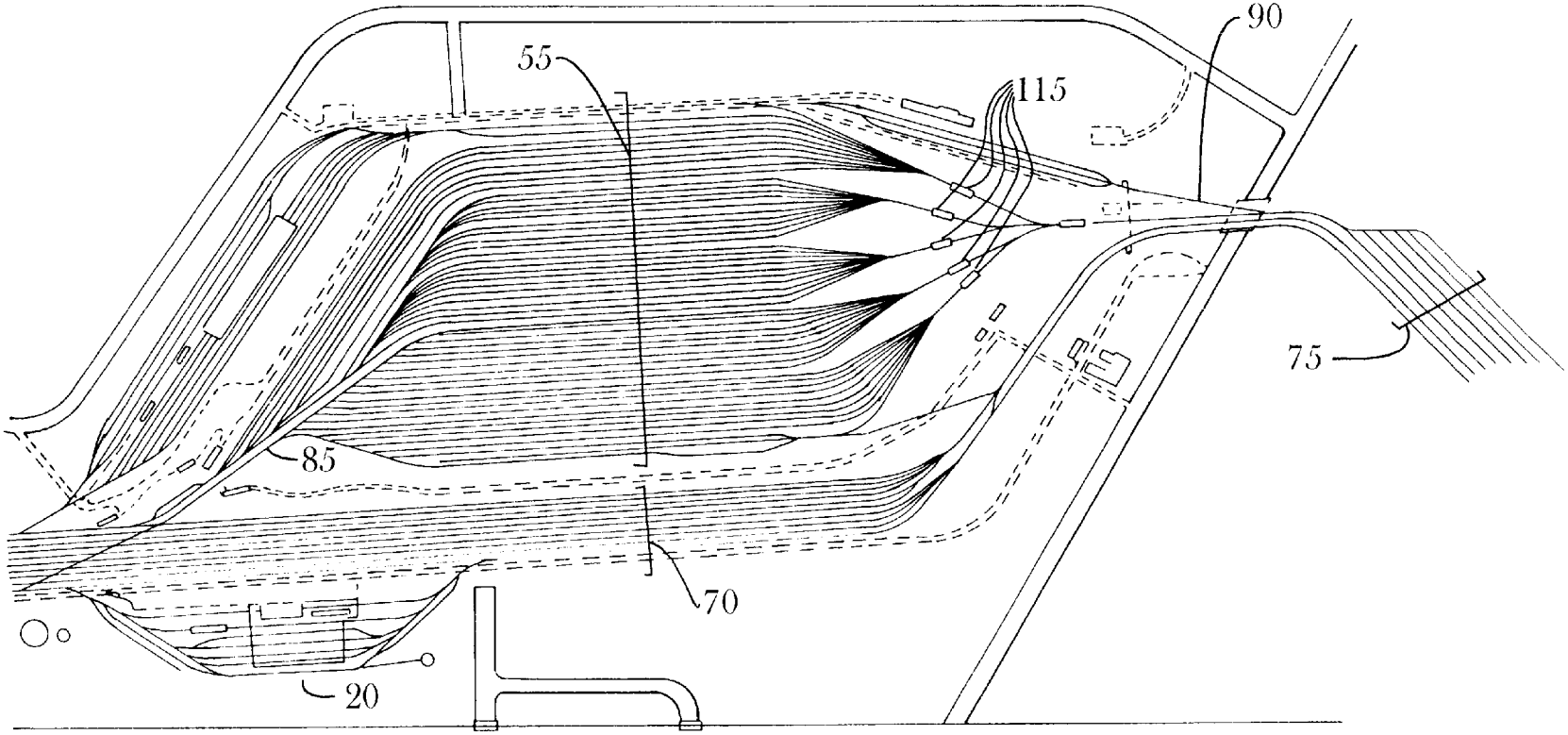
Fig. 5 Prior Art
FIG. 5 shows a typical prior art single stage hump yard design with separate receiving, classification and departure subyards.
Figure 6A:
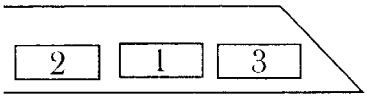
Fig. 6A Prior Art
FIGS. 6A–6C show the inefficient prior art sequence of car movements required to "cherry pick" priority cars at the trim end of a typical single stage hump yard.
Figure 6B:
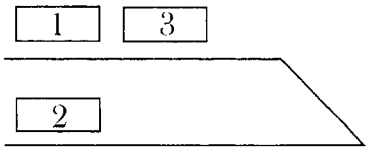
Fig. 6B Prior Art
Figure 6C:
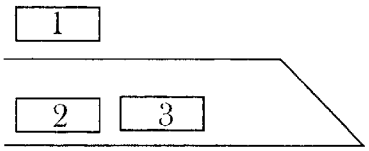
Fig. 6C Prior Art

Likewise, no known prior art addresses the opportunity to completely eliminate the flat switching 'trim" operation now needed for final train assembly. Although Davis (1967, pg. 59) alludes to a theoretical possibility of building a complete train on a single track, this is contradicted by Davis' FIGS. 4–6 on page 58 where he shows a train being "doubled" for final train assembly. Although prior art does suggests a means of reducing outbound train assembly time, it stops short of suggesting and fails to reduce to practice any means of totally eliminating the need for flat switching for outbound train assembly.

Figure 1:
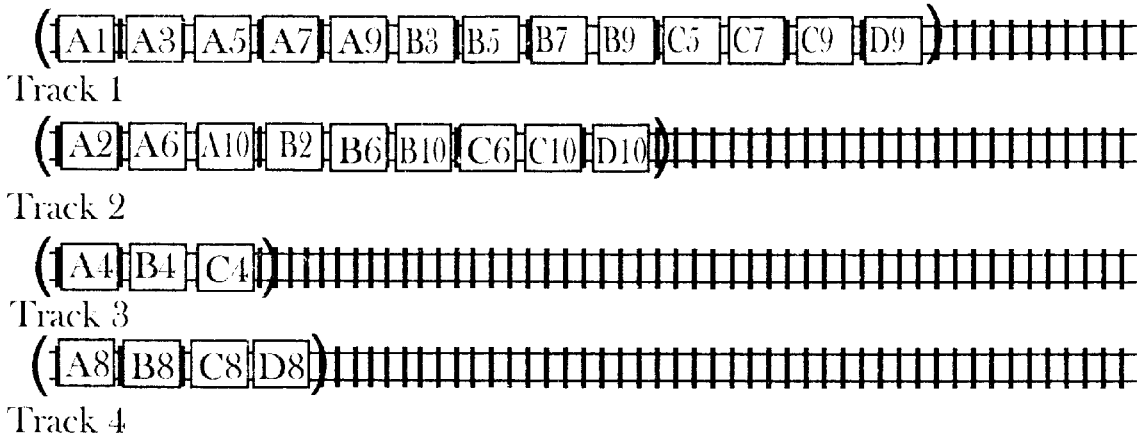
Fig. 1 Prior Art
FIG. 1 shows the prior art "geometrical" sorting pattern giving initial block to track assignment for up to ten blocks and four trains, from Siddiquee (1971).
Figure 2:
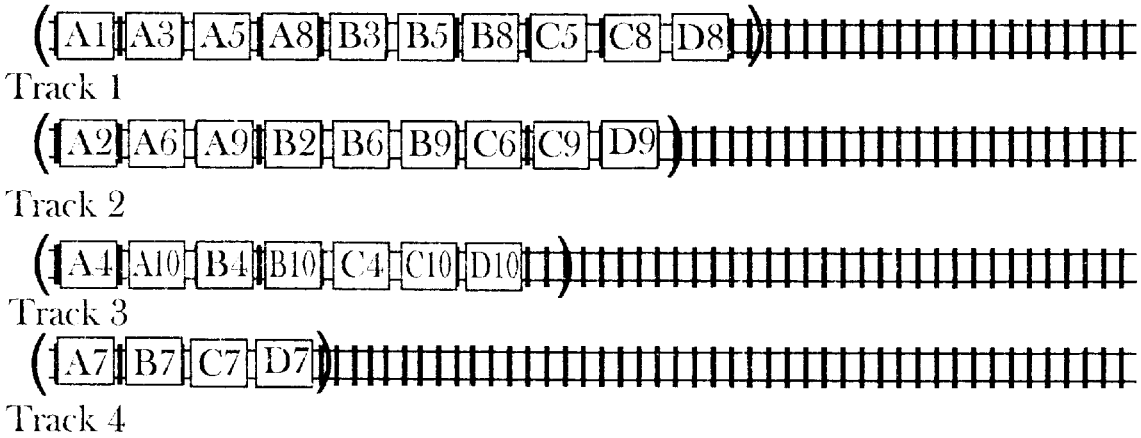
Fig. 2 Prior Art
FIG. 2 shows the prior art "triangular" sorting pattern giving initial block to track assignment for up to ten blocks and four trains, from Siddiquee (1971).
Figure 3A:
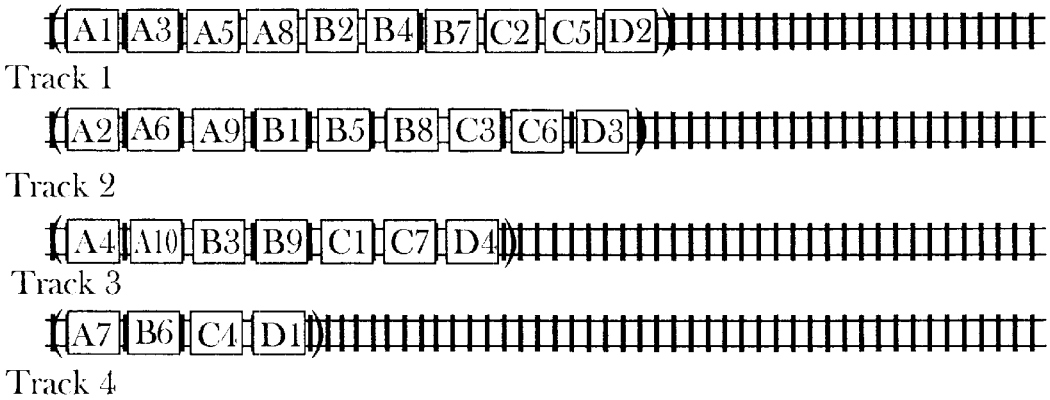
Fig. 3A Prior Art
FIGS. 3A–3E shows the prior art and renumbers Siddiquee's block subscripts, so that each train starts with block #1, and works the example through to show how four trains can be simultaneously built on four tracks using the triangular sorting pattern.
Figure 3B:
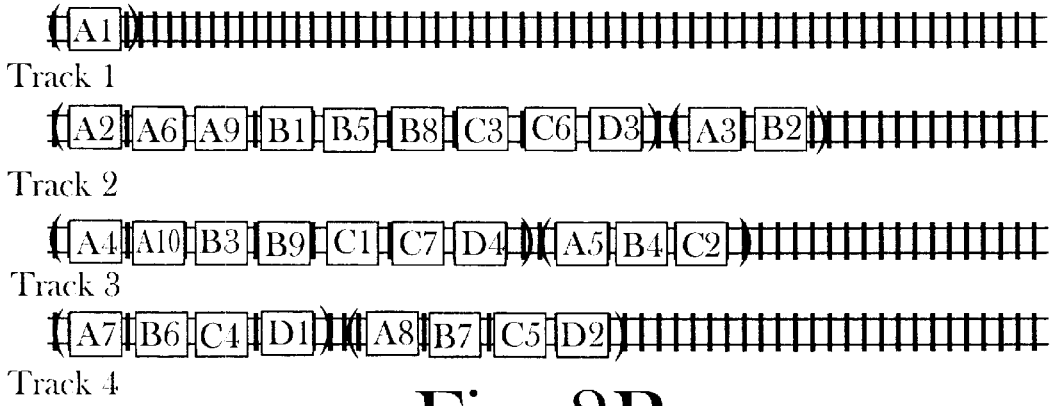
Fig. 3B Prior Art
Figure 3C:
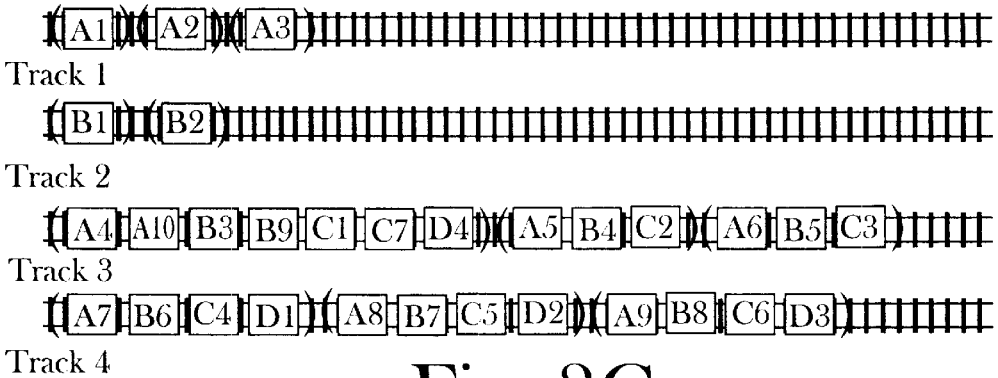
Fig. 3C Prior Art
Figure 3D:
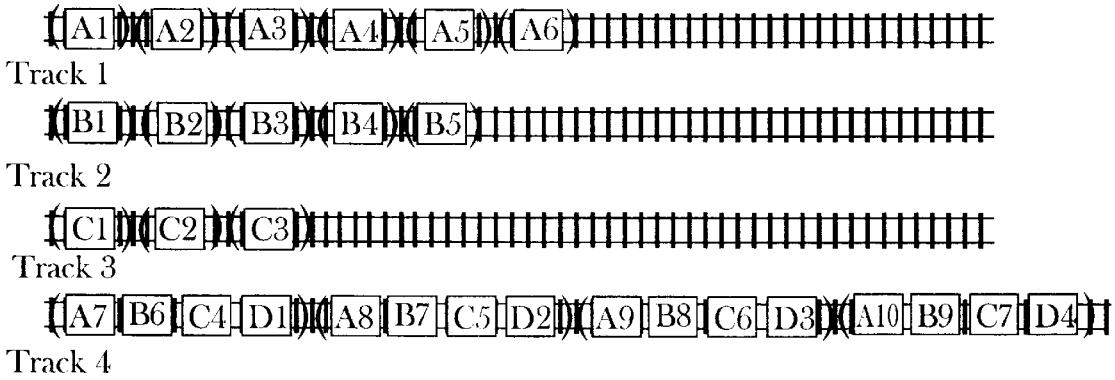
Fig. 3D Prior Art
Figure 3E:
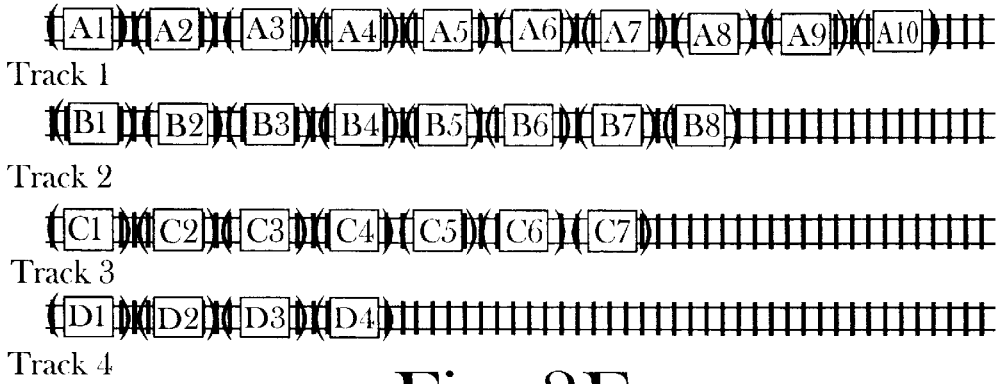
Fig. 3E Prior Art

Troop (1975) on page 7 FIG. 2 shows a yard design having arrival, receiving and classification performed in the same set of tracks. On the same page it is explained this is a "flat" yard design. In prior art hump yard designs combined receiving and departure yards are not unusual, and occasionally classification tracks are extended to also serve as departure tracks. But the combination of all three functions of arrival, classification and departure into a single set of tracks as proposed by this invention, is not known in any prior art hump yard design.

Figure 7:
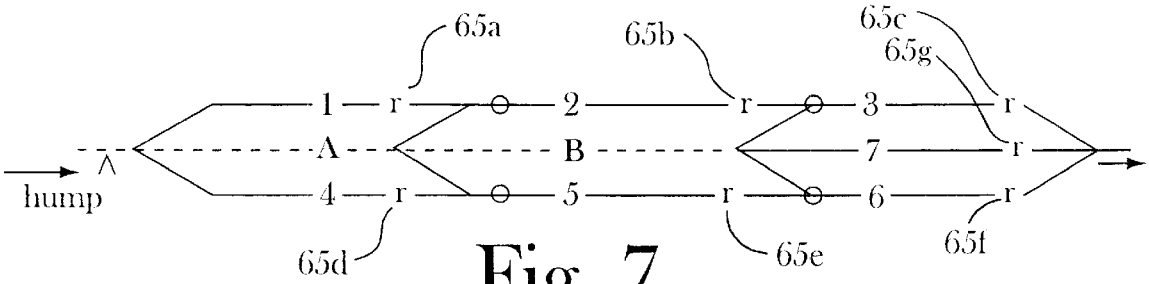
Fig. 7 Prior Art
FIG. 7 shows the prior art herringbone track arrangment, which may be used in conjunction with the sorting by train" method.

Herringbone tracks provide a means for reducing rather than eliminating train assembly time. For example in FIG. 7, since three is the largest number of pockets with car stopper devices 65 provided on any individual herringbone track; any train of more than three blocks will need to pick up cars from an additional track. With the increasing number of blocks carried by typical trains today, it is likely that a flat switching operation would still be required for final train assembly even using a herringbone track arrangement. By contrast, not only do multiple stage switching methods impose no predetermined upper limits on the maximum number of blocks any train may carry, but the yard facilities needed are much less expensive to construct than herringbone tracks.

Undoubtedly, one reason why prior art stopped short of suggesting outbound trains could be built "complete" on a single track, as this invention does, are difficulties of maintaining accurate car speed control over such long distances. Conventional "clasp" retarder systems as described in U.S. Pat. No. 5,388,525 to Bodkin (1993) apply speed control at only a few points in the yard. With increasing length of the classification tracks, variability in railcar coefficients of friction, or "rollability" makes it difficult to predict the speed at which cars should be released from the retarders so they will couple at a safe speed to cars already on the track. Typically, either too much retardation is applied causing cars to stop short of their destinations, or not enough retardation, allowing cars to crash into standing cars at an excessive rate of speed or run out the far ends of the tracks.

Given typical train lengths operated now of 8,000–10,000 feet, it was apparently not deemed feasible to assemble such long trains on a single classification track 55 using car retarder systems available in the 1960's when many of these prior art citations were being developed. At that time, the "Dowty" retarder system was still in the experimental stages in Britain and its capabilities were not yet proven, known or understood, so the prior authors chose not to further pursue this line of investigation. However, it has since been established that "Dowty" retarder system are in fact capable of maintaining continuous car speed control throughout the very long classification tracks proposed by this invention. Now a realistic means of completely eliminating the costly flat switching operation at the "trim" end of the yard can be seriously suggested for the first time.

Operation of the Preferred Embodiment

Prior art suggests that multiple stage sorting can only be used to build "batches" of trains, which must all depart close to the same time. The entire set of tracks must be cleared out and sorting starts over with a new batch of trains. This leads to excessive peaking of demands on terminal resources—it is more efficient to receive, process and dispatch trains on a continuous, steady-state basis. Continuous sorting improves the utility and practicality of multiple stage sorting methods.

Any "batch" multiple stage sorting method can be transformed into a continuous process by following two steps:
(a) "Replicate" the same block to track assignment pattern for each train, although patterns used for individual trains may be perturbed by skipping block positions as in FIG. 9.
(b) "Offset" the starting track assignment for each subsequent train by a certain number of tracks, usually 1 or 2 tracks for each new train. For example, blocks for Train A might be assigned to tracks 1 through 3; Train B to tracks 2 through 4, and train C to tracks 3 through 5.

The number of tracks required for each train depends on the number of blocks in that train, and the sorting pattern used. For example, to build a six block train using a triangular sorting pattern requires three tracks. To build a six block train using an arithmetic sorting pattern requires six tracks. "Overlap" measures the degree of interdependency between multiple train assignments using the same tracks. "Offset" and "Overlap" are related through the following mathematical expression:

$$\text{Overlap}=\text{Number of Tracks required for each train}-\text{Offset}$$

If three tracks are required for each train, then by offsetting assignments by one track, each train's block to track assignments will overlap by two tracks. If two trains share all the same tracks (zero offset), both trains are assembled simultaneously, but the sorting process is not continuously sustainable. With offset greater than or equal to the number of tracks needed by each train, block to track assignments do not overlap at all. Then only one train at a time would be built, and although the process is continuously sustainable, such non-overlapping assignments do not make the most effective use of available track space. Normally, block to track assignments should be offset by at least one track, but should also overlap as well. By both overlapping and offsetting block to track assignments the sorting process can be sustained indefinitely by starting a new train whenever a classification track becomes available. In contrast to prior art "batch" sorting methods, this method for continuous sorting imposes no restriction on the maximum number of blocks any particular train may carry. It utilizes a different pattern of block to track assignments than any prior art sorting process—and produces a novel result, which is the continuous nature of the sorting process.

FIGS. 12A thru 12G give a sequence of car movements based on the triangular sorting pattern, leading to a continuous sorting process. In these figures, both initial and secondary sorting are performed from the right, and trains depart towards the left Since each tram has six blocks, and the triangular pattern for a six block train requires three tracks, then offsetting block to track assignments by one track for each new train results in a two track overlap. Train A can be readied for departure by rehumping tracks #1, #2 and #3. This not only arranges all blocks for train A on track #1, but also begins assembly of trains B and C on tracks #2 and #3, respectively. From this point (FIG. 12D), one outbound train is completed for every additional track reprocessed, while the next two trains are "in process" of construction at all times. More trains could be added to extend the sequence at any time before train A is completed. By starting new trains whenever classification tracks become available, the sorting process can be continued indefinitely.

Although building several trains at once improves efficiency, it may imply a loss of flexibility. When block to track assignments for two trains overlap, the first train cannot be assembled without also at least partially starting construction of the second train. Unfortunately once second stage sorting has begun, if blocks become "buried" behind any other blocks, cars may no longer be added to those blocks in any straightforward manner. For example in FIG. 11C, track 3 contains the sequence (A4 B1 B3 B5) (A5) (A6). Although new cars may still be added to (A6), blocks B1, B3 and B5 appear to be closed out, so cars may no longer be added without a special switching move. Curiously however, after track 3 is reprocessed in FIG. 11D, these blocks move to "first out" position on tracks 3, 4 and 5 respectively, so they open up again to receive additional cars. This shows that determination whether or not a block is really "closed out" may be a complex matter which depends not only on the current block to track configuration, but also planned future arrangements. In this instance cars for blocks B1, B3 and B5 may be intermixed with the A6 cars without adverse effect, giving as an allowable configuration: (A4 B1 B3 B5) (A5) (A6 B1 B3 B5), so B1, B3 and B5 are not in fact closed out.

To summarize, if cars remain to be added to any blocks which would be closed out by reprocessing a track, then either second stage sorting must be postponed long enough to add those inbound cars first (possibly delaying departure of the first train), or connections for the second train may be missed. Reducing overlap in block to track assignments reduces interdependency between subsequent train departures, but also utilizes track space less intensively, and so requires more tracks in the yard.

This problem can be managed by overlapping block to track assignments for outbound trains according to the planned order of departure. The proper amount of overlap depends on how closely train departures are scheduled. For departures scheduled less than an hour apart, the prior art triangular pattern might be used to assemble both trains simultaneously. For departures two or three hours apart, a one or two track overlap as in

TABLE 11

Figure 11A:
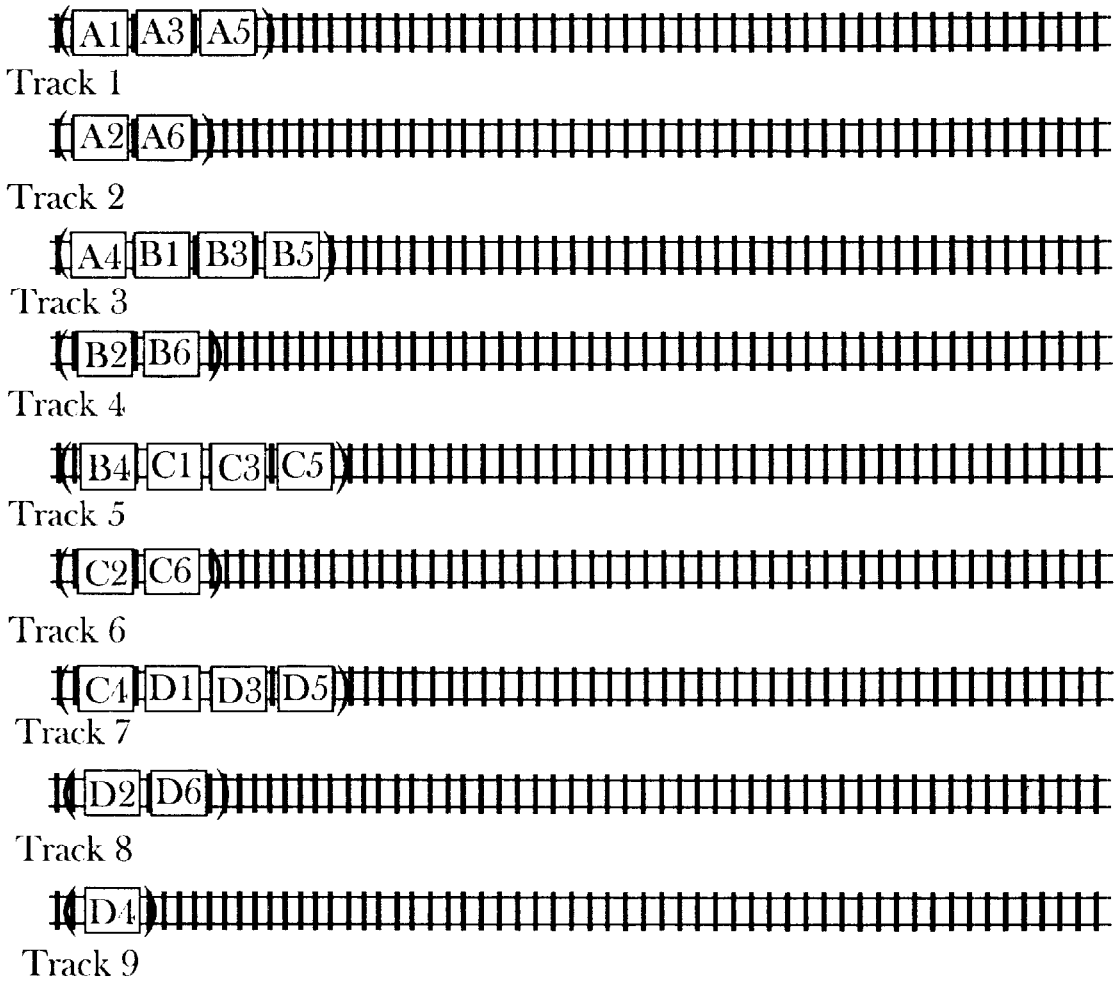
FIGS. 11A through 11J show continuous triangular sorting in accordance with this invention with a one track overlap.
Figure 11B:
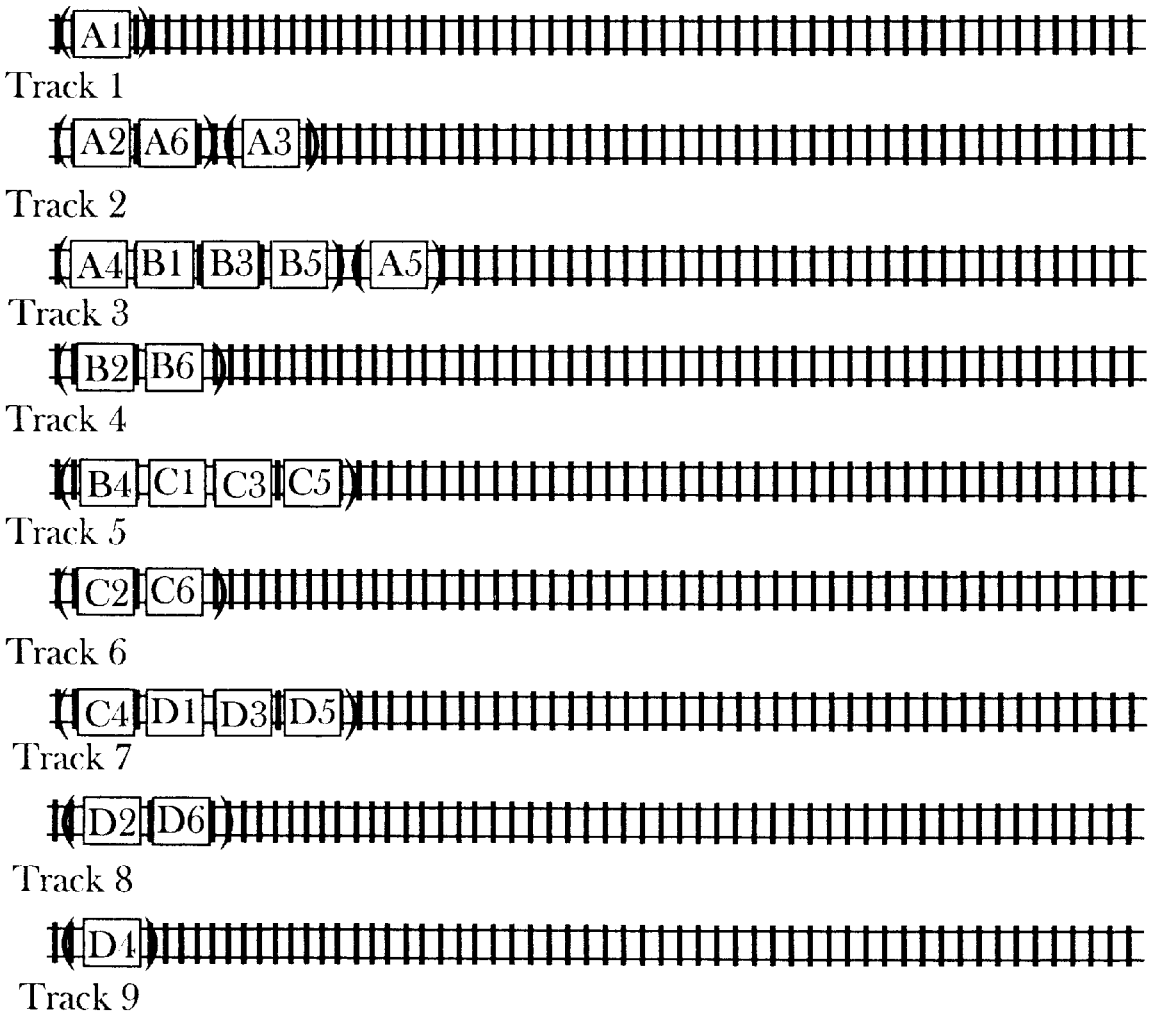
Figure 11C:
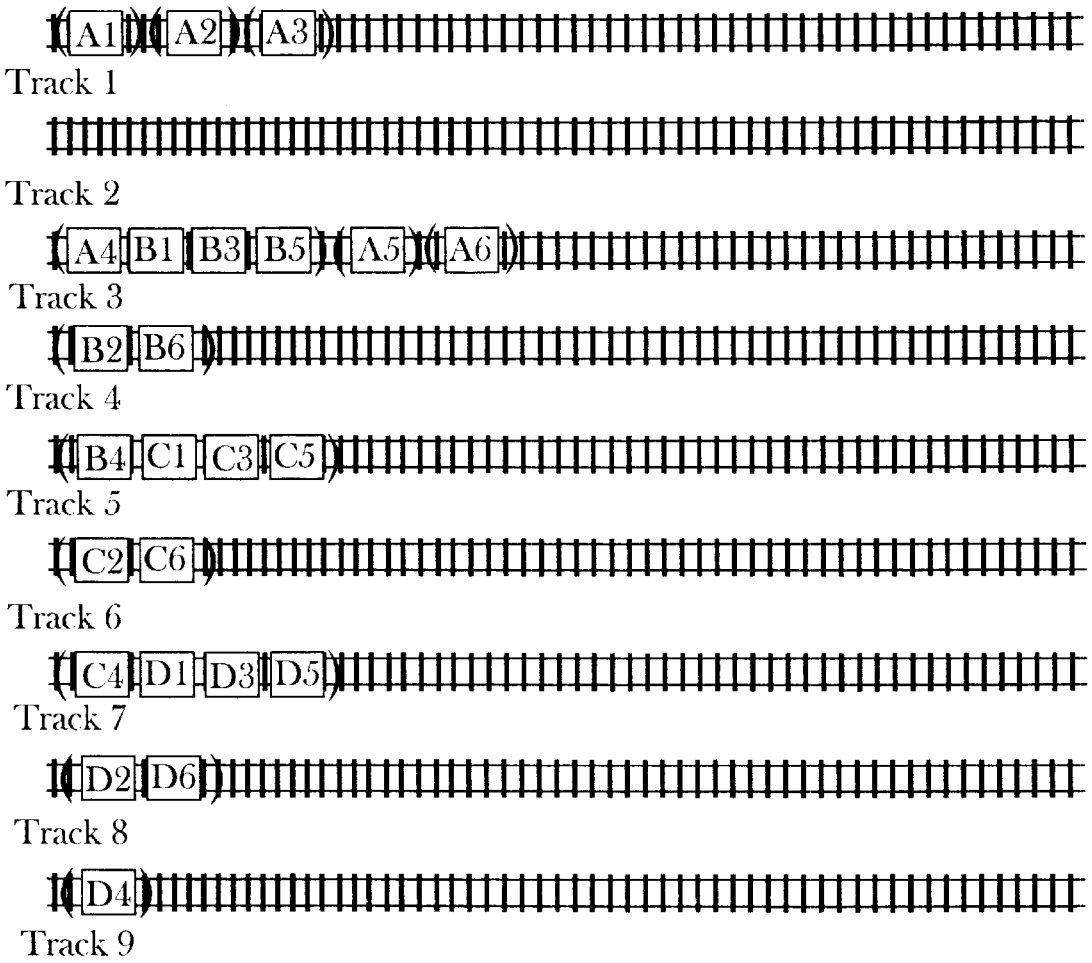
Figure 11D:
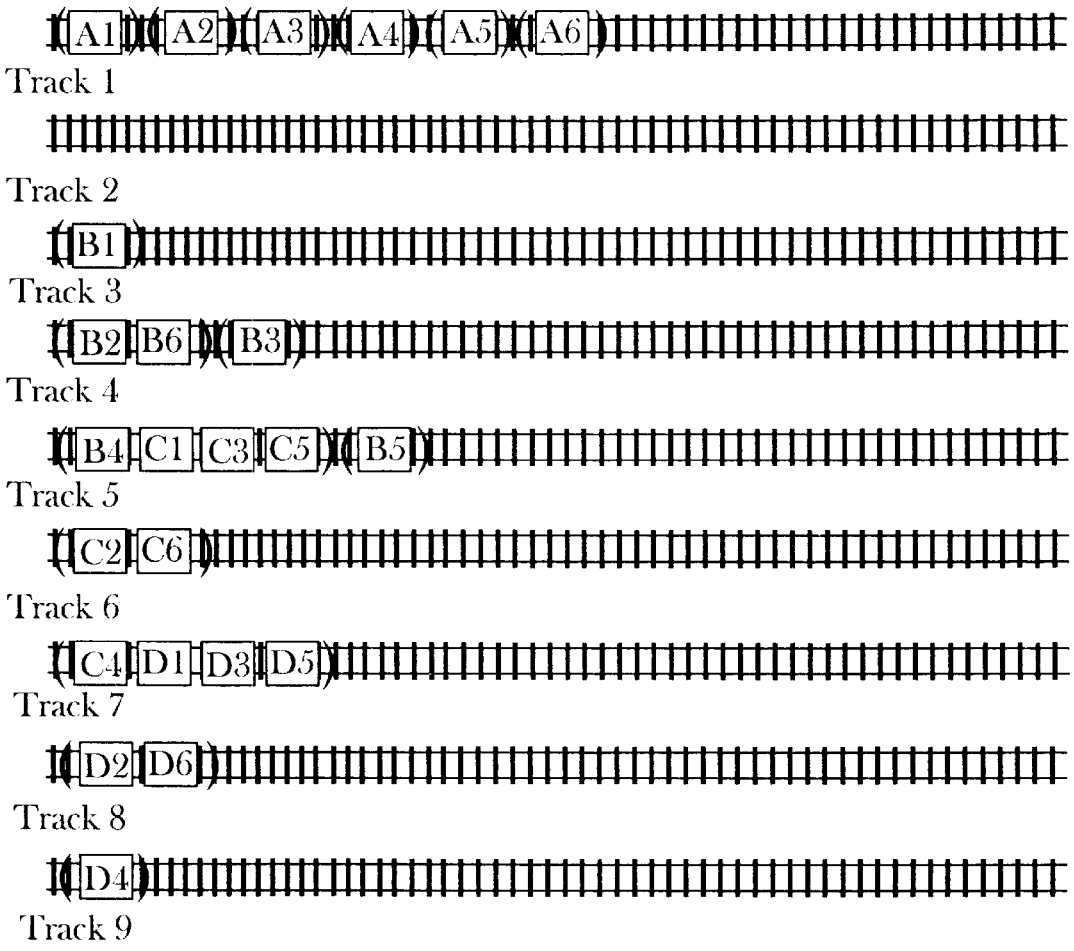
Figure 11E:
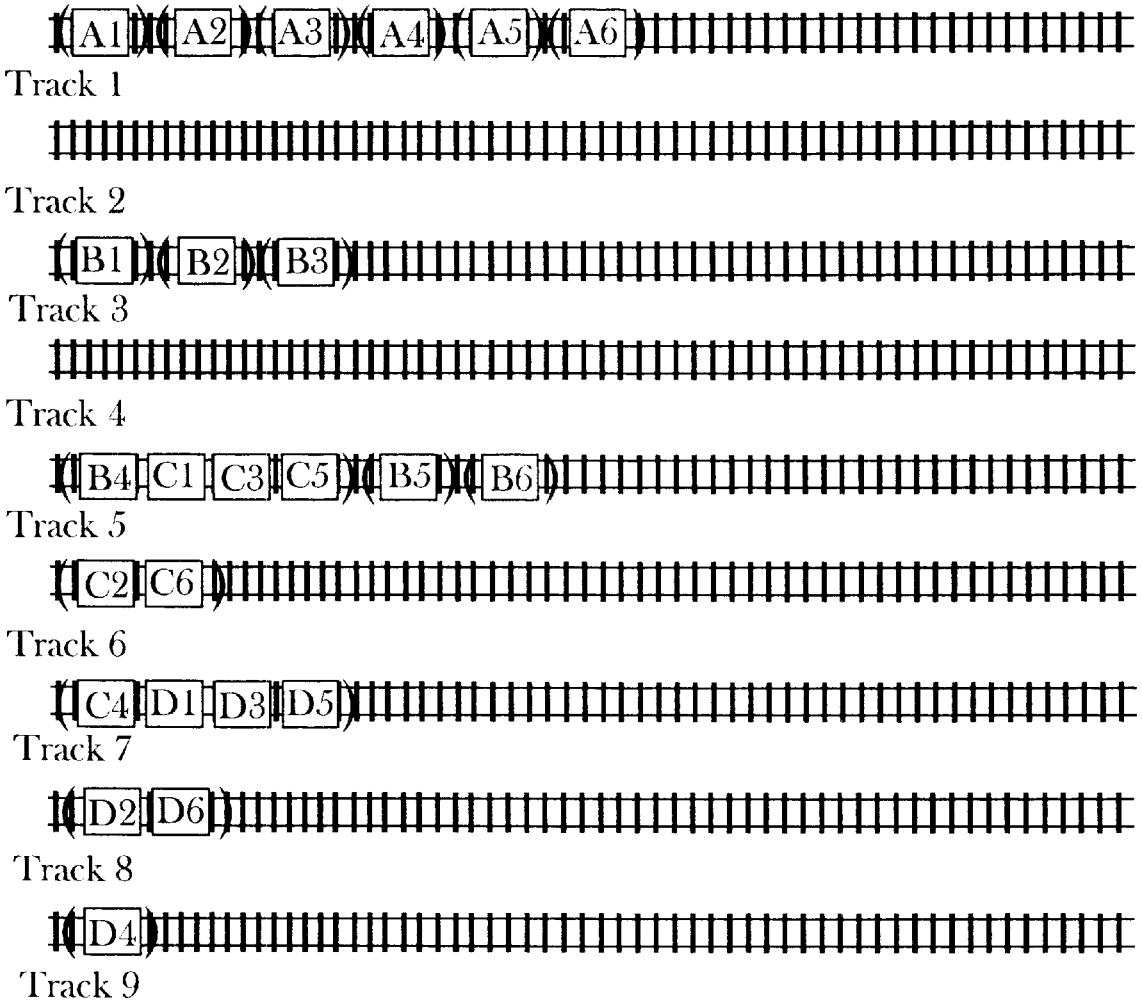
Figure 11F:
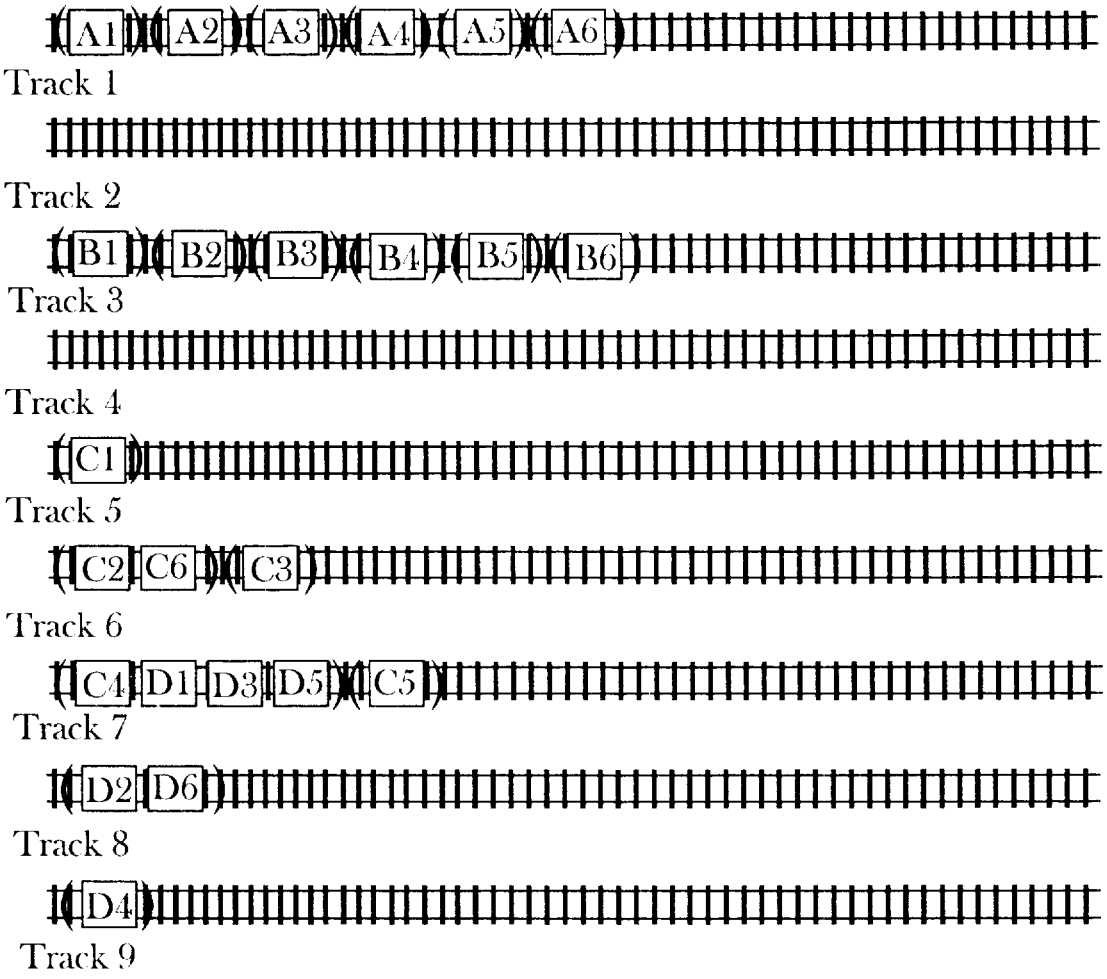
Figure 11G:
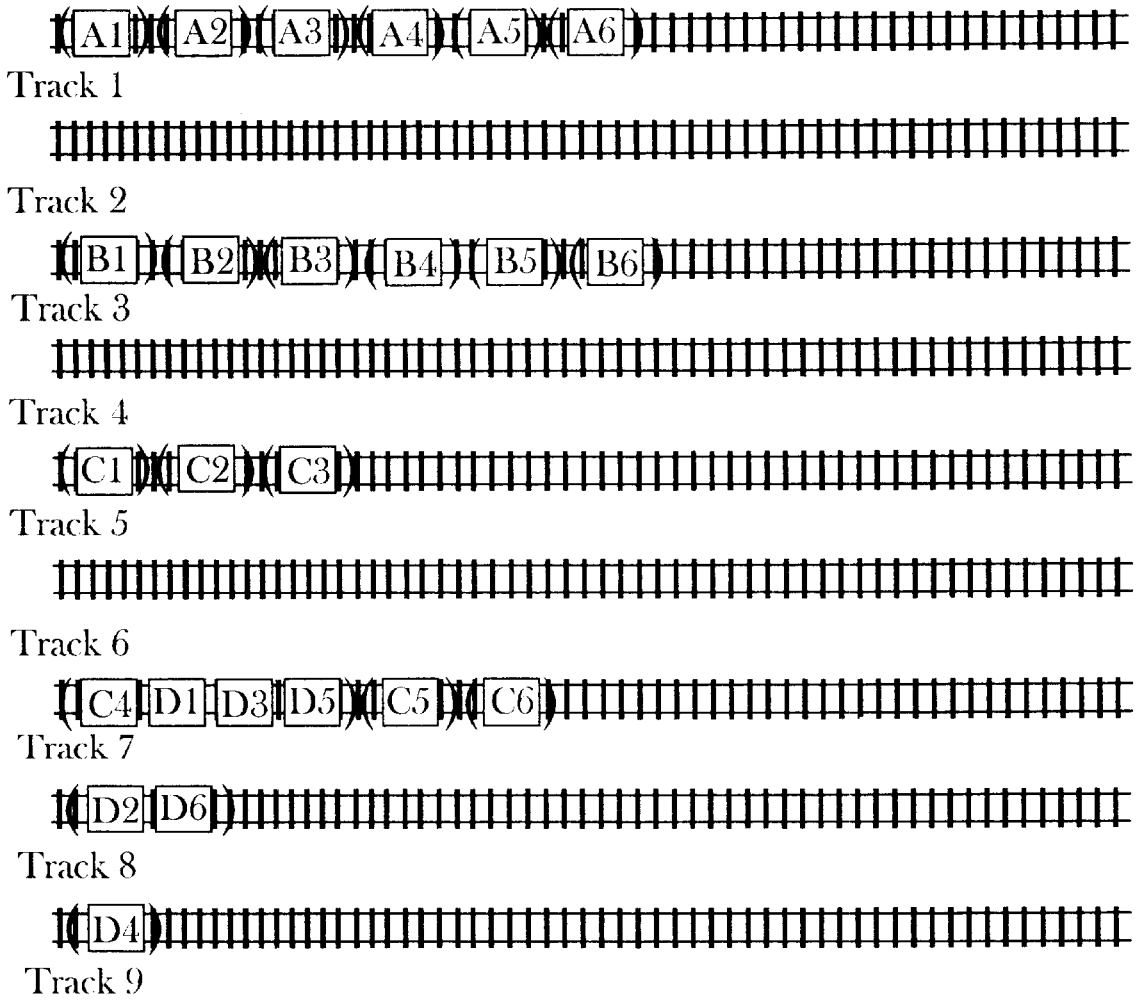
Figure 11H:
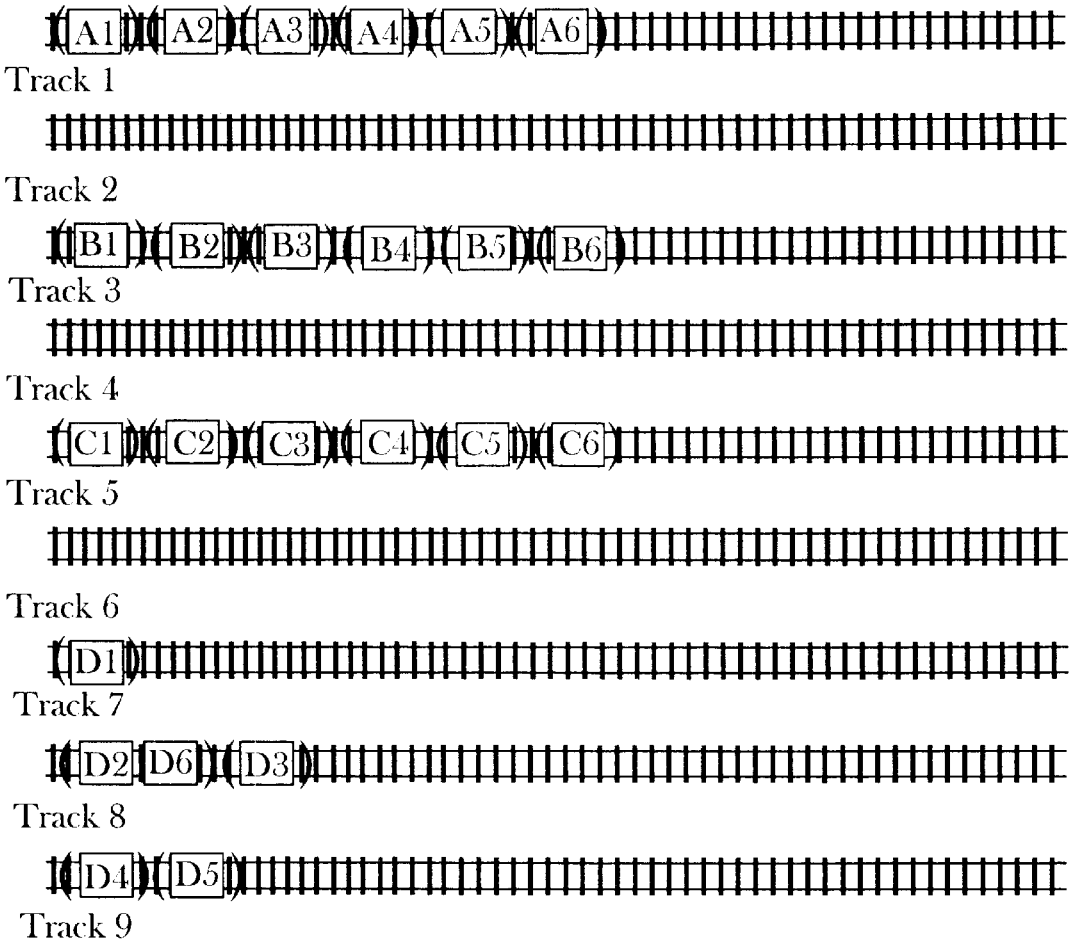
Figure 11I:
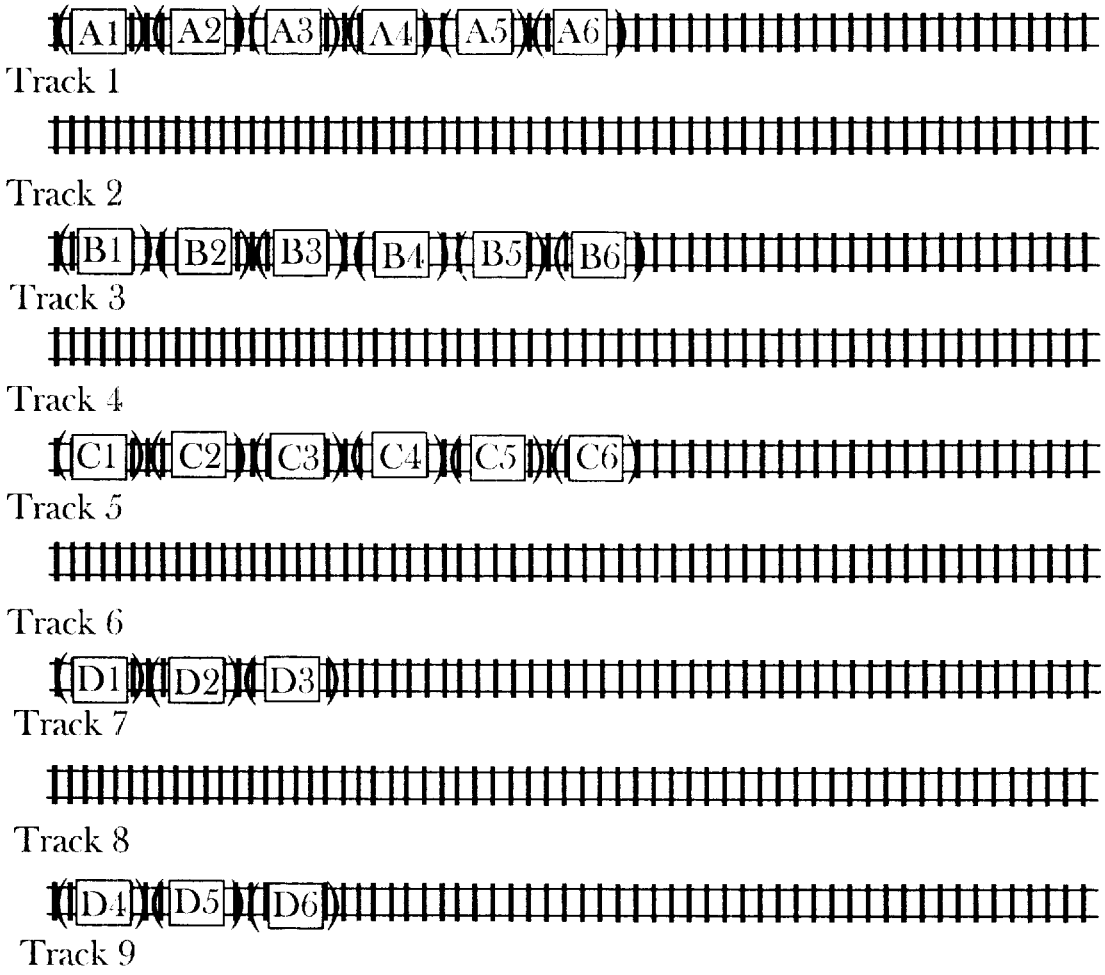
Figure 11J:
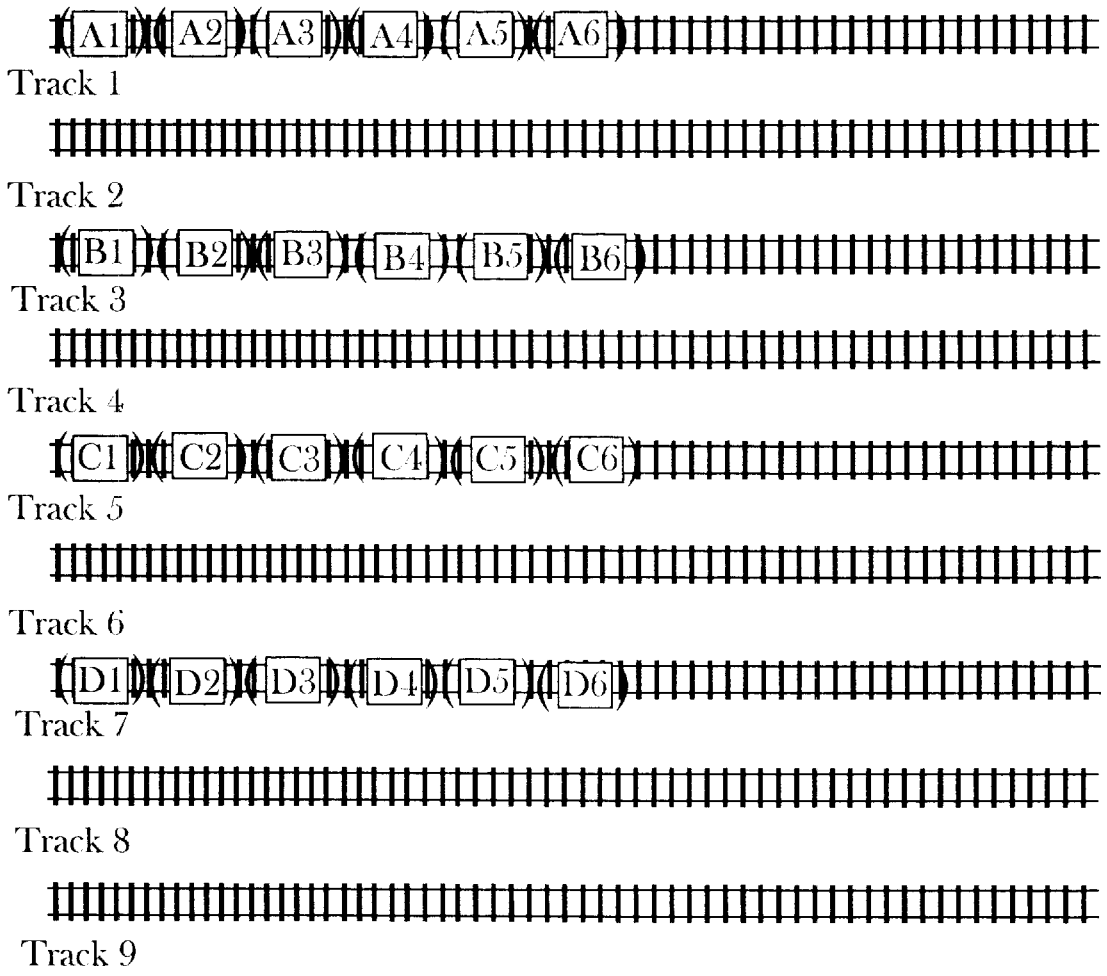

| | |
|---|---|
| First Stage Set up shown in FIG. 11A | A1,A3,A5 to Track 1<br>A2,A6 to Track 2<br>A4,B1,B3,B5 to Track 3<br>B2,B6 to Track 4<br>B4,C1,C3,C5 to Track 5<br>C2,C6 to Track 6<br>C4,D1,D3,D5 to Track 7<br>D2,D6 to Track 8<br>D4 to Track 9 |
| Pull Back Track 1 from the right side, and reclassify as follows. Outcome shown FIG. 11B. | A1 to Track 1<br>A3 to Track 2<br>A5 to Track 3 |
| Pull Back Track 2 from the right side, and reclassify as follows. Outcome shown in FIG. 11C. | A2,A3 to Track 1<br>A6 to Track 3 |
| Pull Back Track 3 from the right side, and reclassify as follows. Outcome shown in FIG. 11D. | A4,A5,A6 to Track 1<br>(Train A is completed)<br>B1 to Track 3<br>B3 to Track 4<br>B5 to Track 5 |
| Pull Back Track 4 from the right side, and reclassify as follows. Outcome shown in FIG. 11E. | B2,B3 to Track 3<br>B6 to to Track 5 |
| Pull Back Track 5 from the right side, and reclassify as follows. Outcome shown in FIG. 11F. | B4,B5,B6 to Track 3<br>(Train B is completed)<br>C1 to Track 5<br>C3 to Track 6<br>C5 to Track 7 |
| Pull Back Track 6 from the right side, and reclassify as follows. Outcome shown in FIG. 11G | C2,C3 to Track 5<br>C6 to to Track 7 |
| Pull Back Track 7 from the right side, and reclassify as follows. Outcome shown in FIG. 11H. | C4,C5,C6 to Track 5<br>(Train C is completed)<br>D1 to Track 7<br>D3 to Track 8<br>D5 to Track 9 |
| Pull Back Track 8 from the right side, and reclassify as follows. Outcome shown in FIG. 11I. | D2,D3 to Track 7<br>D6 to to Track 9 |
| Pull Back Track 9 from the right side, and reclassify as follows. Outcome shown in FIG. 11J. All four trains are ready for departure towards the left. | D4,D5,D6 to Track 7<br>(Train D is completed) |

TABLE 12

Figure 12A:
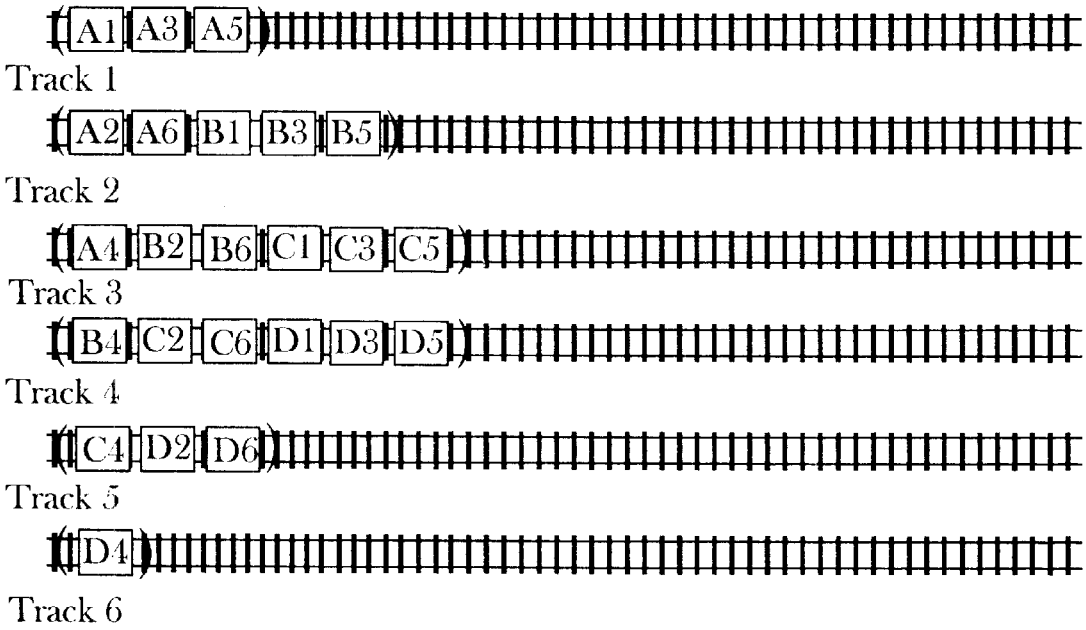
FIGS. 12A through 12G show continuous triangular sorting in accordance with this invention with a two track overlap.
Figure 12B:
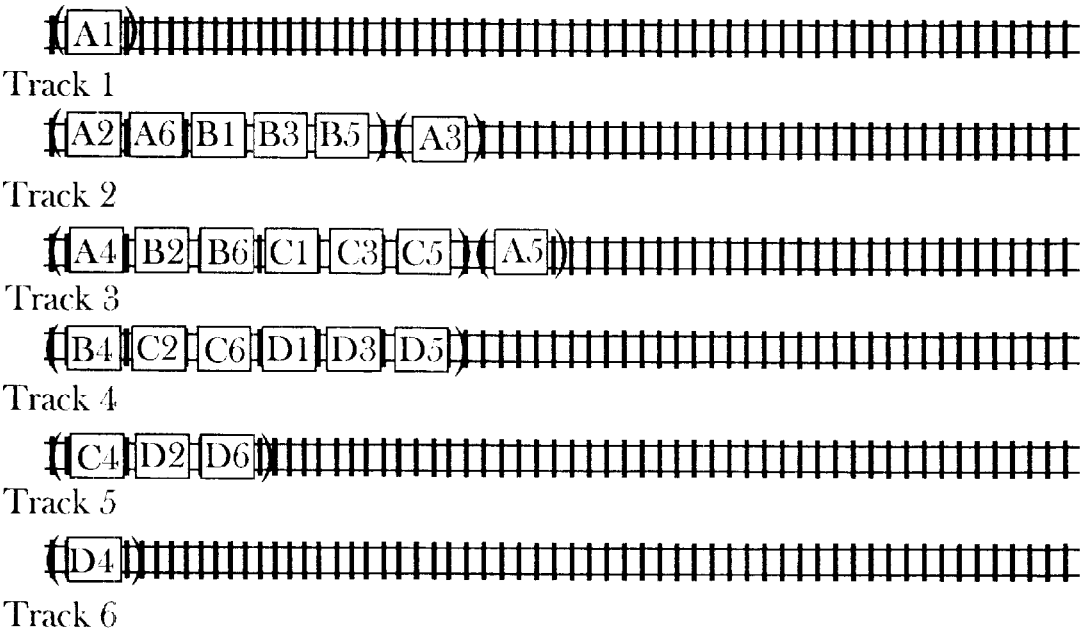
Figure 12C:
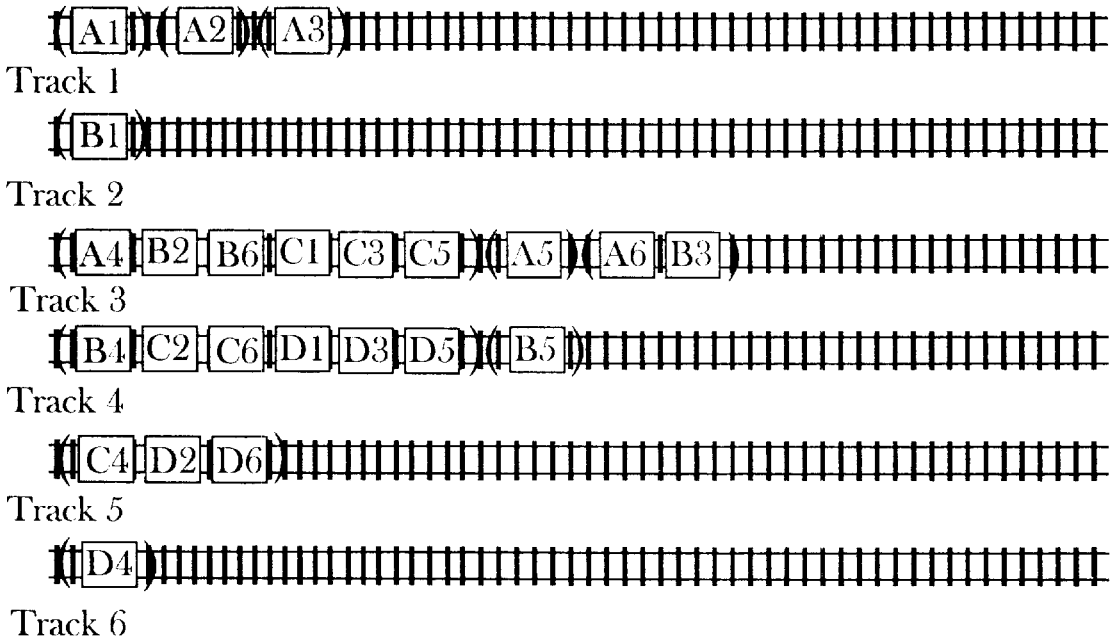
Figure 12D:
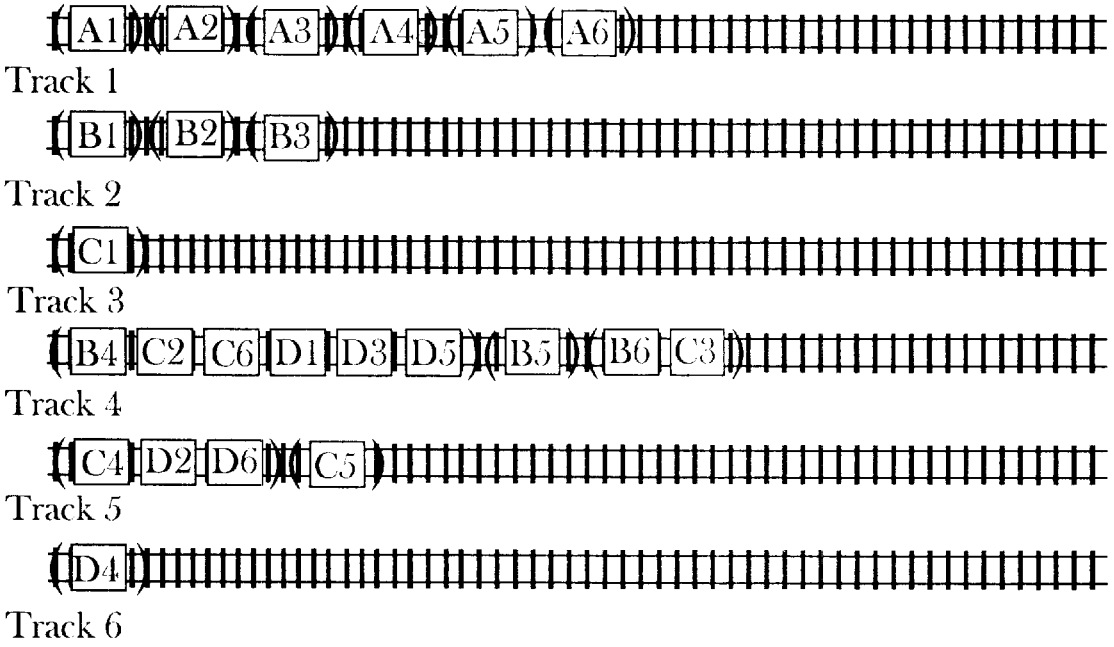
Figure 12E:
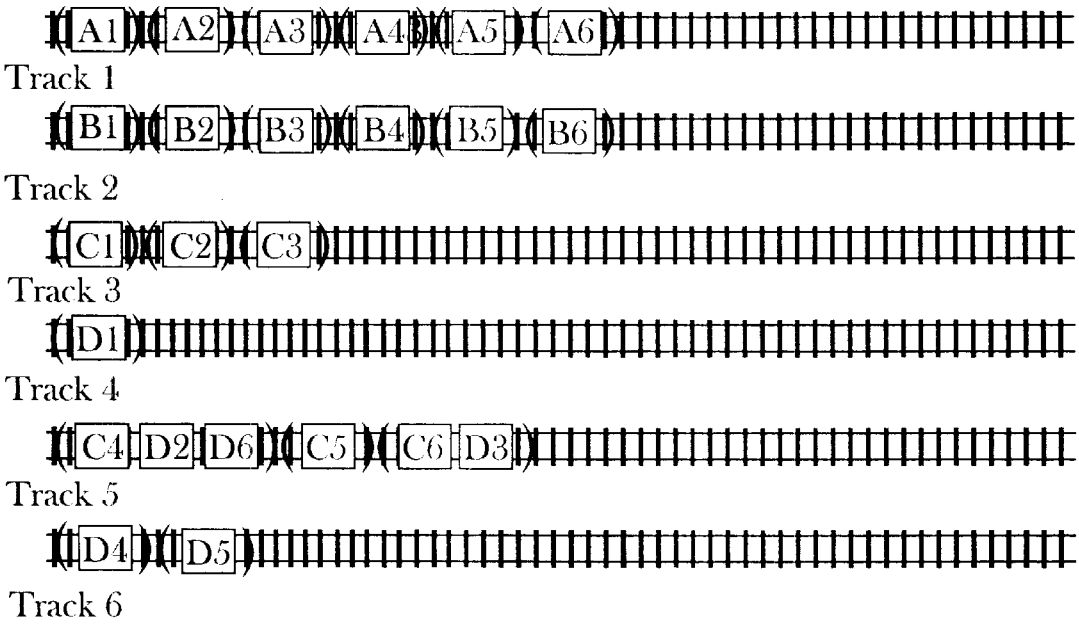
Figure 12F:
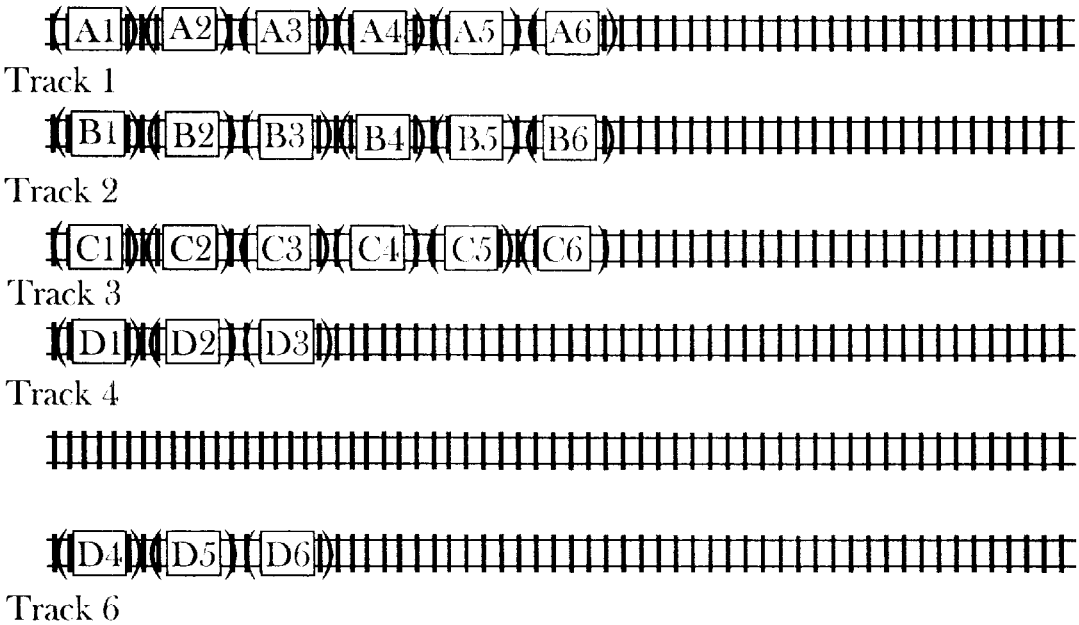
Figure 12G:
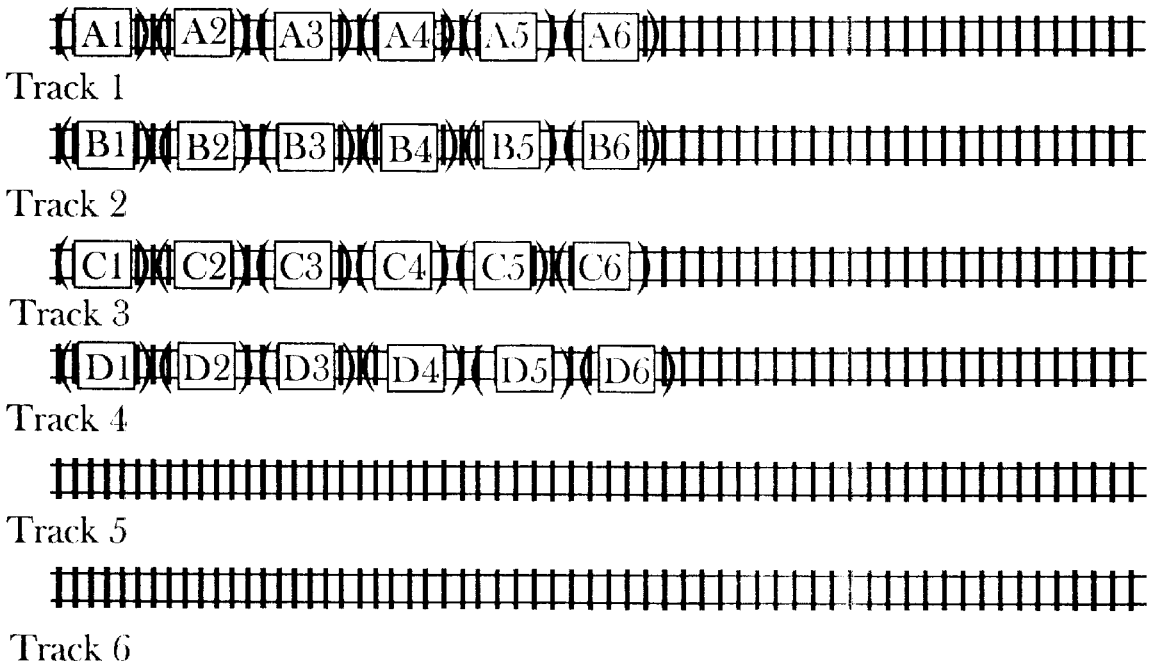

| | |
|---|---|
| First Stage Setup shown in FIG. 12A | A1,A3,A5 to Track 1<br>A2,A6,B1,B3,B5 to Track 2<br>A4,B2,B6,C1,C3,C5 to Track 3<br>B4,C2,C6,D1,D3,D5 to Track 4<br>C4,D2,D6 to Track 5<br>D4 to Track 6 |
| Pull Back Track 1 from the right side, and reclassify as follows. Outcome shown in FIG. 12B. | A1 to Track 1<br>A3 to Track 2<br>A5 to Track 3 |
| Pull Back Track 2 from the right side, and reclassify as follows. Outcome shown in FIG. 12C. | A2,A3 to Track 1<br>B1 to Track 2<br>A6,B3 to Track 3<br>B5 to Track 4 |
| Pull Back Track 3 from the right side, and reclassify as follows. Outcome shown in FIG. 12D. | A4,A5,A6 to Track 1<br>(Train A is completed)<br>B2,B3 to Track 2<br>C1 to Track 3<br>B6,C3 to Track 4<br>C5 to Track 5 |
| Pull Back Track 4 from the right side, and reclassify as follows. Outcome shown in FIG. 12E. | B4,B5,B6 to Track 2<br>(Train B is completed)<br>C2,C3 to Track 3<br>D1 to Track 4<br>C6,D3 to Track 5<br>D5 to Track 6 |
| Pull Back Track 5 from the right side, and reclassify as follows. Outcome shown in FIG. 12F. | C4,C5,C6 to Track 3<br>(Train C is completed)<br>D2,D3 to Track 4<br>D6 to Track 6 |
| Pull Back Track 6 from the right side, and reclassify as follows. Outcome shown in FIG. 12G. All four trains are ready for departure towards the left. | D4,D5,D6 to Track 4<br>(Train D is completed) |

FIGS. 11A–11J or 12A–12G, respectively, should be used. Tables 11 and 12 describe the sequence of rail car movements shown in drawing FIGS. 11A–11J and 12A–12G, respectively. For departure spaced wider than this, separate tracks should be used for each train (no overlap) so each train may be assembled independently.

If any classification track will be required to hold too many cars during an intermediate sorting stage, it may be possible to prevent this overflow by either reducing the overlap between subsequent trains, or by perturbing the sorting pattern to reduce the utilization of that track, for example by skipping an intermediate block position as in FIGS. 9A thru 9D.

Designs for the preferred and additional embodiments in FIGS. 10, 13, 14 and 15 are optimized for continuous triangular or geometric sorting, since the length of the switching lead 40, 40*a*, or 40*b* approximately equals the length of each yard track 55.

In this two stage sorting process, specific cars can be selected for each outbound train based on car priority or delivery commitment. There are two different methods of accomplishing this:

(a) If classification tracks 55 are available, low priority cars in excess of outbound train capacity can be diverted from their primary classification in the first stage sort, as may now be done using a single stage sorting approach. This saves one handling for each car diverted, but requires a decision very early on outbound train make up. It also requires that a separate classification track 55 be available to receive the cars, implying that two different outbound trains must be built simultaneously carrying the same blocks.

(b) Diverting cars into a rehump track generally does not make sense in multiple stage sorting. Instead, it is better to just ignore the outbound train in the first stage sort and keep all cars intermixed until the second stage sort. Excess cars can easily be "rolled" to a later train in the second stage sort. This preserves the maximum degree of operating flexibility, and avoids the need to build more than one train at a time for each block.

The ability to intermix cars for different trains, and thereby defer decision making on the exact makeup of each outbound train until the second stage sort is a key benefit of the multiple stage switching process. The method is robust even if train schedules cannot be strictly adhered to, and emergency train schedule changes are well tolerated. Once assembled, outbound trains may simply rest on classification tracks 55 until operational circumstances permit their departure. Provided a sufficient number of tracks 55 remain available for continued operation of the facility, holding trains as needed in the yard does not prevent or interfere with the makeup of any other trains.

Figure 13:
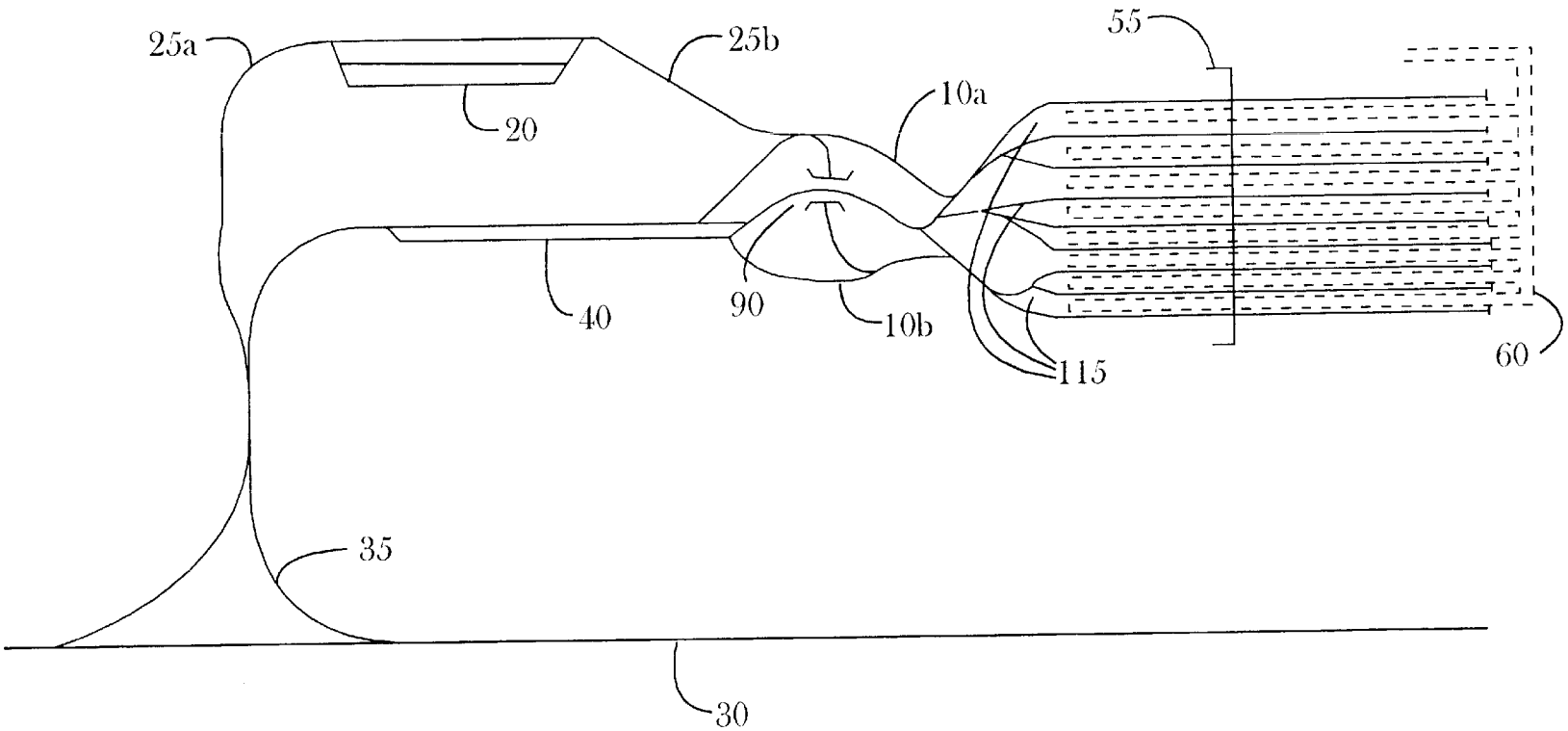
FIG. 13 shows a lower cost, stub-end version of a multi stage yard in accordance with this invention.
Figure 14:
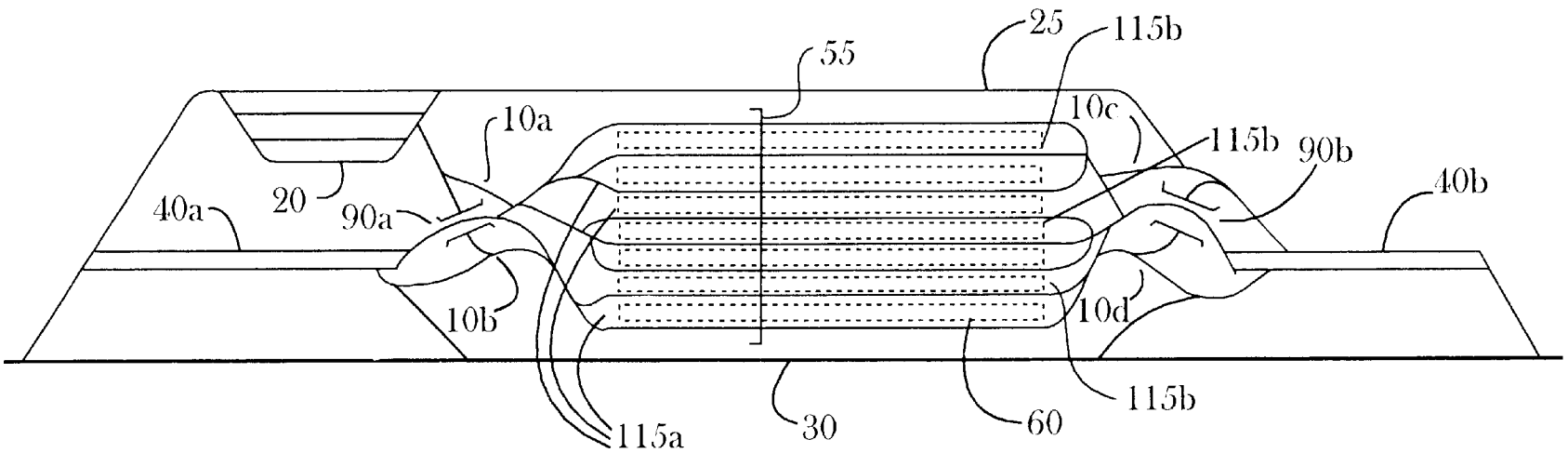
FIG. 14 shows a higher capacity, double-ended version of a multi stage yard in accordance with this invention.
Figure 15:
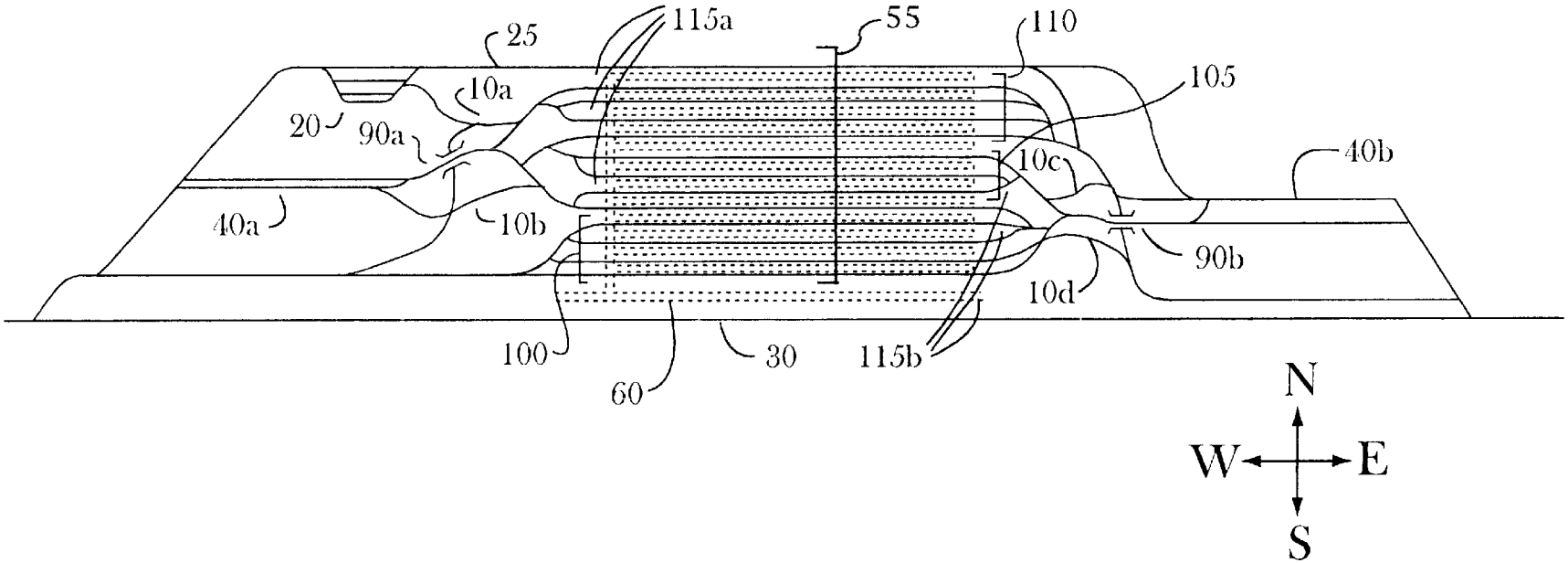
FIG. 15 shows a higher capacity, double-ended and lapped version of a multi stage yard in accordance with this invention.

FIGS. 13, 14 and 15—Additional Embodiments

Variations on this theme include a lower-cost stub end, and higher-capacity double ended design shown in FIGS. 13 and 14. In each of these designs, all trains must arrive and depart through escape tracks 10 or over the hump 90. If only a locomotive uses the escape track, the interruption only lasts for a couple of minutes; but arrival or departure of a train might require 20–30 minutes. This interference might be tolerated if trains are permitted to arrive or depart only during second stage sorting, when switching activities are limited only to a few tracks, which are hopefully all concentrated on the opposite side of the yard. But this required use of escape tracks and the required coordination in a stub end yard would inevitably lead to delays in hump processing, receiving or departing trains, or both.

A "lapped" variation of the high capacity double-ended yard is shown in FIG. 15. This configuration overcomes the disadvantage of escape tracks by providing a second set of switches opposite each hump with dedicated arrival/departure leads in both directions. Switches 100 at the Westbound Departure/Eastbound Arrival end are provided opposite to hump 90*b*; and switches 110 at the Eastbound Departure/Westbound Arrival end are provided opposite to hump 90*a*. These second sets of switches 100 and 110 in FIG. 15 serve the same purpose as do switches 80 at the Arrival Departure end in FIG. 10; which provide a means for direct arrival and departure of trains from and to the mainline 30 without interfering with hump 90 processing activities. Tracks connected to switches 100 and 110 on the outside of the yard are used for receiving and assembling outbound trains, while tracks 105 in the middle are mostly used for first stage sorting. This leads to a "cross flow" traffic pattern within the yard, whereby eastbound trains are received via the eastbound receiving/westbound departure switches 100; cars are humped into one of the middle tracks 105 in the first stage sort; and finally outbound eastbound trains are assembled (using the opposite hump) and depart using the westbound receiving/eastbound departure switches 110. Westbound cars progress through the yard in the opposite direction.

Operation of the Additional Embodiments

First stage sorting from one end of the yard and secondary sorting from the other hump eliminates the need to switch cars into the same track from both ends of the yard at the same time, since the same track will never be used for both purposes at the same time. If secondary sorting is done from the opposite end of the yard, the train must be set up "backwards" by inverting the sequence of block subscripts in the first stage sort, as shown in FIGS. 16A thru 16G. Table 16 below describes the sequence of railcar movements shown in drawing FIGS. 16A–16G. An interlocked control system should be provided to ensure that only one hump has "control" over each track at any time, and also to provide lock-out or "blue flag" protection, by preventing cars from being routed into tracks where

TABLE 16

Figure 16A:
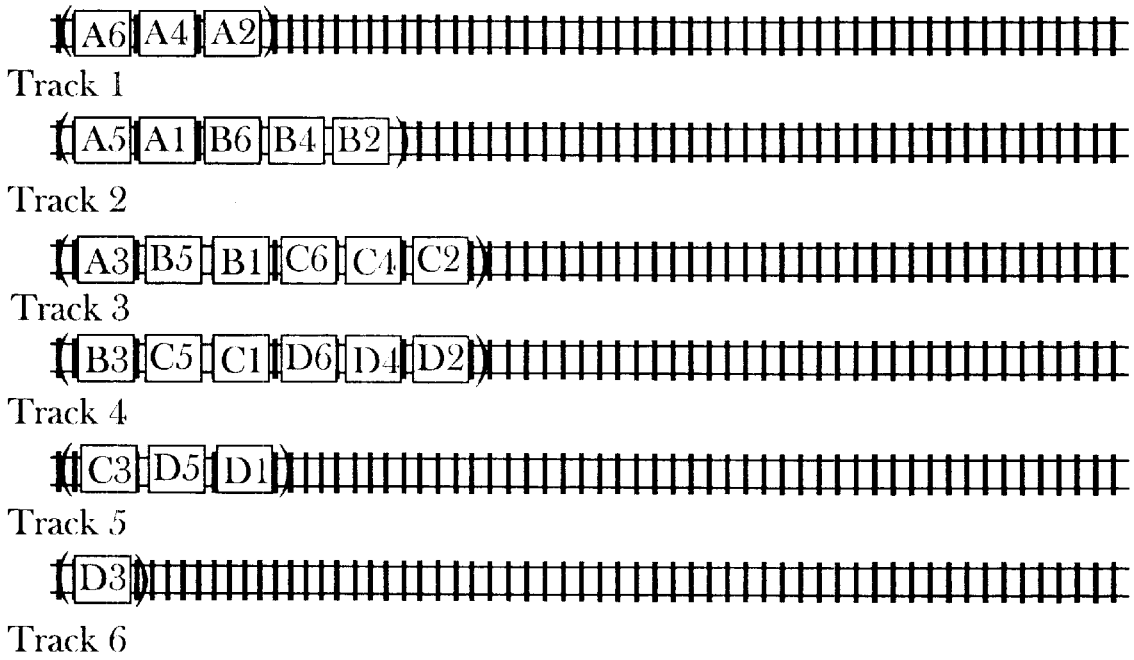
FIGS. 16A through 16G show continuous triangular sorting in accordance with this invention with a one track-overlap, similar to FIG. 12, except the yard is set up "backwards" in the first stage sort. It shows the ease by which trains can be prepared to depart either to the left or to the right, simply by inverting the positions of the block sequence numbers in the first stage classification.
Figure 16B:
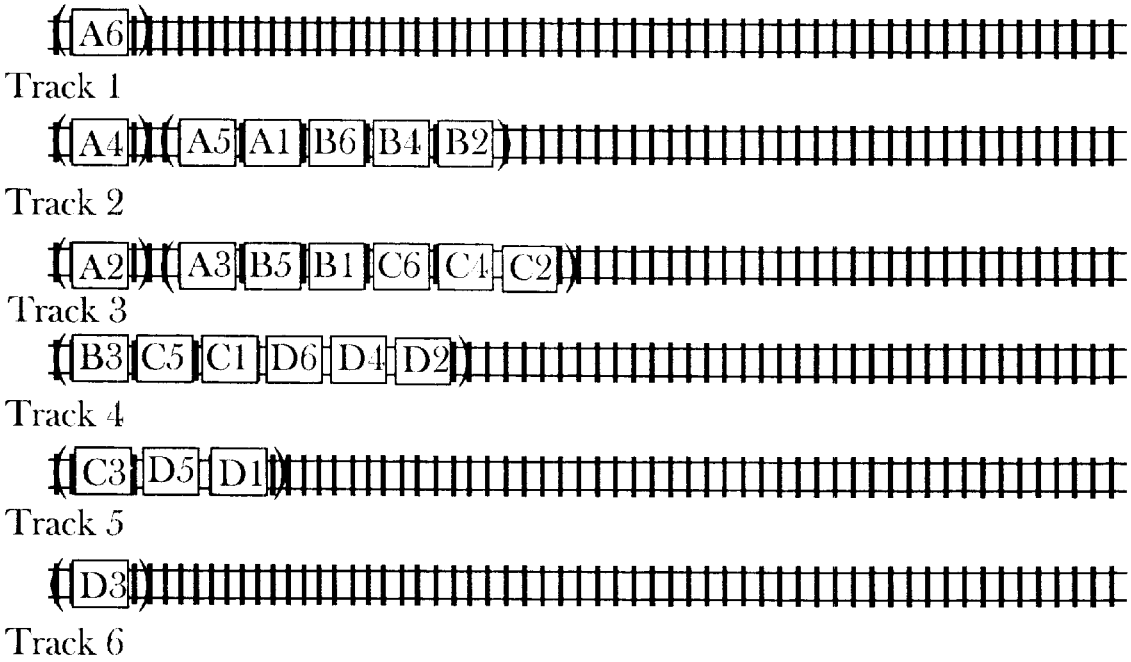
Figure 16C:
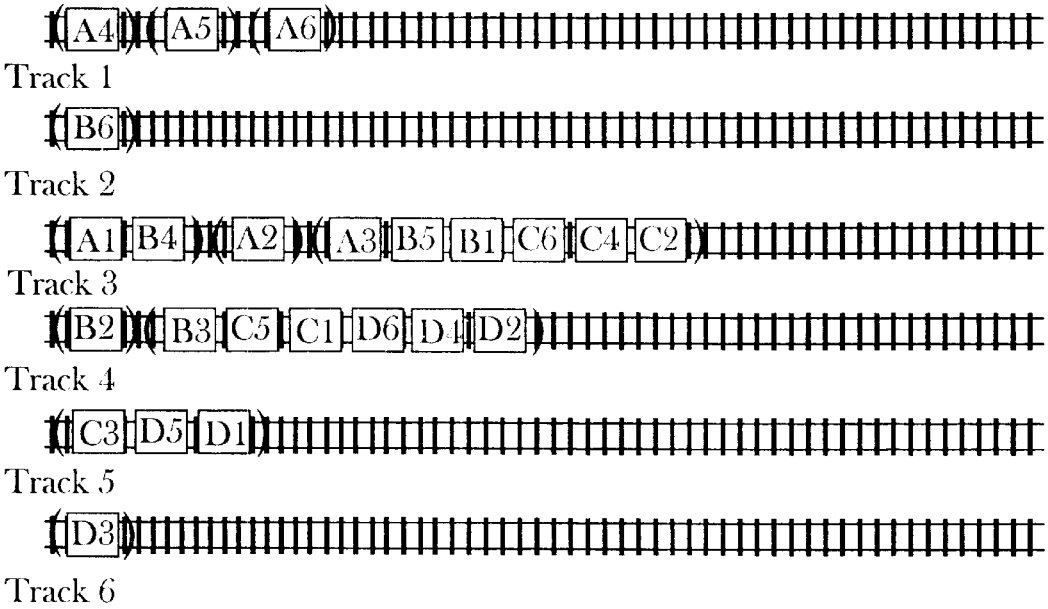
Figure 16D:
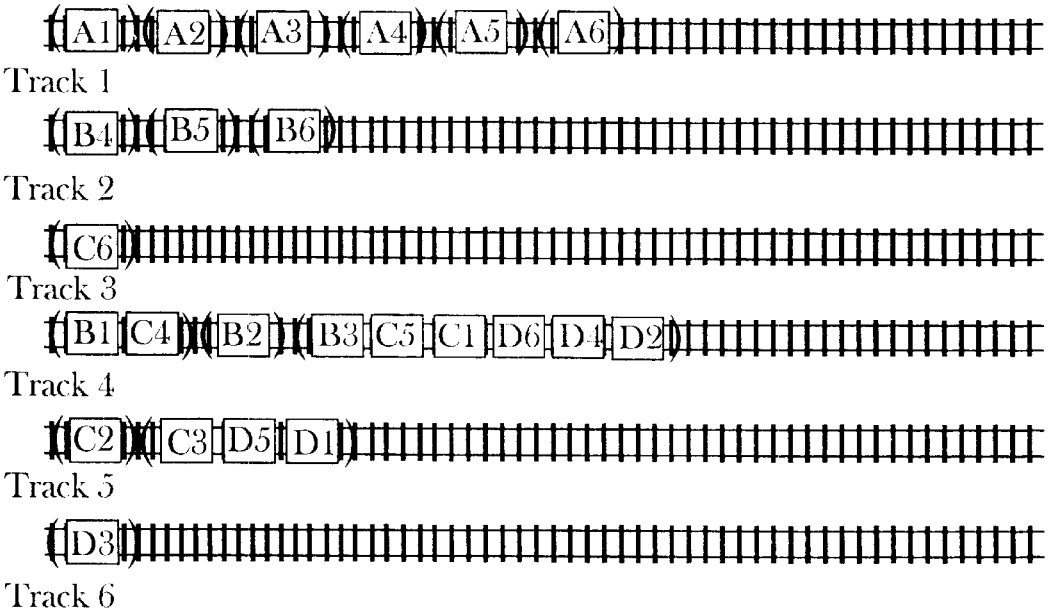
Figure 16E:
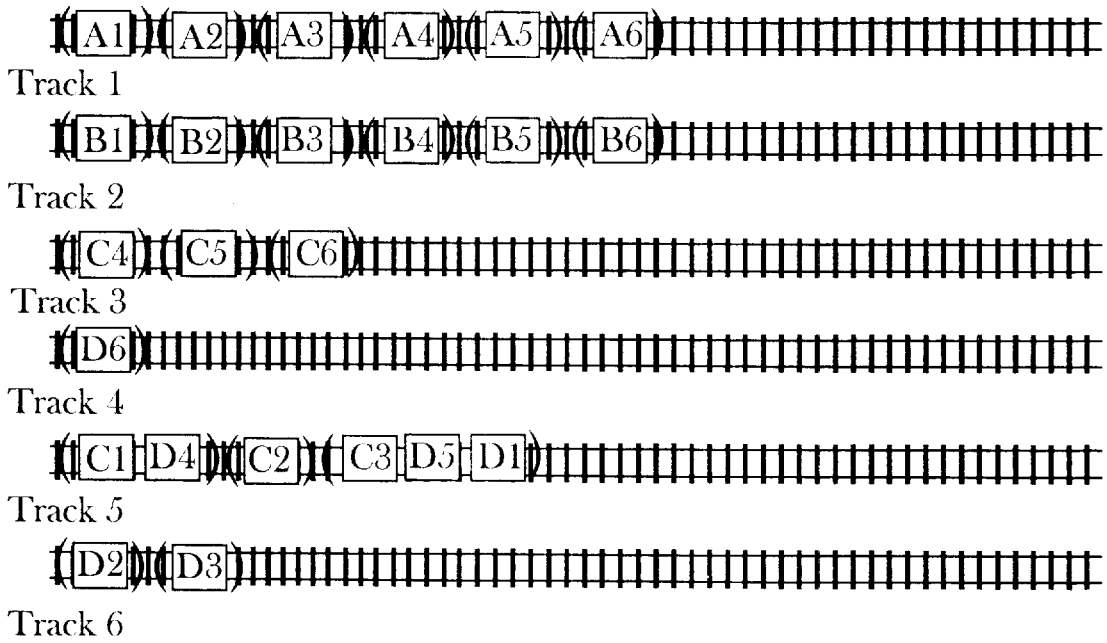
Figure 16F:
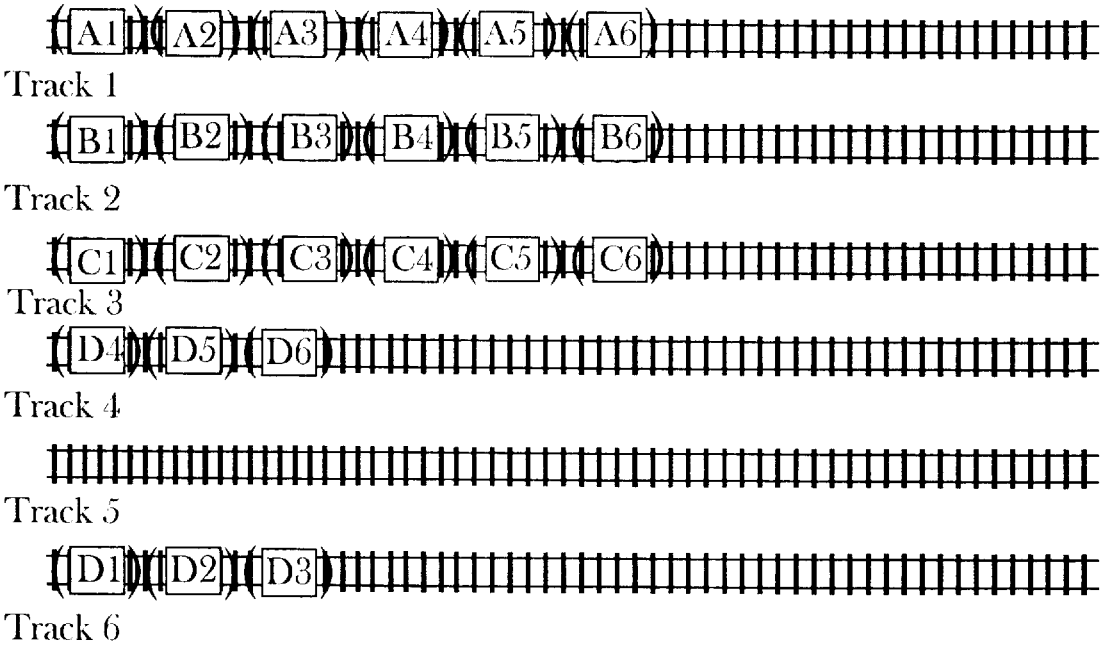
Figure 16G:
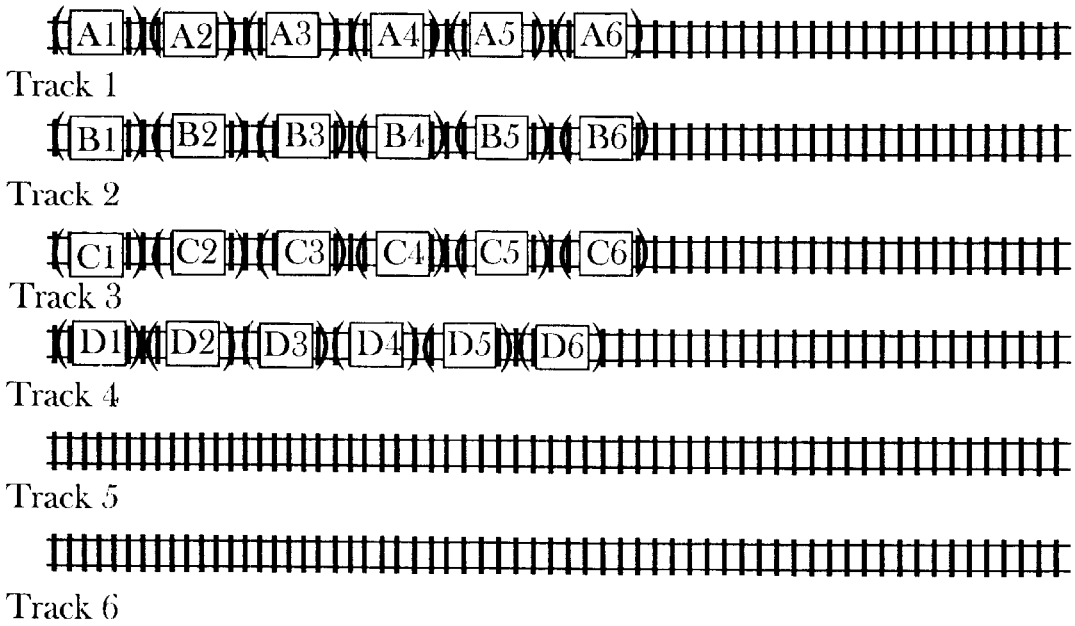

| | |
|---|---|
| First Stage Setup shown in FIG. 16A | A6,A4,A2 to Track 1<br>A5,A1,B6,B4,B2 to Track 2<br>A3,B5,B1,C6,C4,C2 to Track 3<br>B3,C5,C1,D6,D4,D2 to Track 4<br>C3,D5,D1 to Track 5<br>D3 to Track 6 |
| Pull Back Track 1 from the left side, and reclassify as follow . Outcome shown in FIG. 16B. | A6 to Track 1<br>A4 to Track 2<br>A2 to Track 3 |
| Pull Back Track 2 from the left side, and reclassify as follows. Outcome shown in FIG. 16C. | A4,A5 to Track 1<br>B6 to Track 2<br>A1,B4 to Track 3<br>B2 to Track 4 |
| Pull Back Track 3 from the left side, and reclassify as follows. Outcome shown in FIG. 16D. | A1,A2,A3 to Track 1<br>(Train A is completed)<br>B4,B5 to Track 2 |

TABLE 16-continued

| | |
|---|---|
| | C6 to Track 3<br>B1,C4 to Track 4<br>C2 to Track 5 |
| Pull Back Track 4 from the left side, and reclassify as follows. Outcome shown in FIG. 16E. | B1,B2,B3 to Track 2<br>(Train B is completed)<br>C4,C5 to Track 3<br>D6 to Track 4<br>C1,D4 to Track 5<br>D2 to Track 6 |
| Pull Back Track 5 from the left side, and reclassify as follows. Outcome shown in FIG. 16F. | C1,C2,C3 to Track 3<br>(Train C is completed)<br>D4,D5 to Track 4<br>D1 to Track 6 |
| Pull Back Track 6 from the left side, and reclassify as follows. Outcome shown in FIG. 16H. All four trains are ready for departure towards the left. | D1,D2,D3 to Track 4<br>(Train D is completed) |

mechanical personnel are inspecting or repairing equipment. Although the double ended design increases capacity, sorting activity may become so intense that it becomes difficult for mechanical personnel to find the time necessary to inspect and maintain equipment without increasing the amount of time cars must remain in the yard.

For the lapped design shown in FIG. 15, while the hump at one end of the yard is engaged in primary sorting—sending cars to tracks in the middle of the yard—the opposite hump should be assembling trains by secondary sorting into the outer tracks. Center tracks can receive cars from humps at either end of the yard, but not at the same time (unless the car retarder or speed control systems are specifically designed to allow this.)

FIGS. 17 thru 20—Alternative Embodiments

FIGS. 17, 18 and 20 show prior art yard designs (Christianson, 1972) for the two stage arithmetic pattern, or "Sorting by Block" as described in FIGS. 8A thru 8E. FIGS. 17 and 18 show "folded" yard designs which use a back-and-forth car movement pattern, whereas FIG. 20 shows an "in line" version of a two-stage sorting yard. These designs are more complex and less flexible than simple triangular sorting yards, and the sorting by block process does not permit car inspection or repairs to be performed in the first stage classification yard.

The most critical shortcoming of the "folded" design is the bottleneck which occurs between the two sections of the yard, and through which every car must move twice. Davis (1967) suggested this be overcome by using mechanical devices rather than gravity to accelerate and decelerate cars at a high speed through this zone. Dual humps (FIG. 19) could also be provided to increase capacity, but if both humps operate simultaneously, access to half the tracks in each yard are blocked by trains being humped in the opposite direction.

The "in line" design of FIG. 20 eliminates this bottleneck, but reinstitutes the need for an independent receiving yard, geographically widely separated from the departure yard, making flat switching or "block swapping" difficult and inconvenient

Operation of the Alternative Embodiments

The arithmetic or "sorting by block" method can also be continuously sustained by offsetting and overlapping block to track assignments. FIGS. 8A thru 8E show the prior art method of "sorting by blocks." In this method, cars for the first block on each train are intermixed on the first track, cars for the second block are intermixed on the second track, and so on. Table 8 below describes the sequence of railcar movements shown in drawing FIGS. 8A–8E.

For continuous sorting, the first block of the second train is placed on the second track (instead of the first track), the first block of the third train is placed on the third track (instead of the first track), and so on. FIGS. 21A thru 21I show the process of building a

TABLE 8

Figure 8A:
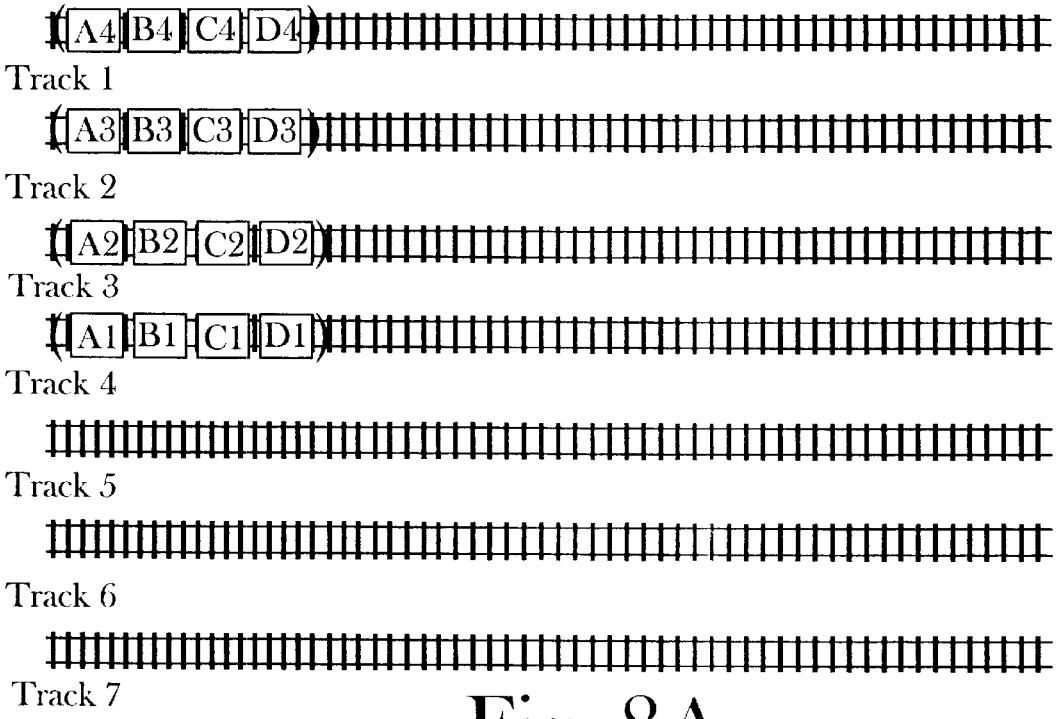
Fig. 8A Prior Art
FIGS. 8A thru 8E show the prior art "Sorting by block" (also called "arithmetic") sorting pattern, working through an example to show how four trains can be simultaneously built on four tracks.
Figure 8B:
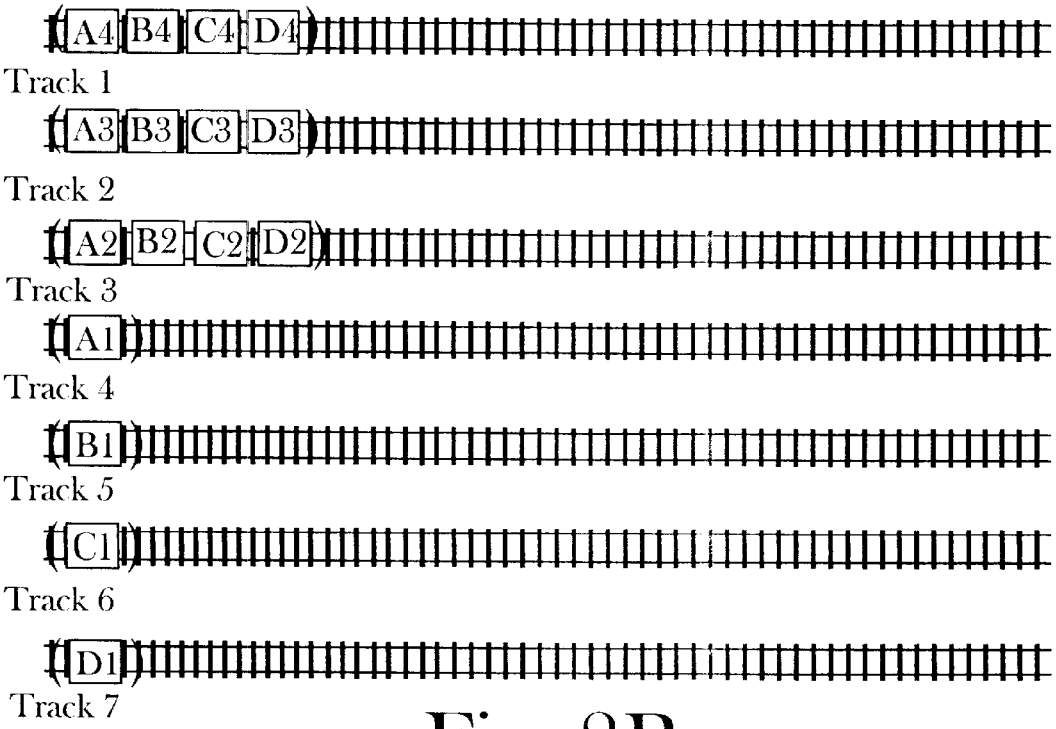
Fig. 8B Prior Art
Figure 8C:
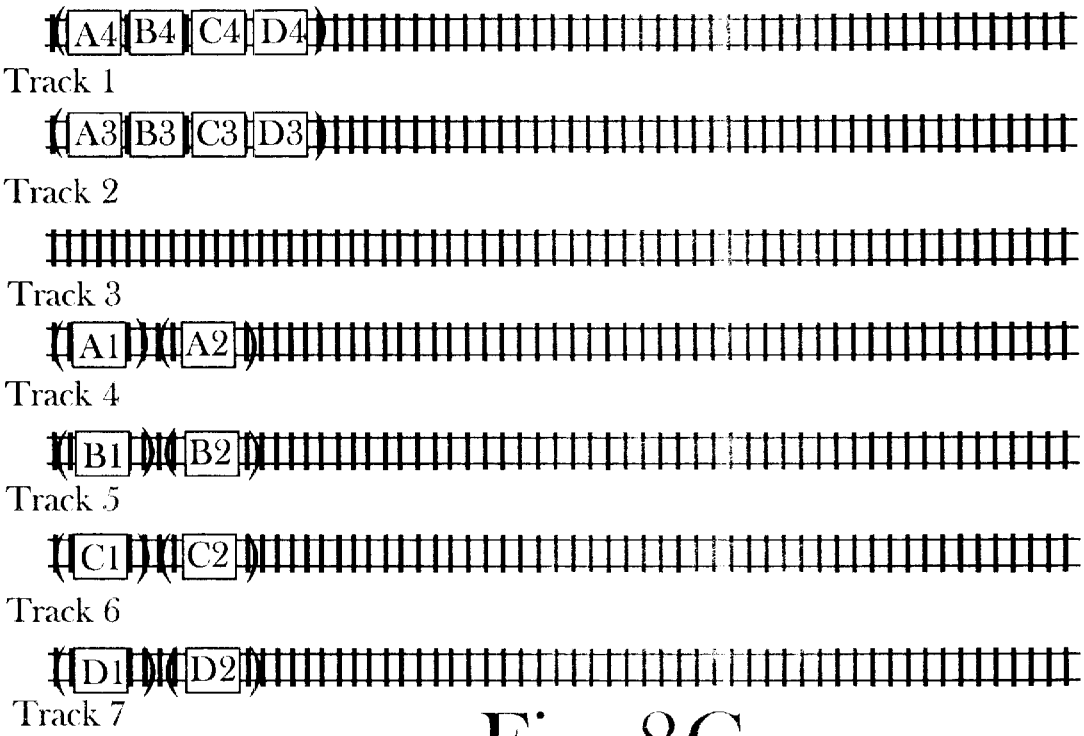
Fig. 8C Prior Art
Figure 8D:
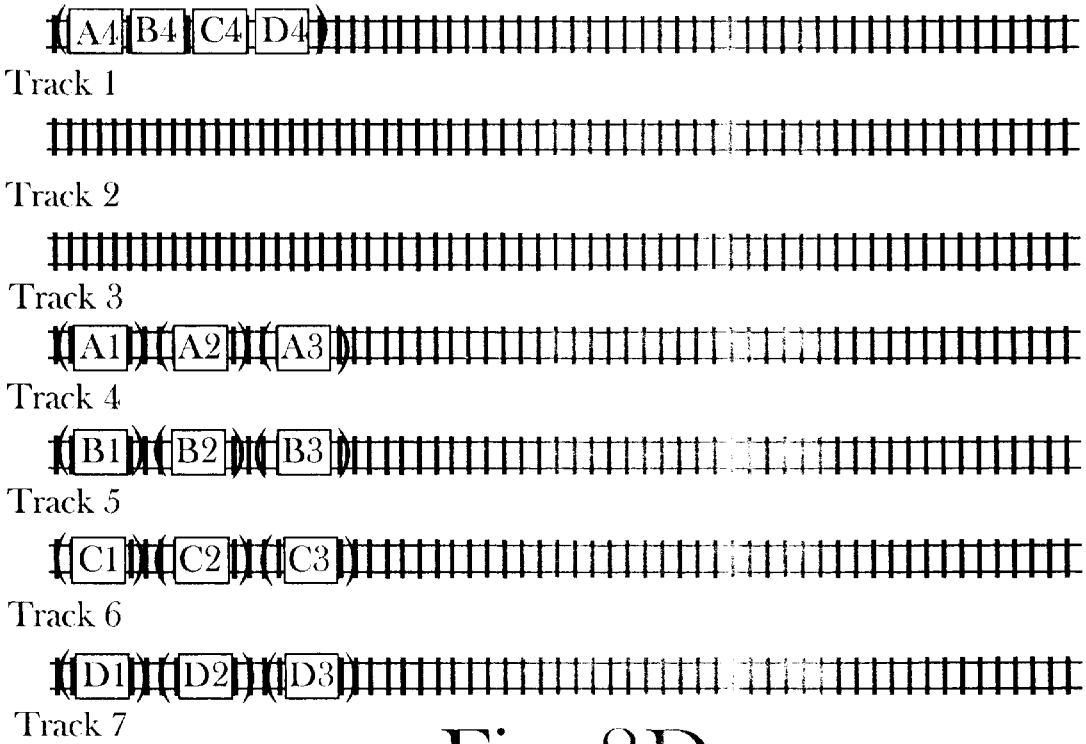
Fig. 8D Prior Art
Figure 8E:
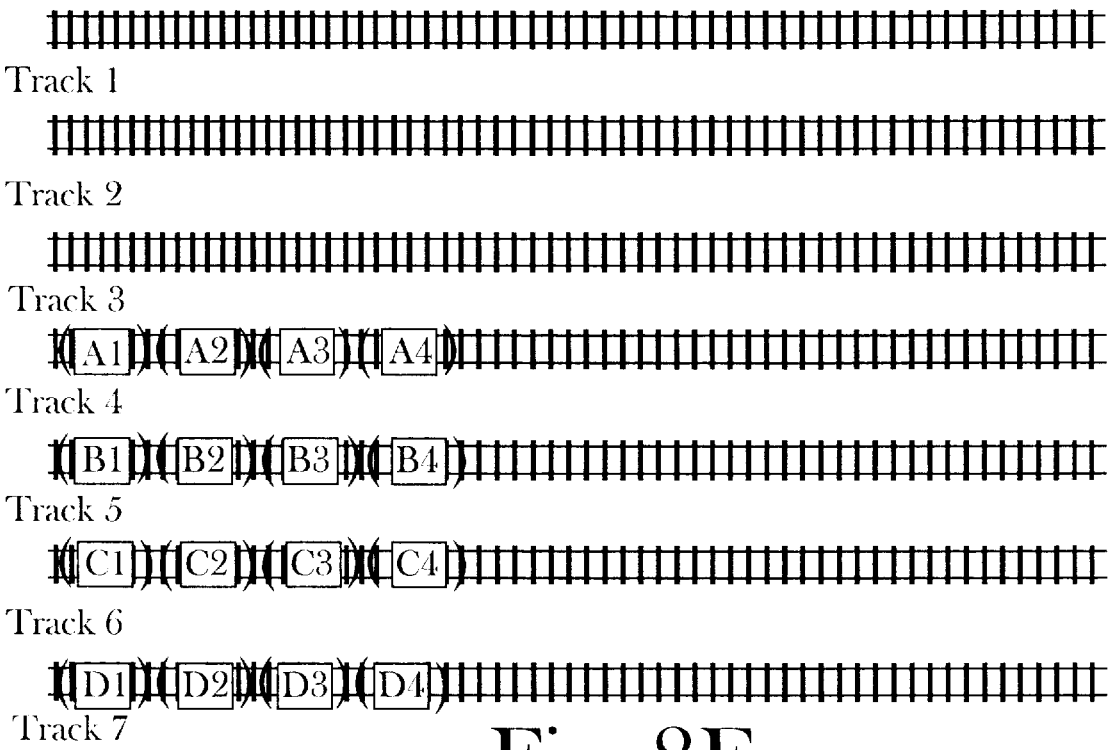
Fig. 8E Prior Art
Figure 9A:
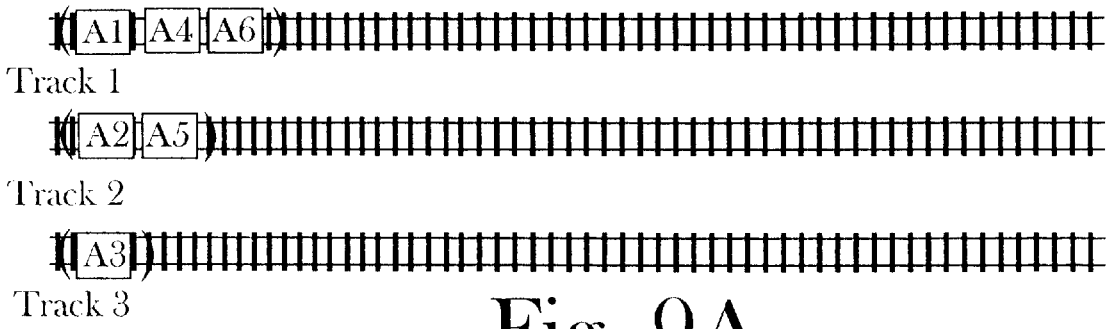
Fig. 9A Prior Art
FIGS. 9A thru 9D show a prior art "triangular" sorting pattern for a 7 block train, used to build a train having only 6 blocks. The position normally reserved for the third block has no cars, so blocks 4–7 have been renumbered 3–6.
Figure 9B:
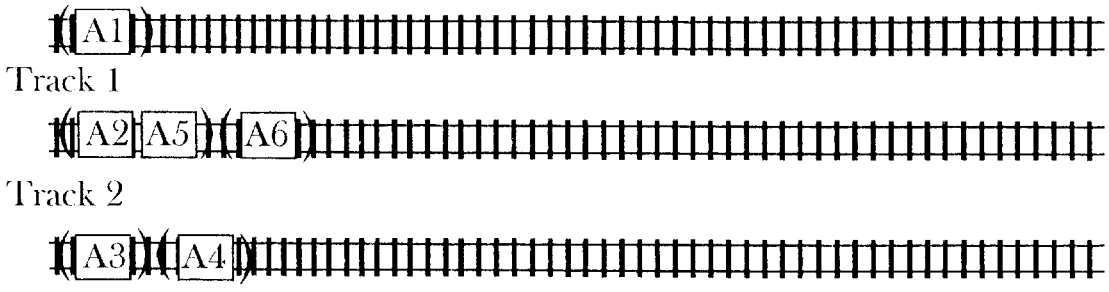
Fig. 9B Prior Art
Figure 9C:
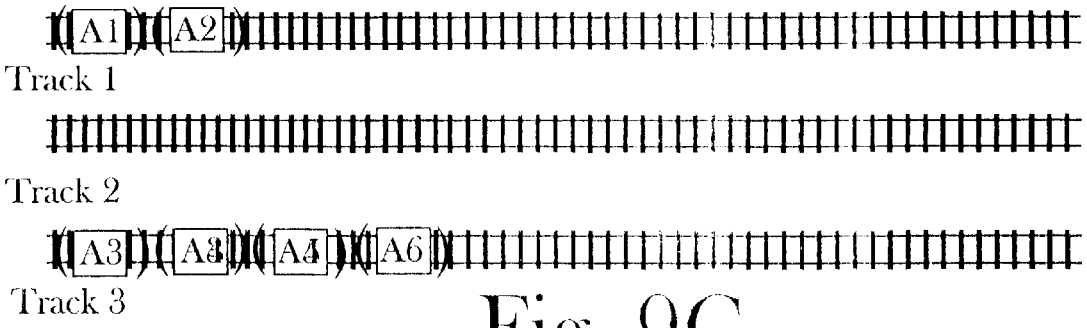
Fig. 9C Prior Art
Figure 9D:
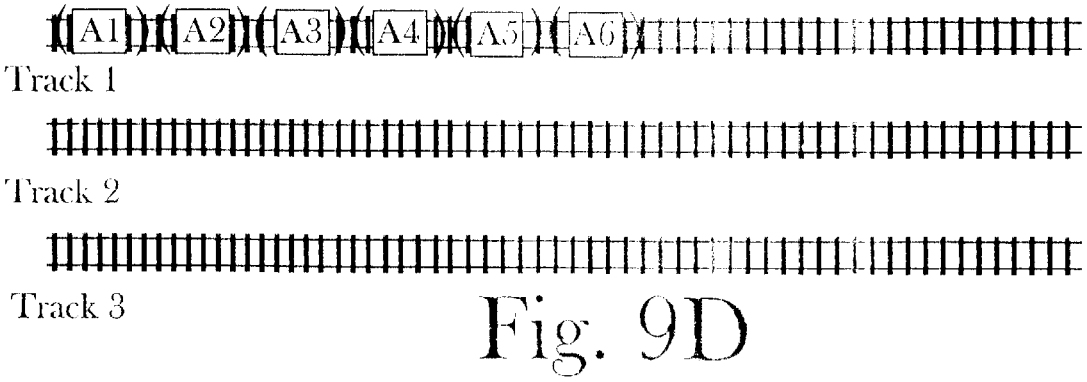
Fig. 9D Prior Art

| Prior Art | |
|---|---|
| First Stage Setup shown in FIG. 8A | A4,B4,C4,D4 to Track 1<br>A3,B3,C3,D3 to Track 2<br>A2,B2,B2,D2 to Track 3<br>A1,B1,C1,D1 to Track 4 |
| Pull Back Track 4 from the right side, and reclassify as follows. Outcome shown in FIG. 8B. | A1 to Track 4<br>B1 to Track 5<br>C1 to Track 6<br>D1 to Track 7 |
| Pull Back Track 3 from the right side, and reclassify as follows. Outcome shown in FIG. 8C. | A2 to Track 4<br>B2 to Track 5<br>C2 to Track 6<br>D2 to Track 7 |
| Pull Back Track 2 from the right side, and reclassify as follows. Outcome shown in FIG. 8D. | A3 to Track 4<br>B3 to Track 5<br>C3 to Track 6<br>C3 to Track 7 |
| Pull Back Track 1 from the right side, and reclassify as follows. Outcome shown in FIG. 8E. All four trains are ready for departure towards the left. | A4 to Track 4<br>B4 to Track 5<br>C4 to Track 6<br>C4 to Track 7 |

TABLE 21

Figure 21A:
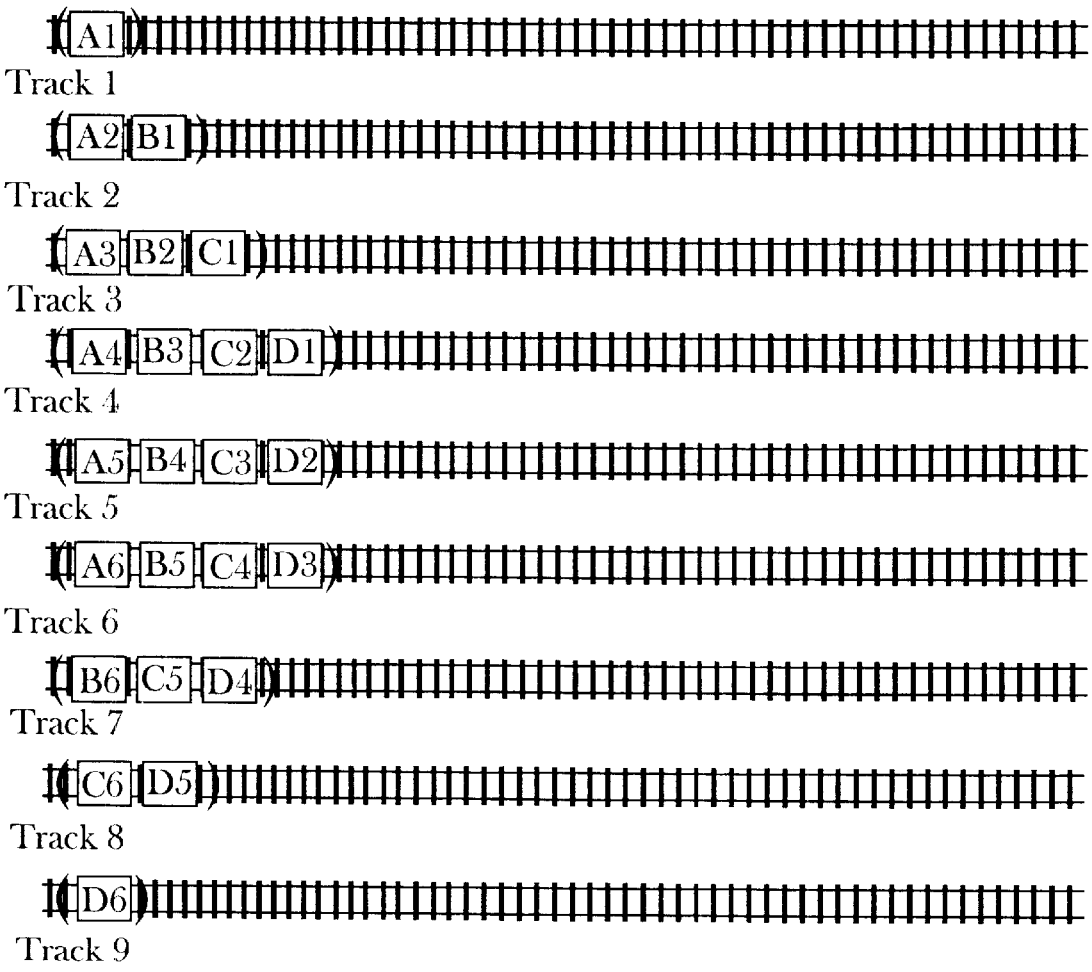
FIG. 21A through 21I show a continuous version of the "arithmetic" or "sorting by block" method in accordance with this invention.
Figure 21B:
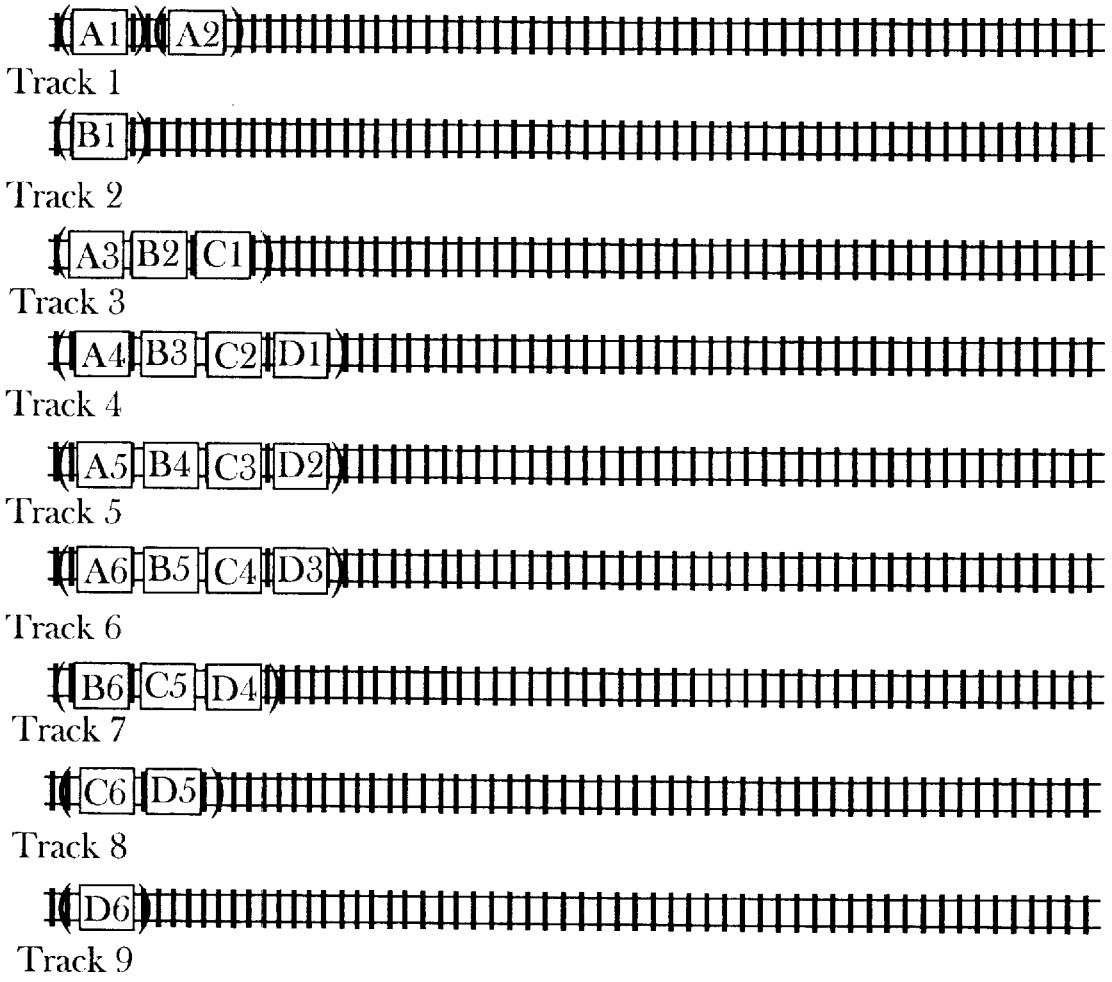
Figure 21C:
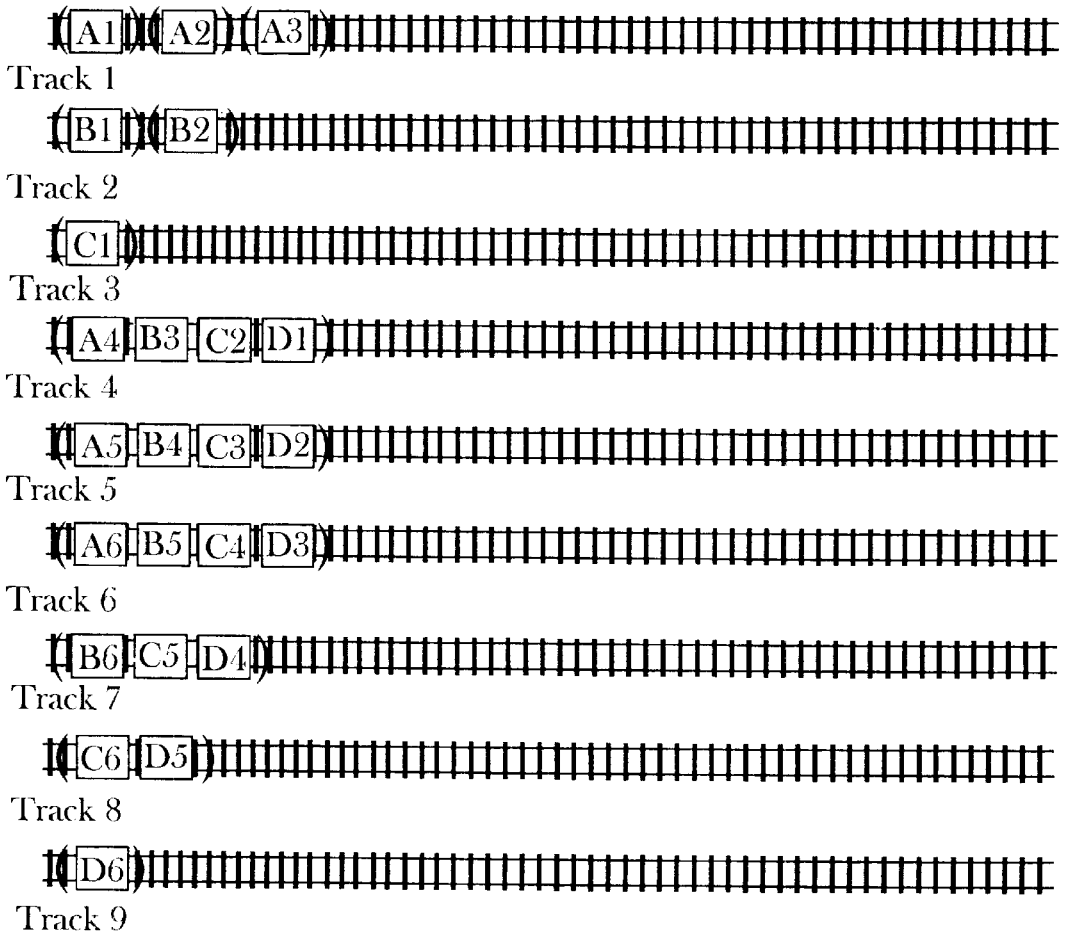
Figure 21D:
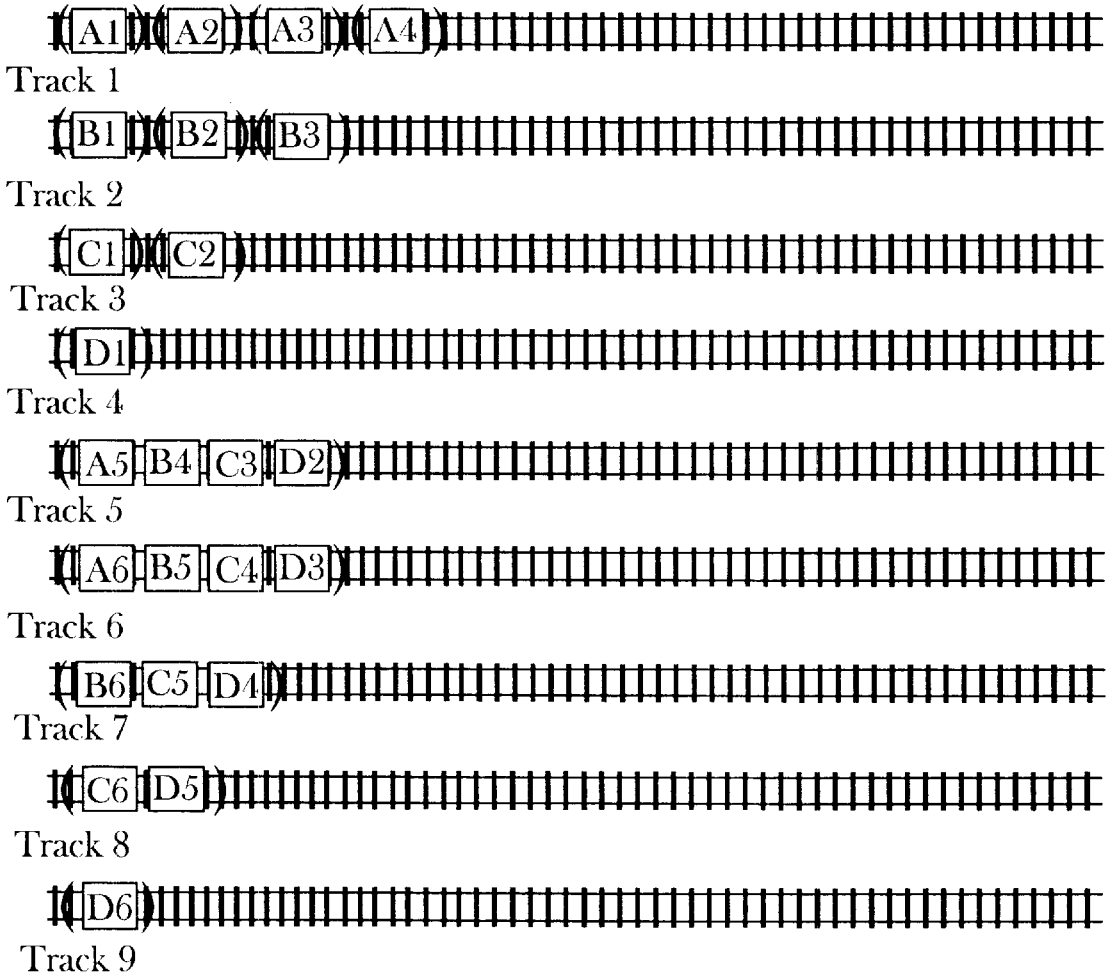
Figure 21E:
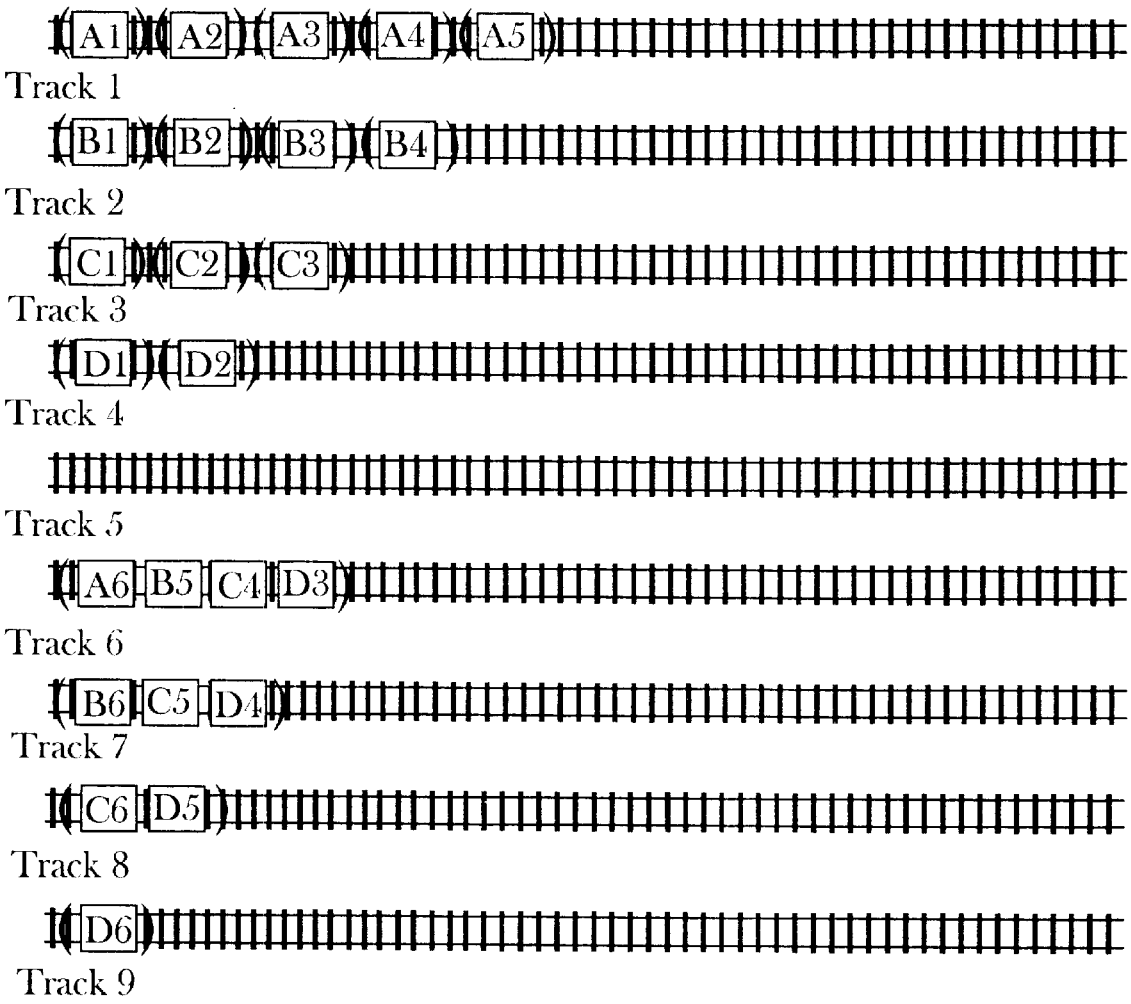
Figure 21F:
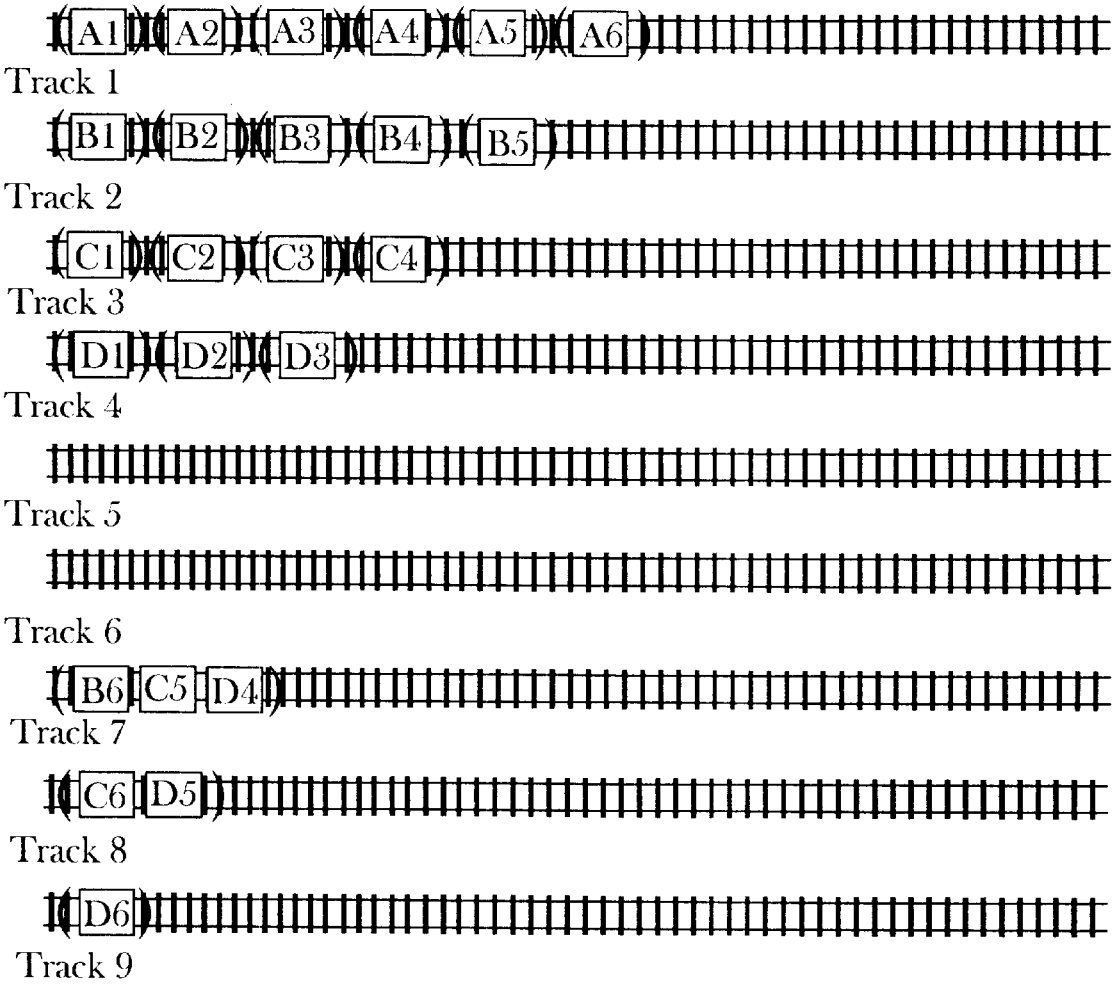
Figure 21G:
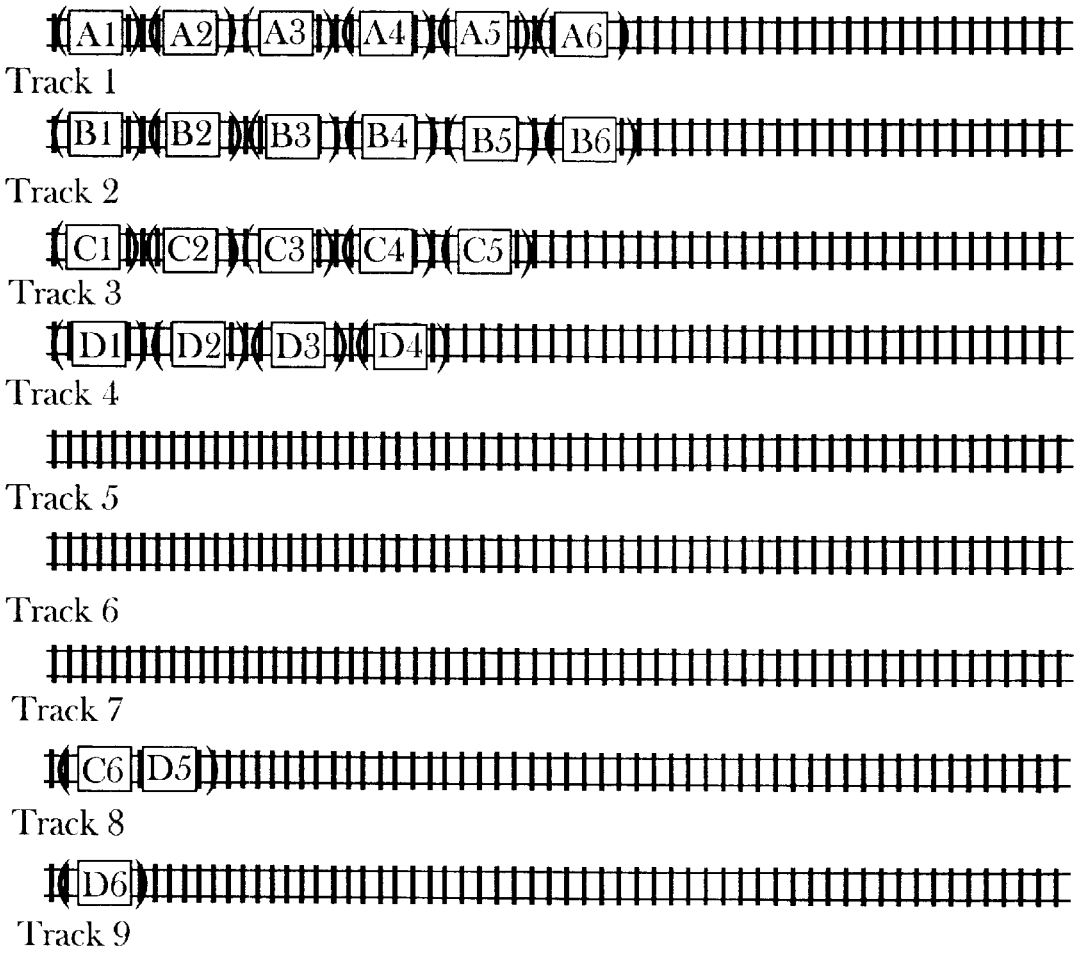
Figure 21H:
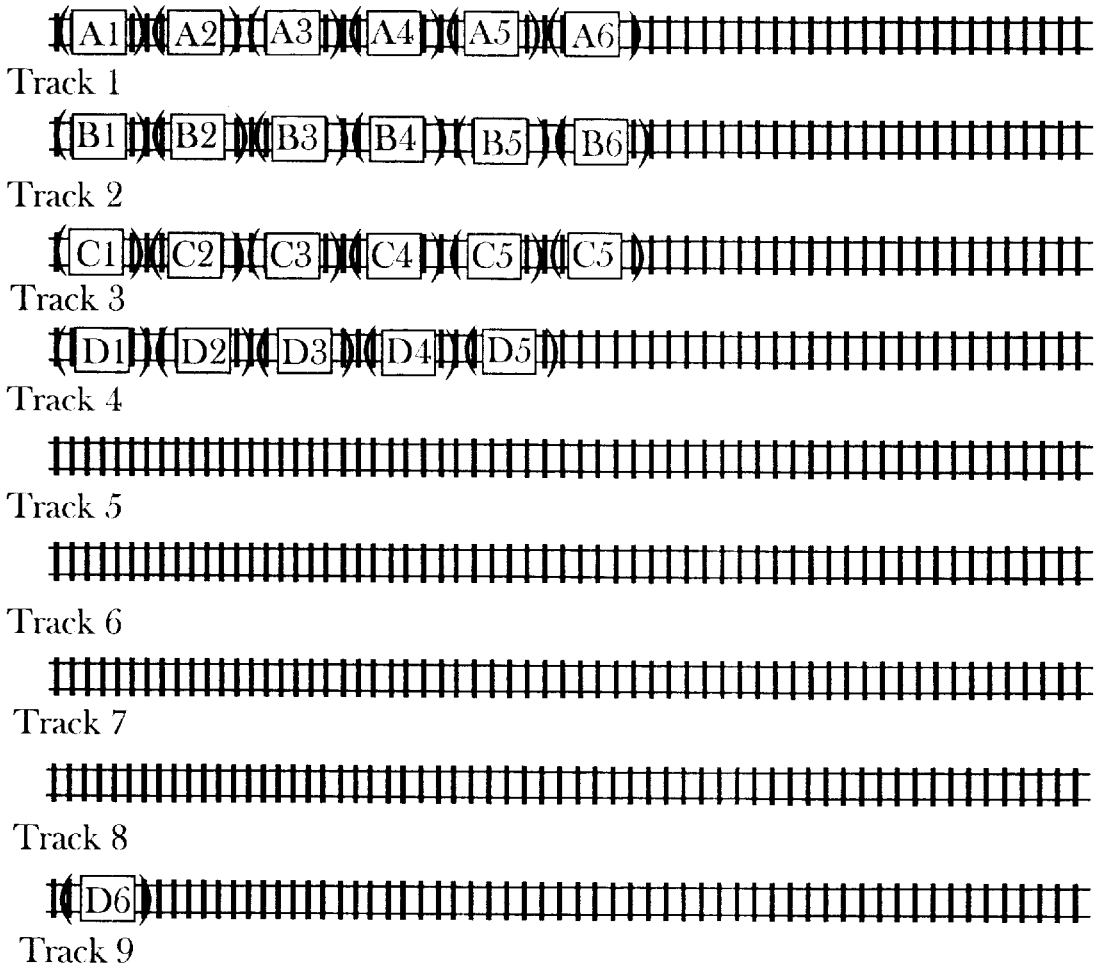
Figure 21I:
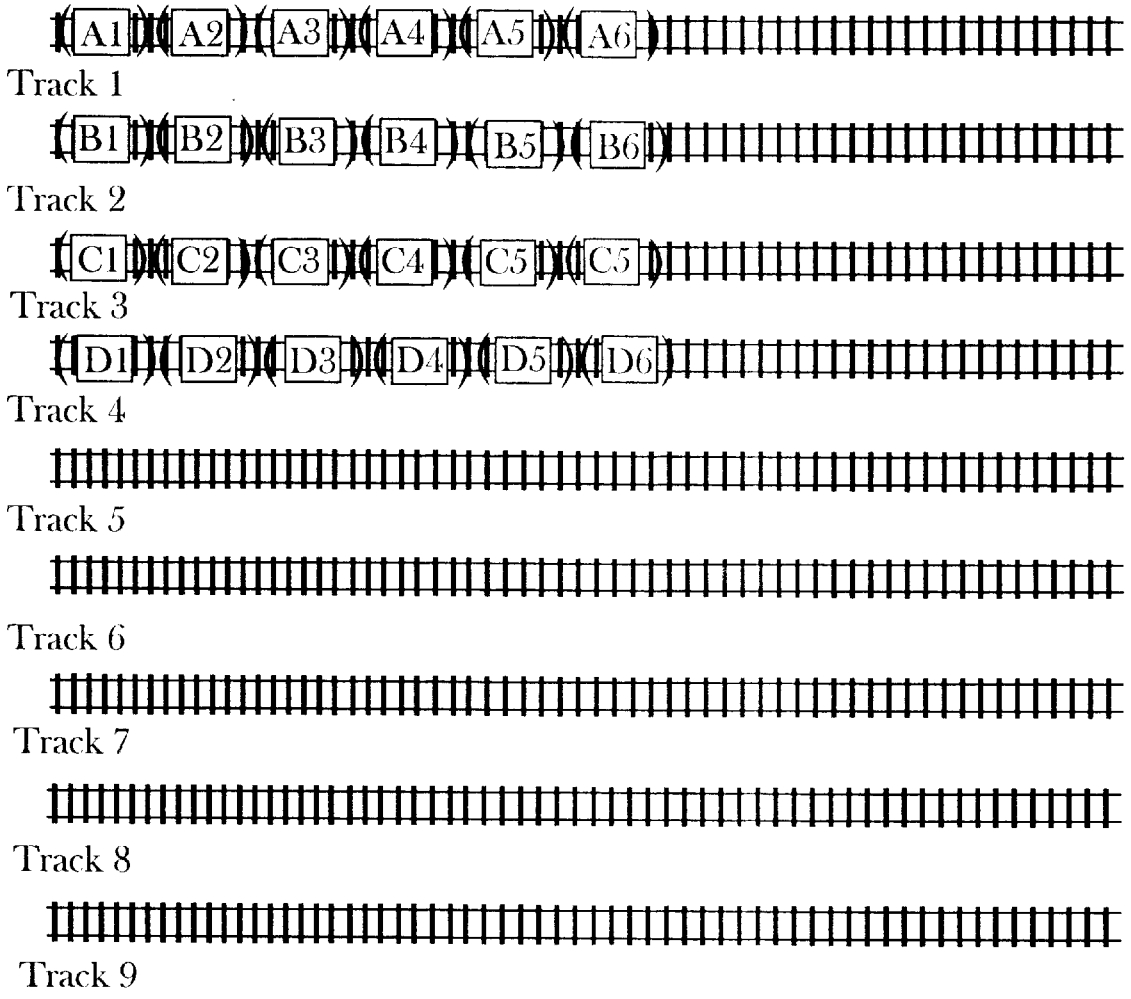

| | |
|---|---|
| First Stage Setup shown in FIG. 21A | A1 to Track 1<br>A2,B1 to Track 2<br>A3,B2,C1 to Track 3<br>A4,B3,C2,D1 to Track 4<br>A5,B4,C3,D2 to Track 5<br>A6,B5,C4,D3 to Track 6<br>B6,C5,D4 to Track 7<br>C6,D5 to Track 8<br>D6 to Track 9 |
| Pull Back Track 2 from the right side, and reclassify as follows. Outcome shown in FIG. 21B. | A2 to Track 1<br>B1 to Track 2 |
| Pull Back Track 3 from the right side, and reclassify as follows. Outcome shown in FIG. 21C. | A3 to Track 1<br>B2 to Track 2<br>C1 to Track 3 |
| Pull Back Track 4 from the right side, and reclassify as follows. Outcome shown in FIG. 21D. | A4 to Track 1<br>B3 to Track 2<br>C2 to Track 3<br>D1 to Track 4 |
| Pull Back Track 5 from the right. side, and reclassify as follows. Outcome shown in FIG. 21E. | A5 to Track 1<br>B4 to Track 2<br>C3 to Track 3<br>D2 to Track 4 |
| Pull Back Track 6 from the right side, and reclassify as follows. Outcome shown in FIG. 21F. | A6 to Track 1<br>(Train A is completed)<br>B5 to Track 2<br>C4 to Track 3<br>D3 to Track 4 |
| Pull Back Track 7 from the right side, and reclassify as follows. Outcome shown in FIG. 21G. | B6 to Track 2<br>(Train B is completed)<br>C5 to Track 3<br>D4 to Track 4 |
| Pull Back Track 8 from the right side, and reclassify as follows. Outcome shown in FIG. 21H. | C6 to Track 3<br>(Train C is completed)<br>D5 to Track 4 |
| Pull Back Track 9 from the right side, and reclassify as follows. Outcome shown in FIG. 21I. All four trains are ready for departure towards the left. | D6 to Track 4<br>(Train D is completed) |

six-block train using continuous arithmetic sorting. Table 21 describes the sequence of railcar movements shown in drawing FIGS. 21A–21I. This requires reprocessing six tracks to complete construction of the first train, which also starts assembly of five other trains. This excessive interdependency between multiple trains is a major weakness of the arithmetic sorting method. Because of this high degree of overlap, the continuous "sorting by block" pattern seems best suited for assembling trains containing no more than three or four blocks at most; or for very high volume facilities which depart trains on very regular, frequent intervals. By contrast, triangular sorting can build a six block train having overlapping assignment with no more than one or two other trains.

In general, triangular sorting yards appear to be less expensive to construct, and simpler and more flexible in operation than "folded" arithmetic yard designs. Having less overlap between trains, and by offering more flexibility than arithmetic sorting, the "preferred embodiment" of FIG. 10 based on triangular sorting appears to be the superior design for common applications.

Accordingly, the reader will see that the multiple stage railcar sorting methods presented here may be used to select particular railcars on a priority basis, for departure on specific outbound trains as well as offering numerous other advantages. New yard designs needed to optimize application of the methods have also been presented. These same methods may also be implemented in conventional yards with some loss of efficiency. Given the multi billion dollar investment the rail industry has made in prior art, single stage sorting yards—and the enormous time and expense required to replace all of them—serious consideration should be given either to implementation of these multiple stage methods, or further development and refinement of single stage priority sorting methods, in existing facilities.

Alternatively, new multiple stage sorting yards may be built at a few strategic locations, to establish a guaranteed delivery time train service network for single car rail shipments. Either approach would permit implementation of freight railroad revenue management, to provide an effective means of establishing guaranteed delivery appointments for every railcar.

These multiple stage sorting methods have many advantages, some previously refered to:

(a) By allowing for inspection and repair of cars during otherwise idle time spent in the classification yard, the total amount of time required to pass through the yard can be reduced.

(b) By offsetting and overlapping track assignment patterns for subsequent trains, the multiple stage sorting process can be sustained on a continuous basis.

(c) If the number of cars available exceeds the capacity of the train, the decision on exact train makeup can be deferred until the train is assembled, immediately before train departure rather than requiring such decisions 12–24 hours in advance.

(d) The bottleneck flat switching operation at the "trim" end of the yard is completely eliminated.

(e) A variety of yard configuration options have been presented allowing facilities to be sized appropriately to their intended workloads. Small hump yards can be economically constructed to replace obsolete flat switching facilities, allowing more direct "point to point" operations and reducing the number of required intermediate terminal handlings.

(f) The yard designs proposed here have the capacity of a traditional hump yard facility while maintaining the flexibility associated with traditional flat yard design.

Although the description above contains many specificities, these should not be construed as limiting the scope of the invention, but as merely providing illustrations of some of the presently preferred embodiments of the invention. For example, these methods can be accomplished in conventional railyard designs, so the scope of the process claims is not limited to the physical railyard designs presented here. Those rail yard designs improve the efficiency of the multiple stage sorting methods and highlight some of the deficiencies of current yard designs, as well as demonstrate reduction to practice of the new sorting methods.

Thus the scope of the invention should be determined by the appended claims and their legal equivalents, rather than by the examples given.

What is claimed is:

1. A method of sorting a plurality of rail-cars into a plurality of outbound trains on a plurality of tracks, comprising the steps of:

(a) initially arranging said railcars on a plurality of said tracks in a predetermined mathematical sorting pattern such that said railcars of more than one train or block may be intermixed on any single said track in a first stage sort, (b) offsetting and overlapping the mathematical sorting pattern of track assignments of said railcars for different trains or blocks in said first stage sort, for enabling the sorting method to be sustained on a continuous basis, (c) collecting said railcars on said tracks for an interval of time until the first outbound train must be readied for departure, (d) retrieving said railcars from said tracks in a predetermined sequence, and (e) rearranging said railcars on said tracks one or more additional times as required by the predetermined mathematical sorting pattern, such that said railcars are no longer intermixed but are separated into distinct trains which may have more than one block on a single track, whereby said railcars will be arranged into trains ordered in a proper block sequence for departure and the sorting method can be sustained on a continuous basis.

2. The sorting method of claim 1 wherein said mathematical sorting pattern is selected from the group consisting of arithmetic, triangular or geometric patterns.

3. The sorting method of claim 2 wherein said sorting pattern is perturbed by skipping predetermined block positions.

4. The sorting method of claim 2 wherein said sorting pattern is perturbed by reversing the sequence of block positions.

5. The sorting method of claim 1 performed in a railyard facility having classification tracks substantially equal to the normal train length operated in that geographic territory, so that trains may be ordered in proper block sequence ready for departure on a single track.

6. The sorting method of claim 1 performed in a railyard facility which performs receiving and departure operations on the same tracks used for classification or sorting purposes.

7. The sorting method of claim 1 performed in a railyard facility where mechanical inspection or repairs are conducted on the same tracks used for classification or sorting purposes.

8. The sorting method of claim 1 used for the purpose of predetermining and guaranteeing connections for specific railcars to specific outbound trains.

9. A method of predetermining connections of specific railcars to specific outbound trains, comprising the steps of:

(a) initially arranging said railcars on a plurality of tracks in a yard in a predetermined mathematical sorting pattern such that said railcars of more than one train or block may be intermixed on any single said track in a first stage sort, (b) collecting said railcars on said tracks for an interval of time until the first outbound train must be readied for departure, (c) retrieving said railcars from said tracks in a predetermined sequence, and (d) rearranging said railcars on said tracks one or more additional times as required by the predetermined mathematical sorting pattern, such that said railcars are no longer intermixed but are separated into distinct trains which may have more than one block on a single track, (e) removing from the train any of said railcars in excess of train capacity, or which are undesired by the customer during a second stage, third stage or later sort, whereby only preselected or said railcars are included in the train, and all other of said railcars are separated to remain in the yard or depart on a different train.

10. The method of predetermining railcar connections of claim 9 wherein said mathematical sorting pattern is selected from the group consisting of arithmetic, triangular or geometric patterns.

11. The method of predetermining railcar connections of claim 10 wherein said sorting pattern is perturbed by skipping predetermined block positions.

12. The method of predetermining railcar connections of claim 10 wherein said sorting pattern is perturbed by reversing the sequence of block positions.

13. The method of predetermining railcar connections of claim 10 using offsetting and overlapping track assignments in said first stage sort, for enabling the sorting process to be sustained on a continuous basis.

14. The method of predetermining railcar connections of claim 10 without using offsetting and overlapping track assignments in said first stage sort, to sort trains in discrete groups or batches.

15. The method of predetermining railcar connections of claim 9 wherein said railcars are initially sorted by train in a first stage sort, and a herringbone track arrangement is used to build the departing train in a second stage sort.

16. A method of performing inspection and repairs of railcars, utilizing otherwise idle time of railcars while said railcars are awaiting outbound connections on tracks, comprising the steps of:

(a) initially arranging said railcars on a plurality of tracks in a predetermined mathematical sorting pattern such that said railcars of more than one train or block may be intermixed on any single said track in a first stage sort, (b) collecting said railcars on said tracks for an interval of time until a first outbound train must be readied for departure, (c) retrieving said railcars from said tracks in a predetermined sequence, and (d) rearranging said railcars on said tracks one or more additional times as required by the predetermined mathematical sorting pattern, such that said railcars are no longer intermixed but are separated into distinct trains which may have more than one block on a single track, (e) during a second or later stage sorting operation, inspecting and repairing said railcars on tracks which are not receiving any other railcars during said second or later stage sorting phase;

whereby inspection and repairs of railcars may be safely performed while the railcars lie on classification tracks.

17. A method as in claim 16 further including the step of providing direct access by mechanical personnel, repair parts and tools to said railcars resting on said tracks to facilitate inspection and repairs of said railcars.

18. A method as in claim 17 wherein said direct access is provided by roads and/or paths between adjacent of said tracks.

19. The method of performing inspection and repairs of claim 16 wherein said mathematical sorting pattern is selected from the group consisting of arithmetic, triangular or geometric patterns.

20. The method of performing inspection and repairs of claim 19 wherein said sorting pattern is perturbed by skipping predetermined block positions.

21. The method of performing inspection and repairs of claim 19 wherein said sorting pattern is perturbed by reversing the sequence of block positions.

22. The method of performing inspection and repairs of claim 19 using offsetting and overlapping track assignments in said first stage sort, for enabling the sorting process to be sustained on a continuous basis.

23. The method of performing inspection and repairs of claim 19 without using offsetting and overlapping track assignments in said first stage sort, to sort trains in discrete groups or batches.

24. A railcar sorting facility connected to a mainline, branch or secondary track, comprising:

a plurality of classification tracks onto which railcars can be sorted and stored until departure from said sorting facility, the lengths of each said classification tracks being substantially equal to a normal train length typically operated in the geographic territory in which said sorting facility is located;

at least one switching lead track and means for accelerating individual railcars or groups of railcars connected in operative relationship with each other and with said classification tracks for enabling acceleration of individual railcars, or groups of railcars onto said classification tracks while providing adequate separation between groups of railcars to allow for safe sorting operations;

a first plurality of track switches connected in operative relationship with said switching lead track or tracks and said classification tracks for routing said railcars, or groups of railcars, onto said classification tracks and for selecting which of said classification tracks will receive each of said railcars or group of railcars;

means in operative relationship with said classification tracks for decelerating said railcars, or groups of railcars, and for controlling their coupling speed within safe limits;

means in operative relationship with said classification tracks and with said mainline track for enabling arrival and departure of inbound and outbound trains directly from said classification tracks, and for enabling arriving trains to be received onto said classification tracks for storage while awaiting processing, whereby through application of multiple stage switching methods, trains of more than one block may be ordered in proper standing order sequence ready for departure on a single said classification track, eliminating the need for railcars to be switched into a separate set of departure tracks for final train assembly.

25. A railyard facility as in claim 24 wherein said accelerating means includes an elevated hump from which railcars are allowed to freely roll.

26. A railyard facility as in claim 24 wherein said accelerating means includes a mechanical car pusher device.

27. A railyard facility as in claim 24 wherein said accelerating means includes a locomotive.

28. A railyard facility as in claim 24 further including roads and/or paths located between adjacent ones of said classification tracks to facilitate performance of mechanical inspection and/or repairs on said classification tracks.

29. A railyard facility as in claim 24 further including a second plurality of switches located at the opposite end of the yard from the railcar accelerating means, and in operative relationship with said classification tracks and with said mainline track for enabling arrival and departure of inbound and outbound trains using said second plurality of switches.

30. A railyard facility as in claim 24 further including an escape track located at the same end of the yard as the railcar accelerating means, and in operative relationship with said classification tracks and with said mainline track for enabling arrival and departure of inbound and outbound trains using said escape track.

31. A railyard facility as in claim 24 further including a switching lead track in operative relationship with said classification tracks and with said mainline track for enabling arrival and departure of inbound and outbound trains using said switching lead track.

32. A railyard facility as in claim 31 further including a hump in operative relationship with said classification tracks and with said mainline track for enabling arrival and departure of inbound and outbound trains over the hump.

* * * * *

UNITED STATES PATENT AND TRADEMARK OFFICE

CERTIFICATE OF CORRECTION

PATENT NO. : 6,418,854 B1
DATED : July 16, 2002
INVENTOR(S) : Edwin R. Kraft

It is certified that error appears in the above-identified patent and that said Letters Patent is hereby corrected as shown below:

Column 1,
Line 16, the question mark "?" should be deleted and substituted with a comma -- , --.

Column 2,
Line 26, the word "sing" should be -- sorting --.

Column 3,
Line 8, the semicolon ";" should be deleted.

Column 6,
Line 60, the left parenthesis in the superscript should be part of the superscript and should appear as -- (j-l) --.

Column 7,
Line 52, delete the apostrophe "'".

Column 10,
Line 27, delete the colon ":".

Column 18,
Line 35, delete "Troop" and insert -- Troup --.

Colum 20,
Line 13, delete "left Since each tram" and substitute -- left. Since each train --.

Column 25,
Line 29, in Table 8, delete "C3 to Track 7" and substitute -- D3 to Track 7 --.
Line 33, in Table 8, delete "C4 to Track 7" and substitute -- D4 to Track 7 --.

UNITED STATES PATENT AND TRADEMARK OFFICE

CERTIFICATE OF CORRECTION

PATENT NO. : 6,418,854 B1
DATED : July 16, 2002
INVENTOR(S) : Edwin R. Kraft

It is certified that error appears in the above-identified patent and that said Letters Patent is hereby corrected as shown below:

Column 28,
Line 26, delete “preselected or” and change to -- preselected of --.

Signed and Sealed this

Second Day of September, 2003

JAMES E. ROGAN
*Director of the United States Patent and Trademark Office*